US009871323B2

(12) United States Patent
Horchler et al.

(10) Patent No.: US 9,871,323 B2
(45) Date of Patent: Jan. 16, 2018

(54) ELECTRICAL CONNECTOR WITH REDUCED STACK HEIGHT

(71) Applicant: FCI Americas Technology LLC, Carson City, NV (US)

(72) Inventors: David C. Horchler, Millersburg, PA (US); Lewis Robin Johnson, Dover, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 15/402,146

(22) Filed: Jan. 9, 2017

(65) Prior Publication Data

US 2017/0125946 A1 May 4, 2017

Related U.S. Application Data

(63) Continuation of application No. 13/938,294, filed on Jul. 10, 2013, now Pat. No. 9,543,703.
(Continued)

(51) Int. Cl.
*H01R 13/631* (2006.01)
*H01R 13/64* (2006.01)
(Continued)

(52) U.S. Cl.
CPC ..... *H01R 13/631* (2013.01); *H01R 13/05* (2013.01); *H01R 13/64* (2013.01); *H01R 24/84* (2013.01); *H01R 2107/00* (2013.01)

(58) Field of Classification Search
CPC ..... H01R 13/64; H01R 13/05; H01R 12/716; H01R 12/71; H01R 13/6473; H01R 43/0256; H01R 12/52; H01R 43/20
See application file for complete search history.

(56) References Cited

U.S. PATENT DOCUMENTS 318,186 A 5/1885 Hertzog
741,052 A 10/1903 Mahon
(Continued)

FOREIGN PATENT DOCUMENTS

EP 0782220 A2 7/1997
EP 1209764 A1 5/2002
(Continued)

OTHER PUBLICATIONS

European Communication for European Application No. 13816468.6 dated Jun. 1, 2017.
(Continued)

*Primary Examiner* — Amy Cohen Johnson
*Assistant Examiner* — Matthew T Dzierzynski
(74) *Attorney, Agent, or Firm* — Wolf, Greenfield & Sacks, P.C.

(57) ABSTRACT

An electrical connector assembly includes first and second mezzanine electrical connectors that include respective first and second arrays of electrical contacts. The electrical contacts can be receptacle, or one can be a plug and the other can be a receptacle. Each electrical connector can further include at least one alignment member that cooperate to align the first and second arrays of electrical contacts relative to each other. Each electrical connector can further include at least one orientation member that allows the first and second electrical connectors to mate when in a predetermined orientation relative to each other.

18 Claims, 13 Drawing Sheets

Related U.S. Application Data

(60) Provisional application No. 61/806,327, filed on Mar. 28, 2013, provisional application No. 61/670,498, filed on Jul. 11, 2012.

(51) Int. Cl.

| | |
|---|---|
| ***H01R 12/71*** | (2011.01) |
| ***H01R 13/6473*** | (2011.01) |
| ***H01R 13/05*** | (2006.01) |
| ***H01R 24/84*** | (2011.01) |
| *H01R 107/00* | (2006.01) |

(56) References Cited

U.S. PATENT DOCUMENTS

| | | | |
|---|---|---|---|
| 1,477,527 | A | 12/1923 | Raettig |
| D86,515 | S | 3/1932 | Cox |
| 2,231,347 | A | 2/1941 | Reutter |
| 2,248,675 | A | 7/1941 | Huppert |
| 2,430,011 | A | 11/1947 | Gillentine |
| 2,664,552 | A | 12/1953 | Ericsson et al. |
| 2,759,163 | A | 8/1956 | Ustin et al. |
| 2,762,022 | A | 9/1956 | Benander et al. |
| 2,844,644 | A | 7/1958 | Soule, Jr. |
| 2,849,700 | A | 8/1958 | Perkin |
| 2,858,372 | A | 10/1958 | Kaufman |
| 3,011,143 | A | 11/1961 | Dean |
| 3,115,379 | A | 12/1963 | McKee |
| 3,178,669 | A | 4/1965 | Roberts |
| 3,179,738 | A | 4/1965 | De Lyon |
| 3,208,030 | A | 9/1965 | Evans et al. |
| 3,286,220 | A | 11/1966 | Marley et al. |
| 3,320,658 | A | 5/1967 | Bolda et al. |
| 3,343,120 | A | 9/1967 | Whiting |
| 3,366,729 | A | 1/1968 | Pauza |
| 3,411,127 | A | 11/1968 | Adams |
| 3,420,087 | A | 1/1969 | Hatfield et al. |
| D213,697 | S | 4/1969 | Oxley |
| 3,482,201 | A | 12/1969 | Schneck |
| 3,514,740 | A | 5/1970 | Filson et al. |
| 3,538,486 | A | 11/1970 | Shlesinger, Jr. |
| 3,560,908 | A | 2/1971 | Dell et al. |
| 3,591,834 | A | 7/1971 | Kolias |
| 3,634,811 | A | 1/1972 | Teagno et al. |
| 3,641,475 | A | 2/1972 | Irish et al. |
| 3,663,925 | A | 5/1972 | Proctor |
| 3,669,054 | A | 6/1972 | Desso et al. |
| 3,692,994 | A | 9/1972 | Hirschman et al. |
| 3,701,076 | A | 10/1972 | Irish |
| 3,719,981 | A | 3/1973 | Steitz |
| 3,732,697 | A | 5/1973 | Dickson |
| 3,748,633 | A | 7/1973 | Lundergan |
| 3,827,005 | A | 7/1974 | Friend |
| 3,845,451 | A | 10/1974 | Neidecker |
| 3,864,004 | A | 2/1975 | Friend |
| 3,865,462 | A | 2/1975 | Cobaugh et al. |
| 3,867,008 | A | 2/1975 | Gartland, Jr. |
| 3,871,015 | A | 3/1975 | Lin et al. |
| 3,889,364 | A | 6/1975 | Krueger |
| 3,942,856 | A | 3/1976 | Mindheim et al. |
| 3,972,580 | A | 8/1976 | Pemberton et al. |
| 4,030,792 | A | 6/1977 | Fuerst |
| 4,056,302 | A | 11/1977 | Braun et al. |
| 4,070,088 | A | 1/1978 | Vaden |
| 4,076,362 | A | 2/1978 | Ichimura |
| 4,082,407 | A | 4/1978 | Smorzaniuk et al. |
| 4,097,266 | A | 6/1978 | Takahashi et al. |
| 4,136,919 | A | 1/1979 | Howard et al. |
| 4,140,361 | A | 2/1979 | Sochor |
| 4,159,861 | A | 7/1979 | Anhalt |
| 4,217,024 | A | 8/1980 | Aldridge et al. |
| 4,232,924 | A | 11/1980 | Kline et al. |
| 4,260,212 | A | 4/1981 | Ritchie et al. |
| 4,274,700 | A | 6/1981 | Keglewitsch et al. |
| 4,288,139 | A | 9/1981 | Cobaugh et al. |
| 4,371,912 | A | 2/1983 | Guzik |
| 4,380,518 | A | 4/1983 | Wydro, Sr. |
| 4,383,724 | A | 5/1983 | Verhoeven |
| 4,395,086 | A | 7/1983 | Marsh |
| 4,396,140 | A | 8/1983 | Jaffe et al. |
| 4,402,563 | A | 9/1983 | Sinclair |
| 4,403,821 | A | 9/1983 | Zimmerman, Jr. et al. |
| 4,448,467 | A | 5/1984 | Weidler |
| 4,462,534 | A | 7/1984 | Bitaillou et al. |
| 4,464,003 | A | 8/1984 | Goodman et al. |
| 4,473,113 | A | 9/1984 | Whitfield et al. |
| 4,473,477 | A | 9/1984 | Beall |
| D275,849 | S | 10/1984 | Sakurai |
| 4,482,937 | A | 11/1984 | Berg |
| 4,505,529 | A | 3/1985 | Barkus |
| 4,523,296 | A | 6/1985 | Healy, Jr. |
| 4,533,187 | A | 8/1985 | Kirkman |
| 4,536,955 | A | 8/1985 | Gudgeon |
| 4,545,610 | A | 10/1985 | Lakritz et al. |
| 4,552,425 | A | 11/1985 | Billman |
| 4,560,222 | A | 12/1985 | Dambach |
| 4,564,259 | A | 1/1986 | Vandame |
| 4,592,846 | A | 6/1986 | Metzger et al. |
| 4,596,428 | A | 6/1986 | Tengler |
| 4,596,433 | A | 6/1986 | Oesterheld et al. |
| 4,624,604 | A | 11/1986 | Wagner et al. |
| 4,632,476 | A | 12/1986 | Schell |
| 4,641,426 | A | 2/1987 | Hartman et al. |
| 4,655,515 | A | 4/1987 | Hamsher, Jr. et al. |
| 4,664,309 | A | 5/1987 | Allen et al. |
| 4,664,456 | A | 5/1987 | Blair et al. |
| 4,664,458 | A | 5/1987 | Worth |
| 4,678,250 | A | 7/1987 | Romine et al. |
| 4,685,886 | A | 8/1987 | Denlinger et al. |
| 4,705,205 | A | 11/1987 | Allen et al. |
| 4,705,332 | A | 11/1987 | Sadigh-Behzadi |
| 4,717,360 | A | 1/1988 | Czaja |
| 4,722,470 | A | 2/1988 | Johary |
| 4,762,500 | A | 8/1988 | Dola et al. |
| 4,767,344 | A | 8/1988 | Noschese |
| 4,776,803 | A | 10/1988 | Pretchel et al. |
| 4,782,893 | A | 11/1988 | Thomas |
| 4,790,763 | A | 12/1988 | Weber et al. |
| 4,806,107 | A | 2/1989 | Arnold et al. |
| 4,815,987 | A | 3/1989 | Kawano et al. |
| 4,818,237 | A | 4/1989 | Weber |
| 4,820,169 | A | 4/1989 | Weber et al. |
| 4,820,182 | A | 4/1989 | Harwath et al. |
| 4,824,383 | A | 4/1989 | Lemke |
| 4,830,264 | A | 5/1989 | Bitaillou et al. |
| 4,836,791 | A | 6/1989 | Grabbe et al. |
| 4,844,813 | A | 7/1989 | Helfgott et al. |
| 4,846,727 | A | 7/1989 | Glover et al. |
| 4,850,887 | A | 7/1989 | Sugawara |
| 4,854,899 | A | 8/1989 | Matthews |
| 4,867,713 | A | 9/1989 | Ozu et al. |
| 4,871,110 | A | 10/1989 | Fukasawa et al. |
| 4,878,611 | A | 11/1989 | LoVasco et al. |
| 4,881,905 | A | 11/1989 | Demler, Jr. et al. |
| 4,882,554 | A | 11/1989 | Akaba et al. |
| 4,884,335 | A | 12/1989 | McCoy et al. |
| 4,898,539 | A | 2/1990 | Glover et al. |
| 4,900,271 | A | 2/1990 | Colleran et al. |
| 4,904,212 | A | 2/1990 | Durbin et al. |
| 4,907,990 | A | 3/1990 | Bertha et al. |
| 4,908,129 | A | 3/1990 | Finsterwalder et al. |
| 4,913,664 | A | 4/1990 | Dixon et al. |
| 4,915,641 | A | 4/1990 | Miskin et al. |
| 4,917,616 | A | 4/1990 | Demler, Jr. et al. |
| 4,952,172 | A | 8/1990 | Barkus et al. |
| 4,963,102 | A | 10/1990 | Gettig et al. |
| 4,965,699 | A | 10/1990 | Jorden et al. |
| 4,973,257 | A | 11/1990 | Lhotak |
| 4,973,271 | A | 11/1990 | Ishizuka et al. |
| 4,974,119 | A | 11/1990 | Martin |
| 4,975,069 | A | 12/1990 | Fedder et al. |
| 4,975,084 | A | 12/1990 | Fedder et al. |
| 4,979,074 | A | 12/1990 | Morley et al. |
| 4,997,390 | A | 3/1991 | Scholz et al. |

(56) References Cited

U.S. PATENT DOCUMENTS 5,004,426 A 4/1991 Barnett
5,016,968 A 5/1991 Hammond et al.
5,024,372 A 6/1991 Altman et al.
5,024,610 A 6/1991 French et al.
5,035,631 A 7/1991 Piorunneck et al.
5,035,639 A 7/1991 Kilpatrick et al.
5,046,960 A 9/1991 Fedder
5,052,953 A 10/1991 Weber
5,055,054 A 10/1991 Doutrich
5,060,844 A 10/1991 Behun et al.
5,065,282 A 11/1991 Polonio
5,066,236 A 11/1991 Broeksteeg
5,077,893 A 1/1992 Mosquera et al.
5,082,459 A 1/1992 Billman et al.
5,083,238 A 1/1992 Bousman
5,093,986 A 3/1992 Mandai et al.
5,094,623 A 3/1992 Scharf et al.
5,094,634 A 3/1992 Dixon et al.
5,098,311 A 3/1992 Roath et al.
5,104,332 A 4/1992 McCoy
5,104,341 A 4/1992 Gilissen et al.
5,111,991 A 5/1992 Clawson et al.
5,117,331 A 5/1992 Gebara
5,118,027 A 6/1992 Braun et al.
5,120,237 A 6/1992 Fussell
5,127,839 A 7/1992 Korsunsky et al.
5,131,871 A 7/1992 Banakis et al.
5,137,959 A 8/1992 Block et al.
5,139,426 A 8/1992 Barkus et al.
5,145,104 A 9/1992 Apap et al.
5,151,056 A 9/1992 McClune
5,152,700 A 10/1992 Bogursky et al.
5,161,987 A 11/1992 Sinisi
5,163,337 A 11/1992 Herron et al.
5,163,849 A 11/1992 Fogg et al.
5,167,528 A 12/1992 Nishiyama et al.
5,169,337 A 12/1992 Ortega et al.
5,174,770 A 12/1992 Sasaki et al.
5,181,855 A 1/1993 Mosquera et al.
5,194,480 A 3/1993 Block et al.
5,199,885 A 4/1993 Korsunsky et al.
5,203,075 A 4/1993 Angulas et al.
5,207,372 A 5/1993 Funari et al.
5,213,868 A 5/1993 Liberty et al.
5,214,308 A 5/1993 Nishiguchi et al.
5,217,381 A 6/1993 Zell et al.
5,222,649 A 6/1993 Funari et al.
5,224,867 A 7/1993 Ohtsuki et al.
5,228,864 A 7/1993 Fusselman et al.
5,229,016 A 7/1993 Hayes et al.
5,238,414 A 8/1993 Yaegashi et al.
5,254,012 A 10/1993 Wang
5,255,839 A 10/1993 da Costa Alves et al.
5,257,941 A 11/1993 Lwee et al.
5,261,155 A 11/1993 Angulas et al.
5,269,453 A 12/1993 Melton et al.
5,274,918 A 1/1994 Reed
5,275,330 A 1/1994 Isaacs et al.
5,276,964 A 1/1994 Anderson, Jr. et al.
5,277,624 A 1/1994 Champion et al.
5,284,287 A 2/1994 Wilson et al.
5,285,163 A 2/1994 Liotta
5,286,212 A 2/1994 Broeksteeg
5,288,949 A 2/1994 Crafts
5,295,843 A 3/1994 Davis et al.
5,298,791 A 3/1994 Liberty et al.
5,302,135 A 4/1994 Lee
5,321,582 A 6/1994 Caspersen
5,324,569 A 6/1994 Nagesh et al.
5,342,211 A 8/1994 Broeksteeg
5,344,327 A 9/1994 Brunker et al.
5,346,118 A 9/1994 Degani et al.
5,354,219 A 10/1994 Wanjura
5,355,283 A 10/1994 Marrs et al.
5,356,300 A 10/1994 Costello et al.
5,356,301 A 10/1994 Champion et al.
5,357,050 A 10/1994 Baran
5,358,417 A 10/1994 Schmedding
5,377,902 A 1/1995 Hayes
5,381,314 A 1/1995 Rudy, Jr. et al.
5,382,168 A 1/1995 Azuma et al.
D355,409 S 2/1995 Krokaugger
5,387,111 A 2/1995 DeSantis et al.
5,387,139 A 2/1995 McKee et al.
5,395,250 A 3/1995 Englert, Jr. et al.
5,400,949 A 3/1995 Hirvonen et al.
5,403,206 A 4/1995 McNamara et al.
5,409,157 A 4/1995 Nagesh et al.
5,410,807 A 5/1995 Bross et al.
5,427,543 A 6/1995 Dynia
5,429,520 A 7/1995 Morlion et al.
5,429,521 A 7/1995 Morlion et al.
5,431,332 A 7/1995 Kirby et al.
5,431,578 A 7/1995 Wayne
5,433,617 A 7/1995 Morlion et al.
5,433,618 A 7/1995 Morlion et al.
5,435,482 A 7/1995 Variot et al.
5,442,852 A 8/1995 Danner
5,445,313 A 8/1995 Boyd et al.
5,457,342 A 10/1995 Herbst, II
5,458,426 A 10/1995 Ito
5,462,440 A * 10/1995 Rothenberger ..... H01R 43/24 439/591
5,462,456 A 10/1995 Howell
5,467,913 A 11/1995 Namekawa et al.
5,474,472 A 12/1995 Niwa et al.
5,475,922 A 12/1995 Tamura et al.
5,477,933 A 12/1995 Nguyen
5,489,750 A 2/1996 Sakemi et al.
5,490,040 A 2/1996 Gaudenzi et al.
5,491,303 A 2/1996 Weiss
5,492,266 A 2/1996 Hoebener et al.
5,495,668 A 3/1996 Furusawa et al.
5,496,183 A 3/1996 Soes et al.
5,498,167 A 3/1996 Seto et al.
5,499,487 A 3/1996 McGill
5,504,277 A 4/1996 Danner
5,511,987 A 4/1996 Shinchi
5,512,519 A 4/1996 Hwang
5,516,030 A 5/1996 Denton
5,516,032 A 5/1996 Sakemi et al.
5,518,410 A 5/1996 Masami
5,519,580 A 5/1996 Natarajan et al.
5,522,727 A 6/1996 Saito et al.
5,533,915 A 7/1996 Deans
5,534,127 A 7/1996 Sakai
5,539,153 A 7/1996 Schwiebert et al.
5,542,174 A 8/1996 Chiu
5,558,542 A 9/1996 O'Sullivan et al.
5,564,952 A 10/1996 Davis
5,575,688 A 11/1996 Crane, Jr.
5,577,928 A 11/1996 Duclos
5,580,283 A 12/1996 O'Sullivan et al.
5,586,908 A 12/1996 Lorrain
5,586,914 A 12/1996 Foster, Jr. et al.
5,588,859 A 12/1996 Maurice
5,590,463 A 1/1997 Feldman et al.
5,591,118 A 1/1997 Bierck
5,591,941 A 1/1997 Acocella et al.
5,593,322 A 1/1997 Swamy et al.
5,605,417 A 2/1997 Englert et al.
5,609,502 A 3/1997 Thumma
5,613,882 A 3/1997 Hnatuck et al.
5,618,187 A 4/1997 Goto
5,634,821 A 6/1997 Crane, Jr.
5,637,008 A 6/1997 Kozel
5,637,019 A 6/1997 Crane, Jr. et al.
5,643,009 A 7/1997 Dinkel et al.
5,664,968 A 9/1997 Mickievicz
5,664,973 A 9/1997 Emmert et al.
5,667,392 A 9/1997 Kocher et al.
5,672,064 A 9/1997 Provencher et al.
5,685,073 A * 11/1997 Estes ..... H01R 12/52 29/827

(56) References Cited

U.S. PATENT DOCUMENTS 5,691,041 A 11/1997 Frankeny et al.
D387,733 S 12/1997 Lee
5,697,799 A 12/1997 Consoli et al.
5,702,255 A 12/1997 Murphy et al.
5,713,746 A 2/1998 Olson et al.
5,718,606 A 2/1998 Righy et al.
5,727,963 A 3/1998 LeMaster
5,730,609 A 3/1998 Harwath
5,733,453 A 3/1998 DeBusk
5,741,144 A 4/1998 Elco et al.
5,741,161 A 4/1998 Cahaly et al.
5,742,484 A 4/1998 Gillette et al.
5,743,009 A 4/1998 Matsui et al.
5,743,765 A 4/1998 Andrews et al.
5,745,349 A 4/1998 Lemke
5,746,608 A 5/1998 Taylor
5,749,746 A 5/1998 Tan et al.
5,755,595 A 5/1998 Davis et al.
5,766,023 A 6/1998 Noschese et al.
5,772,451 A 6/1998 Dozier, II et al.
5,782,644 A 7/1998 Kiat
5,787,971 A 8/1998 Dodson
5,795,191 A 8/1998 Preputnick et al.
5,810,607 A 9/1998 Shih et al.
5,817,973 A 10/1998 Elco
5,827,094 A 10/1998 Aizawa et al.
5,831,314 A 11/1998 Wen
5,833,475 A 11/1998 Mitra
5,846,024 A 12/1998 Mao et al.
5,851,121 A 12/1998 Thenaisie et al.
5,853,797 A 12/1998 Fuchs et al.
5,857,857 A 1/1999 Fukuda
5,860,816 A 1/1999 Provencher et al.
5,871,362 A 2/1999 Campbell et al.
5,874,776 A 2/1999 Kresge et al.
5,876,219 A 3/1999 Taylor et al.
5,876,222 A 3/1999 Gardner et al.
5,876,248 A 3/1999 Brunker et al.
5,882,214 A 3/1999 Hillbish et al.
5,883,782 A 3/1999 Thurston et al.
5,887,158 A 3/1999 Sample et al.
5,888,884 A 3/1999 Wojnarowski
5,892,791 A 4/1999 Moon
5,893,761 A 4/1999 Longueville
5,902,136 A 5/1999 Lemke et al.
5,904,581 A 5/1999 Pope et al.
5,908,333 A 6/1999 Perino et al.
5,913,702 A 6/1999 Garcin
5,919,050 A 7/1999 Kehley et al.
5,930,114 A 7/1999 Kuzmin et al.
5,938,479 A 8/1999 Paulson et al.
5,943,770 A 8/1999 Thenaisie et al.
5,955,888 A 9/1999 Frederickson et al.
5,961,355 A 10/1999 Morlion et al.
5,967,844 A 10/1999 Doutrich et al.
5,971,817 A 10/1999 Longueville
5,975,921 A 11/1999 Shuey
5,980,270 A 11/1999 Fjelstad et al.
5,980,321 A 11/1999 Cohen et al.
5,982,249 A 11/1999 Bruns
5,984,690 A 11/1999 Riechelmann et al.
5,984,726 A 11/1999 Wu
5,992,953 A 11/1999 Rabinovitz
5,993,259 A 11/1999 Stokoe et al.
6,012,948 A 1/2000 Wu
6,022,227 A 2/2000 Huang
6,024,584 A 2/2000 Lemke et al.
6,027,381 A 2/2000 Lok
6,036,549 A 3/2000 Wulff
6,041,498 A 3/2000 Hillbish et al.
6,042,389 A * 3/2000 Lemke ..... H01R 43/0256 439/74
6,042,394 A 3/2000 Mitra et al.
6,042,427 A 3/2000 Adriaenssens et al.
6,050,842 A 4/2000 Ferrill et al.
6,050,862 A 4/2000 Ishii
6,053,751 A 4/2000 Humphrey
6,059,170 A 5/2000 Jimarez et al.
6,066,048 A 5/2000 Lees
6,068,520 A 5/2000 Winings et al.
6,071,152 A 6/2000 Achammer et al.
6,077,089 A 6/2000 Bishop et al.
6,077,130 A 6/2000 Hughes et al.
6,083,047 A 7/2000 Paagman
6,086,386 A 7/2000 Fjelstad et al.
6,089,878 A 7/2000 Meng
6,095,827 A 8/2000 Dutkowsky et al.
6,113,418 A 9/2000 Kjeldahl
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,132,255 A 10/2000 Verhoeven
6,139,336 A 10/2000 Olson
6,146,157 A 11/2000 Lenoir et al.
6,146,202 A 11/2000 Ramey et al.
6,146,203 A 11/2000 Elco et al.
6,152,747 A 11/2000 McNamara
6,152,756 A 11/2000 Huang et al.
6,154,742 A 11/2000 Herriot
6,171,115 B1 1/2001 Mickievicz et al.
6,171,149 B1 1/2001 van Zanten
6,174,198 B1 1/2001 Wu et al.
6,179,663 B1 1/2001 Bradley et al.
6,180,891 B1 1/2001 Murdeshwar
6,183,287 B1 2/2001 Po
6,183,301 B1 2/2001 Paagman
6,190,213 B1 2/2001 Reichart et al.
6,193,537 B1 2/2001 Harper, Jr. et al.
6,196,871 B1 3/2001 Szu
6,202,916 B1 3/2001 Updike et al.
6,206,722 B1 3/2001 Ko et al.
6,206,735 B1 3/2001 Zanolli
6,210,197 B1 4/2001 Yu
6,210,240 B1 4/2001 Comerci et al.
6,212,755 B1 4/2001 Shimada et al.
6,215,180 B1 4/2001 Chen et al.
6,219,913 B1 4/2001 Uchiyama
6,220,884 B1 4/2001 Lin
6,220,895 B1 4/2001 Lin
6,220,896 B1 4/2001 Bertoncini et al.
6,227,882 B1 5/2001 Ortega et al.
6,231,391 B1 5/2001 Ramey et al.
6,234,851 B1 5/2001 Phillips
6,238,225 B1 5/2001 Middlehurst et al.
6,241,535 B1 6/2001 Lemke et al.
6,244,887 B1 6/2001 Commerci et al.
6,257,478 B1 7/2001 Straub
6,259,039 B1 7/2001 Chroneos, Jr. et al.
6,261,132 B1 7/2001 Koseki et al.
6,267,604 B1 7/2001 Mickievicz et al.
6,269,539 B1 8/2001 Takahashi et al.
6,274,474 B1 8/2001 Caletka et al.
6,280,209 B1 8/2001 Bassler et al.
6,280,230 B1 8/2001 Takase et al.
6,280,809 B1 8/2001 Wang et al.
6,290,552 B1 9/2001 Saito et al.
6,293,827 B1 9/2001 Stokoe
6,299,483 B1 10/2001 Cohen et al.
6,299,484 B2 10/2001 Van Woensel
6,299,492 B1 10/2001 Pierini et al.
6,302,711 B1 10/2001 Ito
6,309,245 B1 10/2001 Sweeney
6,319,075 B1 11/2001 Clark et al.
6,322,377 B2 11/2001 Middlehurst et al.
6,322,379 B1 11/2001 Ortega et al.
6,322,393 B1 11/2001 Doutrich et al.
6,328,602 B1 12/2001 Yamasaki et al.
6,338,635 B1 1/2002 Lee
6,343,955 B2 2/2002 Billman et al.
6,347,952 B1 2/2002 Hasegawa et al.
6,347,962 B1 2/2002 Kline
6,350,134 B1 2/2002 Fogg et al.

(56) References Cited

U.S. PATENT DOCUMENTS 6,354,877 B1 3/2002 Shuey et al.
6,358,061 B1 3/2002 Regnier
6,359,783 B1 3/2002 Noble
6,360,940 B1 3/2002 Bolde et al.
6,361,366 B1 3/2002 Shuey et al.
6,361,376 B1 3/2002 Onoda
6,362,961 B1 3/2002 Chiou
6,363,607 B1 4/2002 Chen et al.
6,364,710 B1 4/2002 Billman et al.
6,371,773 B1 4/2002 Crofoot et al.
6,371,813 B2 4/2002 Ramey et al.
6,375,478 B1 4/2002 Kikuchi
6,375,508 B1 4/2002 Pickles et al.
6,379,188 B1 4/2002 Cohen et al.
6,386,914 B1 5/2002 Collins et al.
6,386,924 B2 5/2002 Long
6,390,826 B1 5/2002 Affolter et al.
6,394,818 B1 5/2002 Smalley, Jr.
6,402,566 B1 6/2002 Middlehurst et al.
6,409,543 B1 6/2002 Astbury, Jr. et al.
6,414,248 B1 7/2002 Sundstrom
6,420,778 B1 7/2002 Sinyansky
6,425,785 B1 7/2002 Azuma
6,428,328 B2 8/2002 Haba et al.
6,431,914 B1 8/2002 Billman
6,431,921 B2 8/2002 Saito et al.
6,435,914 B1 8/2002 Billman
6,450,829 B1 9/2002 Weisz-Margulescu
6,457,983 B1 10/2002 Bassler et al.
6,461,183 B1 10/2002 Ohkita et al.
6,461,202 B2 10/2002 Kline
6,464,529 B1 10/2002 Jensen et al.
6,471,523 B1 10/2002 Shuey
6,471,548 B2 10/2002 Bertoncini et al.
6,472,474 B2 10/2002 Burkhardt et al.
6,482,038 B2 11/2002 Olson
6,485,330 B1 11/2002 Doutrich
6,488,549 B1 12/2002 Weller et al.
6,489,567 B2 12/2002 Zachrai
6,491,545 B1 12/2002 Spiegel et al.
6,494,734 B1 * 12/2002 Shuey ..... H01R 23/688 439/284
6,503,103 B1 1/2003 Cohen et al.
6,506,076 B2 1/2003 Cohen et al.
6,506,081 B2 1/2003 Blanchfield et al.
6,514,103 B2 2/2003 Pape et al.
6,517,360 B1 2/2003 Cohen
6,520,803 B1 2/2003 Dunn
6,526,519 B1 2/2003 Cuthbert
6,527,587 B1 3/2003 Ortega et al.
6,527,588 B2 3/2003 Paagman
6,528,737 B1 3/2003 Kwong et al.
6,530,134 B1 3/2003 Laphan et al.
6,537,086 B1 3/2003 Mac Mullin
6,537,111 B2 3/2003 Brammer et al.
6,540,522 B2 4/2003 Sipe
6,540,558 B1 4/2003 Paagman
6,540,559 B1 4/2003 Kemmick et al.
6,544,046 B1 4/2003 Hahn et al.
6,544,072 B2 4/2003 Olson
6,547,066 B2 4/2003 Koch
6,551,112 B1 4/2003 Li et al.
6,551,140 B2 4/2003 Billman et al.
6,554,647 B1 4/2003 Cohen et al.
6,565,387 B2 5/2003 Cohen
6,565,388 B1 5/2003 Van Woensel et al.
6,572,409 B2 6/2003 Nitta et al.
6,572,410 B1 6/2003 Volstorf et al.
6,575,774 B2 6/2003 Ling et al.
6,575,776 B1 6/2003 Conner et al.
6,589,071 B1 7/2003 Lias et al.
6,592,381 B2 7/2003 Cohen et al.
6,602,095 B2 8/2003 Astbury, Jr. et al.
6,604,967 B2 8/2003 Middlehurst et al.
6,607,402 B2 8/2003 Cohen et al.
6,623,310 B1 9/2003 Billman et al.
6,629,854 B2 10/2003 Murakami
6,633,490 B2 10/2003 Centola et al.
6,641,410 B2 11/2003 Marvin et al.
6,641,411 B1 11/2003 Stoddard et al.
6,641,825 B2 11/2003 Scholz et al.
6,652,318 B1 11/2003 Winings et al.
6,663,426 B2 12/2003 Hasircoglu et al.
6,665,189 B1 12/2003 Lebo
6,666,693 B2 12/2003 Belopolsky et al.
6,669,514 B2 12/2003 Wiebking et al.
6,672,884 B1 1/2004 Toh et al.
6,672,907 B2 1/2004 Azuma
6,679,709 B2 1/2004 Takeuchi
6,692,272 B2 2/2004 Lemke et al.
6,695,627 B2 2/2004 Ortega et al.
6,702,590 B2 3/2004 Zaderej et al.
6,702,594 B2 3/2004 Lee et al.
6,705,902 B1 3/2004 Yi et al.
6,709,294 B1 3/2004 Cohen et al.
6,712,621 B2 3/2004 Li et al.
6,712,646 B2 3/2004 Shindo
6,716,045 B2 4/2004 Meredith
6,716,068 B2 4/2004 Wu
6,717,825 B2 4/2004 Volstorf
6,726,492 B1 4/2004 Yu
6,736,664 B2 5/2004 Ueda et al.
6,739,910 B1 5/2004 Wu
6,740,820 B2 5/2004 Cheng
D492,295 S 6/2004 Glatt
6,743,037 B2 6/2004 Kassa et al.
6,743,059 B1 6/2004 Korsunsky et al.
6,746,278 B2 6/2004 Nelson et al.
6,749,439 B1 6/2004 Potter et al.
6,762,067 B1 7/2004 Quinones et al.
6,764,341 B2 7/2004 Lappoehn
6,769,883 B2 8/2004 Brid et al.
6,769,935 B2 8/2004 Stokoe et al.
6,776,635 B2 8/2004 Blanchfield et al.
6,776,649 B2 8/2004 Pape et al.
6,780,027 B2 8/2004 Allison
6,786,771 B2 9/2004 Gailus
6,790,088 B2 9/2004 Ono et al.
6,796,831 B1 9/2004 Yasufuku et al.
6,799,215 B1 9/2004 Giroir et al.
D497,343 S 10/2004 Busse et al.
6,805,278 B1 10/2004 Olson et al.
6,808,399 B2 10/2004 Rothermel et al.
6,808,420 B2 10/2004 Whiteman, Jr. et al.
6,810,783 B1 11/2004 Larose
6,811,440 B1 11/2004 Rothermel et al.
6,814,590 B2 11/2004 Minich et al.
6,814,619 B1 11/2004 Stokoe et al.
6,824,391 B2 11/2004 Mickievicz et al.
6,829,143 B2 12/2004 Russell et al.
6,835,072 B2 12/2004 Simons et al.
6,835,103 B2 12/2004 Middlehurst et al.
6,843,686 B2 1/2005 Ohnishi et al.
6,843,687 B2 1/2005 McGowan et al.
6,848,886 B2 2/2005 Schmaling et al.
6,848,944 B2 2/2005 Evans
6,848,950 B2 2/2005 Allison et al.
6,848,953 B2 2/2005 Schell et al.
6,851,974 B2 2/2005 Doutrich
6,851,980 B2 2/2005 Nelson et al.
6,852,567 B1 2/2005 Lee et al.
D502,919 S 3/2005 Studnicky, III
6,866,521 B1 * 3/2005 Harper, Jr. ..... H01R 12/716 439/71
6,866,549 B2 3/2005 Kimura et al.
6,869,292 B2 3/2005 Johnescu et al.
6,869,294 B2 3/2005 Clark et al.
6,872,082 B2 3/2005 Hsu et al.
6,872,085 B1 3/2005 Cohen et al.
6,884,117 B2 4/2005 Korsunsky et al.
6,890,184 B2 5/2005 Doblar et al.
6,890,214 B2 5/2005 Brown et al.
6,890,221 B2 5/2005 Wagner
6,893,272 B2 5/2005 Yu

(56) References Cited

U.S. PATENT DOCUMENTS 6,893,300 B2 5/2005 Zhou et al.
6,893,686 B2 5/2005 Egan
6,899,566 B2 5/2005 Kline et al.
6,902,411 B2 6/2005 Kubo
6,905,367 B2 6/2005 Crane, Jr. et al.
6,913,490 B2 7/2005 Whiteman, Jr. et al.
6,918,776 B2 * 7/2005 Spink, Jr. ..... H01R 12/716 439/108
6,918,789 B2 7/2005 Lang et al.
6,929,504 B2 8/2005 Ling et al.
6,932,649 B1 8/2005 Rothermel et al.
6,939,173 B1 9/2005 Elco et al.
6,945,796 B2 9/2005 Bassler et al.
6,947,012 B2 9/2005 Aisenbrey
6,951,466 B2 10/2005 Sandoval et al.
6,953,351 B2 10/2005 Fromm et al.
6,969,268 B2 11/2005 Brunker et al.
6,969,280 B2 11/2005 Chien et al.
6,975,511 B1 12/2005 Lebo et al.
6,976,886 B2 12/2005 Winings et al.
6,979,202 B2 12/2005 Benham et al.
6,979,215 B2 12/2005 Avery et al.
6,981,883 B2 1/2006 Raistrick et al.
6,988,902 B2 1/2006 Winings et al.
6,994,569 B2 2/2006 Minich et al.
7,001,189 B1 2/2006 McGowan et al.
7,021,975 B2 4/2006 Lappohn
7,040,901 B2 5/2006 Benham et al.
7,044,794 B2 5/2006 Consoli et al.
7,059,892 B1 6/2006 Trout
7,059,919 B2 6/2006 Clark et al.
7,065,871 B2 6/2006 Minich et al.
7,070,464 B2 7/2006 Clark et al.
7,074,096 B2 7/2006 Copper et al.
7,086,147 B2 8/2006 Caletka et al.
7,090,501 B1 8/2006 Scherer et al.
7,094,102 B2 8/2006 Cohen et al.
7,097,465 B1 8/2006 Korsunsky et al.
7,097,506 B2 8/2006 Nakada
7,101,191 B2 9/2006 Benham et al.
7,101,228 B2 9/2006 Hamner et al.
7,104,812 B1 9/2006 Bogiel et al.
7,108,556 B2 9/2006 Cohen et al.
7,114,963 B2 10/2006 Shuey et al.
7,114,964 B2 10/2006 Winings et al.
7,118,391 B2 10/2006 Minich et al.
RE39,380 E 11/2006 Davis
7,131,870 B2 11/2006 Whiteman, Jr. et al.
7,137,848 B1 11/2006 Trout et al.
7,153,162 B2 12/2006 Mizumura et al.
7,160,151 B1 1/2007 Rigby et al.
7,163,421 B1 1/2007 Cohen et al.
7,168,963 B2 1/2007 Minich et al.
7,172,461 B2 2/2007 Davis et al.
7,182,642 B2 2/2007 Ngo et al.
7,182,643 B2 2/2007 Winings et al.
D540,258 S 4/2007 Peng et al.
7,204,699 B2 4/2007 Stoner et al.
7,207,807 B2 4/2007 Fogg
D541,748 S 5/2007 Peng et al
D542,736 S 5/2007 Riku
7,220,141 B2 5/2007 Daily et al.
7,239,526 B1 7/2007 Bihee
7,241,168 B2 7/2007 Sakurai et al.
7,258,562 B2 8/2007 Daily et al.
D550,158 S 9/2007 Victor
D550,628 S 9/2007 Whiteman, Jr. et al.
7,267,515 B2 9/2007 Lappohn
7,270,574 B1 9/2007 Ngo
7,273,382 B2 9/2007 Igarashi et al.
7,278,856 B2 10/2007 Minich
7,281,950 B2 10/2007 Belopolsky
D554,591 S 11/2007 Victor
7,292,055 B2 11/2007 Egitto
7,303,427 B2 12/2007 Swain
7,309,239 B2 12/2007 Shuey et al.
7,316,585 B2 1/2008 Smith et al.
7,322,855 B2 1/2008 Mongold et al.
7,331,802 B2 2/2008 Rothermel et al.
7,335,043 B2 2/2008 Ngo et al.
7,338,321 B2 3/2008 Laurx
7,344,383 B1 3/2008 Lu et al.
7,347,740 B2 3/2008 Minich
7,351,071 B2 4/2008 Korsunsky et al.
7,381,092 B2 6/2008 Nakada
7,384,289 B2 6/2008 Minich
7,384,311 B2 6/2008 Sharf et al.
7,402,064 B2 7/2008 Daily et al.
7,407,387 B2 8/2008 Johnescu et al.
7,422,483 B2 9/2008 Avery et al.
7,425,145 B2 9/2008 Ngo
7,429,176 B2 9/2008 Johnescu et al.
7,445,457 B1 11/2008 Frangioso, Jr. et al.
7,452,242 B2 11/2008 Poh et al.
7,452,249 B2 11/2008 Daily et al.
7,458,839 B2 12/2008 Ngo et al.
7,467,955 B2 12/2008 Raistrick et al.
7,476,108 B2 1/2009 Swain et al.
7,497,735 B2 3/2009 Belopolsky
7,497,736 B2 3/2009 Minich et al.
7,500,871 B2 3/2009 Minich et al.
7,503,804 B2 3/2009 Minich
7,541,135 B2 6/2009 Swain
7,549,897 B2 6/2009 Fedder et al.
7,553,182 B2 6/2009 Buck et al.
7,588,463 B2 9/2009 Yamada et al.
7,621,781 B2 11/2009 Rothermel et al.
D607,822 S 1/2010 Dennes
D611,908 S 3/2010 Takada et al.
7,708,569 B2 5/2010 Sercu et al.
D618,180 S 6/2010 Gross et al.
D618,181 S 6/2010 Gross et al.
7,753,731 B2 7/2010 Cohen et al.
7,762,843 B2 7/2010 Minich et al.
D626,075 S 10/2010 Truskett et al.
D628,963 S 12/2010 Sau et al.
7,883,366 B2 2/2011 Davis et al.
7,976,326 B2 7/2011 Stoner
7,988,456 B2 8/2011 Davis et al.
8,011,957 B2 9/2011 Pan
D651,177 S 12/2011 Luo
8,079,847 B2 12/2011 Davis et al.
D653,621 S 2/2012 Gross et al.
8,109,770 B2 2/2012 Perugini et al.
8,119,926 B2 2/2012 Murphy
8,231,415 B2 7/2012 Johnescu et al.
8,277,241 B2 10/2012 Horchler et al.
8,323,038 B2 12/2012 Jin
8,366,485 B2 2/2013 Johnescu et al.
8,374,470 B2 2/2013 Ban et al.
8,408,939 B2 4/2013 Davis et al.
8,414,199 B2 4/2013 Ishigami
8,465,213 B2 6/2013 Tamura et al.
8,480,413 B2 7/2013 Minich et al.
8,523,615 B2 * 9/2013 Luo ..... H01R 12/7082 439/660
RE44,556 E 10/2013 Minich et al.
8,632,263 B2 1/2014 Nekado et al.
D712,843 S 9/2014 Buck et al.
D713,799 S 9/2014 Buck et al.
D733,662 S 7/2015 Harper, Jr. et al.
9,209,540 B2 * 12/2015 Raff ..... H01R 12/716
9,543,703 B2 1/2017 Horchler et al.
2001/0003685 A1 6/2001 Aritani
2001/0008189 A1 7/2001 Reede
2001/0012729 A1 8/2001 Van Woensel
2001/0041477 A1 11/2001 Billman et al.
2001/0046810 A1 11/2001 Cohen et al.
2001/0046816 A1 11/2001 Saito et al.
2002/0013101 A1 1/2002 Long
2002/0039857 A1 4/2002 Naito et al.
2002/0084105 A1 7/2002 Geng et al.
2002/0098727 A1 7/2002 McNamara et al.
2002/0106930 A1 8/2002 Pape et al.

(56) References Cited

U.S. PATENT DOCUMENTS

2002/0106932 A1 8/2002 Holland et al.
2002/0111068 A1 8/2002 Cohen et al.
2002/0127903 A1 9/2002 Billman et al.
2002/0142629 A1 10/2002 Zaderej et al.
2002/0142676 A1 10/2002 Hosaka et al.
2002/0159235 A1 10/2002 Miller et al.
2002/0173177 A1 11/2002 Korsunsky et al.
2002/0187688 A1 12/2002 Marvin et al.
2002/0193019 A1 12/2002 Blanchfield et al.
2003/0027439 A1 2/2003 Johnescu et al.
2003/0116857 A1 6/2003 Taniguchi et al.
2003/0119378 A1 6/2003 Avery
2003/0143894 A1 7/2003 Kline et al.
2003/0171010 A1 9/2003 Winings et al.
2003/0203665 A1 10/2003 Ohnishi et al.
2003/0219999 A1 11/2003 Minich et al.
2003/0220021 A1 11/2003 Whiteman et al.
2003/0236035 A1 12/2003 Kuroda et al.
2004/0018757 A1 1/2004 Lang et al.
2004/0023524 A1 2/2004 Ashman et al.
2004/0038590 A1 2/2004 Lang et al.
2004/0072470 A1 4/2004 Lang et al.
2004/0077224 A1 4/2004 Marchese
2004/0087196 A1 5/2004 Lang et al.
2004/0102062 A1 5/2004 Liao et al.
2004/0114866 A1 6/2004 Hiramatsu
2004/0157477 A1 8/2004 Johnson et al.
2004/0224559 A1 11/2004 Nelson et al.
2004/0235316 A1 11/2004 Liao et al.
2004/0235321 A1 11/2004 Mizumura et al.
2004/0259420 A1 12/2004 Wu
2005/0009402 A1 1/2005 Chien et al.
2005/0026503 A1 2/2005 Trout et al.
2005/0032401 A1 2/2005 Kobayashi
2005/0048838 A1 3/2005 Korsunsky et al.
2005/0079763 A1 4/2005 Lemke et al.
2005/0101166 A1 5/2005 Kameyama
2005/0101188 A1 5/2005 Benham et al.
2005/0112952 A1 5/2005 Wang et al.
2005/0118869 A1 6/2005 Evans
2005/0170700 A1 8/2005 Shuey et al.
2005/0196987 A1 9/2005 Shuey et al.
2005/0202722 A1 9/2005 Regnier et al.
2005/0215121 A1 9/2005 Tokunaga
2005/0227552 A1 10/2005 Yamashita et al.
2005/0277315 A1 12/2005 Mongold et al.
2005/0287869 A1 12/2005 Kenny et al.
2006/0003620 A1 1/2006 Daily et al.
2006/0014433 A1 1/2006 Consoli et al.
2006/0024983 A1 2/2006 Cohen et al.
2006/0024984 A1 2/2006 Cohen et al.
2006/0040519 A1 2/2006 Arai et al.
2006/0046526 A1 3/2006 Minich
2006/0051987 A1 3/2006 Goodman et al.
2006/0068610 A1 3/2006 Belopolsky
2006/0068641 A1 3/2006 Hull et al.
2006/0073709 A1 4/2006 Reid
2006/0116857 A1 6/2006 Sevic et al.
2006/0121749 A1 6/2006 Fogg
2006/0128197 A1 6/2006 McGowan et al.
2006/0141818 A1 6/2006 Ngo
2006/0183377 A1 8/2006 Sinsheimer
2006/0192274 A1 8/2006 Lee et al.
2006/0216969 A1 9/2006 Bright et al.
2006/0228912 A1 10/2006 Morlion et al.
2006/0232301 A1 10/2006 Morlion et al.
2006/0281354 A1 12/2006 Ngo et al.
2007/0004287 A1 1/2007 Marshall
2007/0021002 A1 1/2007 Laurx et al.
2007/0042639 A1 2/2007 Manter et al.
2007/0071391 A1 3/2007 Mazotti et al.
2007/0099455 A1 5/2007 Rothermel et al.
2007/0099512 A1 5/2007 Sato
2007/0183707 A1 8/2007 Umezawa
2007/0183724 A1 8/2007 Sato
2007/0202715 A1* 8/2007 Daily ..... H01R 43/0256 439/71
2007/0202747 A1 8/2007 Sharf et al.
2007/0205774 A1 9/2007 Minich
2007/0207641 A1 9/2007 Minich
2007/0218722 A1* 9/2007 Chen ..... H01R 43/205 439/135
2007/0224845 A1* 9/2007 Becker ..... H01L 23/3675 439/66
2007/0293084 A1 12/2007 Ngo
2008/0032524 A1* 2/2008 Lemke ..... H01R 12/57 439/78
2008/0045079 A1 2/2008 Minich et al.
2008/0176453 A1 7/2008 Minich et al.
2008/0232737 A1 9/2008 Ishigami et al.
2008/0246555 A1 10/2008 Kirk et al.
2008/0248670 A1 10/2008 Daily et al.
2008/0316729 A1 12/2008 Rothermel et al.
2009/0011643 A1 1/2009 Amleshi et al.
2010/0055983 A1 3/2010 Wu
2010/0093209 A1 4/2010 Liu et al.
2010/0216342 A1 8/2010 Lin
2010/0240233 A1 9/2010 Johnescu et al.
2010/0291803 A1 11/2010 Kirk
2010/0330844 A1 12/2010 Ito
2011/0097934 A1 4/2011 Minich
2011/0159744 A1 6/2011 Buck
2011/0195593 A1 8/2011 McGrath et al.
2012/0202363 A1 8/2012 McNamara et al.
2012/0214343 A1 8/2012 Buck et al.
2012/0289095 A1 11/2012 Kirk
2013/0005160 A1 1/2013 Minich
2013/0090025 A1 4/2013 Trout et al.
2013/0122744 A1 5/2013 Morgan et al.
2013/0149881 A1 6/2013 Johnescu et al.
2013/0149890 A1 6/2013 Schroll et al.
2013/0195408 A1 8/2013 Hermeline et al.
2013/0210246 A1 8/2013 Davis et al.
2013/0273756 A1 10/2013 Stoner et al.
2013/0273781 A1 10/2013 Buck et al.
2014/0017957 A1 1/2014 Horchler et al.
2014/0227911 A1* 8/2014 Lim ..... H01R 13/6473 439/660

FOREIGN PATENT DOCUMENTS

JP H10-032038 A2 2/1998
JP 2000-323215 A2 11/2000
JP 2001-526821 T2 12/2001
JP 2004-063476 A2 2/2004

OTHER PUBLICATIONS

Japanese Office Action and English Translation for Japanese Application No. 2015-521789 dated Apr. 28, 2017.
U.S. Appl. No. 29/418,299, filed Apr. 13, 2012, Buck et al.
U.S. Appl. No. 29/418,310, filed Apr. 13, 2012, Buck et al.
U.S. Appl. No. 29/418,313, filed Apr. 13, 2012, Zerebilov et al.
U.S. Appl. No. 29/426,921, filed Jul. 11, 2012, Horchler.
U.S. Appl. No. 29/444,125, filed Jan. 25, 2013, Haroer, Jr. et al.
U.S. Appl. No. 29/449,794, filed Mar. 15, 2013, Zerebilov et al.

* cited by examiner

ELECTRICAL CONNECTOR WITH REDUCED STACK HEIGHT

CROSS-REFERENCE TO RELATED APPLICATIONS

This application is a continuation of and claims priority under §120 to U.S. patent application Ser. No. 13/938,294, filed Jun. 30, 2015, entitled "ELECTRICAL CONNECTOR WITH REDUCED STACK HEIGHT", now U.S. Pat. No. 9,543,703. Application Ser. No. 13/938,294 is a non-provisional of and claims priority under 35 U.S.C. §119(e) to U.S. Provisional Patent Application Ser. No. 61/670,498, filed Jul. 11, 2012, entitled "ELECTRICAL CONNECTOR WITH REDUCED STACK HEIGHT," and to U.S. Provisional Patent Application Ser. No. 61/806,327, filed Mar. 28, 2013, entitled "ELECTRICAL CONNECTOR WITH REDUCED STACK HEIGHT," all of the foregoing of which are hereby incorporated by reference in their entireties. This application is related by subject matter to U.S. Pat. No. 6,042,389, the disclosure of which is hereby incorporated by reference in its entirety.

BACKGROUND

Electrical connectors typically include a dielectric connector housing supporting a plurality of electrical contacts. Physical characteristics of the electrical contacts and/or the connector housing can typically govern signal integrity (SI) performance of the electrical connector. For example, mezzanine electrical connectors can be constructed with arrays of electrical contacts having fusible elements, and can be referred to as ball grid array (BGA) connectors. A pair of complementary mezzanine BGA connectors can define a stack height when mated to one another. A mezzanine BGA connector having a shorter stack height than that of typical mezzanine BGA connectors can exhibit enhanced SI characteristics relative to typical mezzanine BGA connectors. As the connector housing and the associated electrical contacts become smaller and smaller, contact retention becomes increasingly more difficult. As the amount of plastic or other suitable connector housing material is reduced, preventing the housing from warping or curling during reflow of solder masses or balls onto respective electrical contacts, during reflow of the electrical connector onto a substrate, during thermal expansion, or due to internal connector housing stress created by the electrical contacts are also a technical challenge. Preventing solder wicking along very short electrical contacts is also more difficult.

SUMMARY

An electrical connector can include a guidance or alignment member that is disposed in the center of a pin field of electrical contacts supported by a connector housing of the electrical connector. The pin field of the electrical connector can be configured to mate a gender-neutral pin field of a complementary electrical connector. The alignment member can also be gender-neutral. Configuring the electrical connector as a gender-neutral electrical connector can minimize tooling and simplify manufacturing processes and/or customer application of the electrical connector.

In accordance with an embodiment, an electrical connector includes a connector housing. The electrical connector further includes an array of electrical contacts supported by the connector housing. The array of electrical contacts includes at least two rows of electrical contacts that are spaced from each other and extend along a first direction and at least two columns of electrical contacts that are spaced from each other and extend along a second direction that is substantially perpendicular to the first direction. Each of the at least two rows of electrical contacts intersect each of the at least two columns of electrical contacts. The electrical connector further includes an alignment member that is disposed in the array of electrical contacts such that the alignment member is surrounded by the least two rows of electrical contacts and the at least two columns of electrical contacts.

In accordance with another embodiment, an electrical connector assembly includes a first electrical connector that has a first connector housing, a first array of electrical contacts supported by the first connector housing, and a first alignment member that defines an outer perimeter and is disposed in the first array of electrical contacts such that the outer perimeter of the first alignment member is substantially surrounded by respective electrical contacts of the first array of electrical contacts. The electrical connector assembly further includes a second electrical connector configured to be mated to the first electrical connector. The second electrical connector has a second connector housing, a second array of electrical contacts supported by the second connector housing, and a second alignment member that defines an outer perimeter and is disposed in the second array of electrical contacts such that the outer perimeter of the second alignment member is substantially surrounded by respective electrical contacts of the second array of electrical contacts. The second alignment member is configured to mate with the first alignment member of the first electrical connector so as to substantially align the first and second arrays of electrical contacts relative to each other. One embodiment of the present disclosure overcomes many of the technical challenges in part by decreasing, rather than increasing, the contact area between an electrical contact and the connector housing that supports the electrical contact.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1:
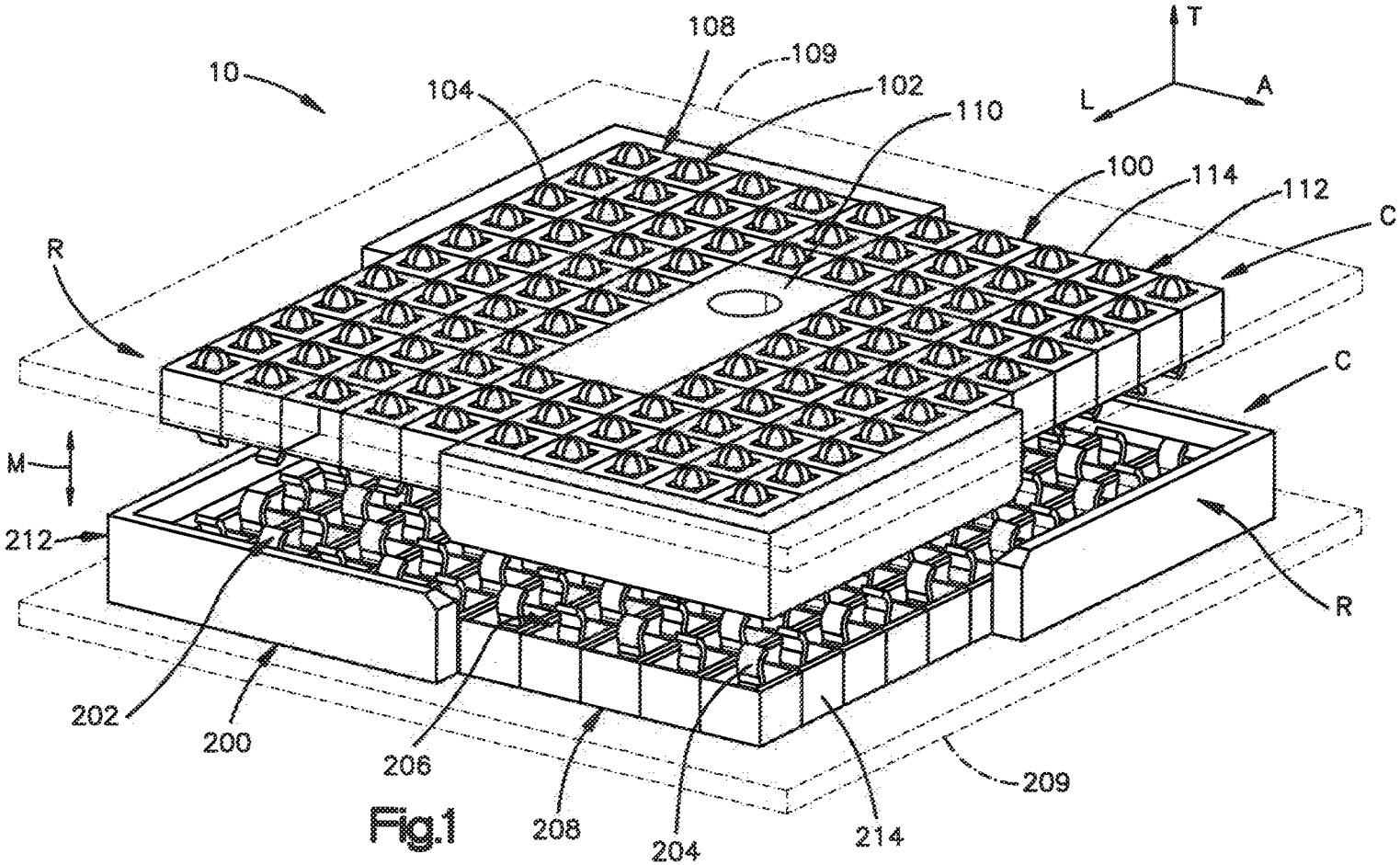
FIG. 1 is a perspective view of an electrical assembly constructed in accordance with one embodiment, including first and second electrical connectors mounted onto respective first and second printed circuit boards, and shown aligned to be mated with each other.
Figure 2:
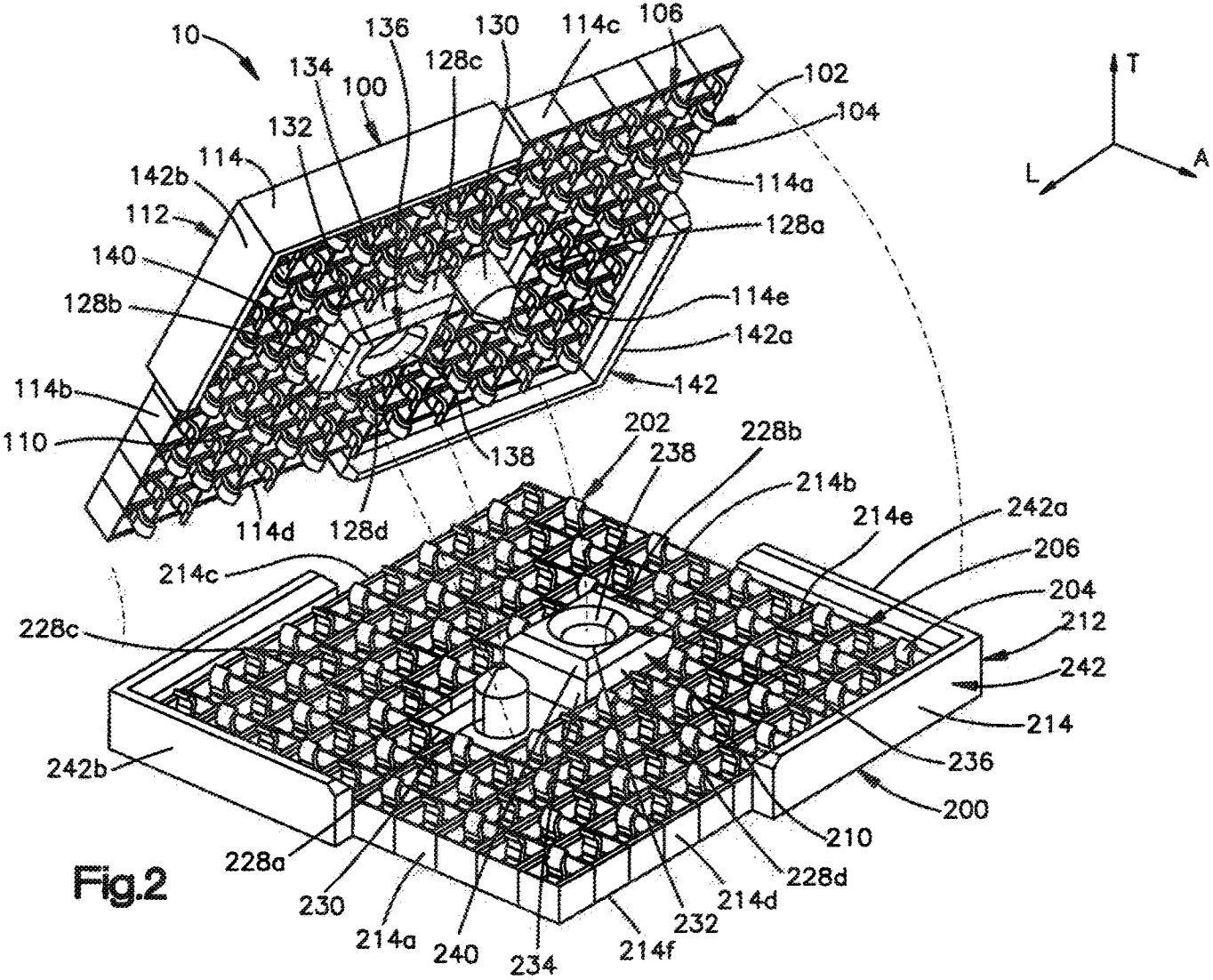
FIG. 2 is a perspective view of the first and second electrical connectors illustrated in FIG. 1.

Referring initially to FIGS. 1-2, an electrical connector assembly 10 includes a first electrical connector 100 and a second electrical connector 200 that is configured to be mated to the first electrical connector 100 so as to place the first and second electrical connectors in electrical communication with each other. The first electrical connector 100 can include at least one alignment member that is configured to engage with a complementary at least one alignment member of the second electrical connector, as described in more detail below. The respective at least one alignment members of the first and second electrical connectors 100 and 200, respectively, can engage each other when the first and second electrical connectors 100 and 200 are mated, so as to at least partially align respective electrical contacts of the first and second electrical connectors 100 and 200, with respect to each other and to ensure proper orientation of the first and second electrical connectors 100 and 200 with respect to each other during mating of the electrical connectors.

The first electrical connector 100 can include a first array 102 of electrical contacts 104. The second electrical connector 200 can be constructed the same or differently than the first electrical connector 100. For example, In accordance with the illustrated embodiment, the first and second electrical connectors 100 and 200 are constructed substantially identically to one another. In this regard, it can be said that the first and second electrical connectors 100 and 200 are constructed as gender-neutral electrical connectors.

The first electrical connector 100 can include a connector housing 112, which can be referred to as a first connector housing, that is configured to support the first array 102 of electrical contacts 104, which can be referred to as a first plurality of electrical contacts 104. The connector housing 112 can be made of any suitable dielectric material, such as plastic and the electrical contacts 104 can be made of any suitable electrically conductive material, such as metal. In accordance with the illustrated embodiment the connector housing 112 can be overmolded onto the electrical contacts 104. Alternatively, the electrical contacts 104 can be stitched into the connector housing 112 or otherwise supported by the connector housing 112 as desired. The connector housing 112 can include a housing body 114 that defines opposed first and second sides 114*a* and 114*b* that are spaced from each other along a first or longitudinal direction L, opposed third and fourth sides 114*c* and 114*d* that are spaced from each other along a second or lateral direction A that extends substantially perpendicular to the longitudinal direction L, an inner end 114*e* that defines a mating interface 106, and an outer end 114*f* that is spaced from the inner end 114*e* along a third or transverse direction T and defines an opposed mounting interface 108. The transverse direction T extends substantially perpendicular to both the longitudinal direction L and the lateral direction A. The inner end 114*e* can define the mating interface 106, and the outer end 114*f* can define the mounting interface 108. It should be appreciated that in accordance with the illustrated embodiment, the longitudinal direction L and the lateral direction A are oriented horizontally, and the transverse direction T is oriented vertically, though it should be appreciated that the orientation of the first electrical connector 100, and thus the electrical connector assembly 10, can vary during use. Unless otherwise specified herein, the terms "lateral," "laterally," "longitudinal," "longitudinally," "transverse," and "transversely" are used to designate perpendicular directional components in the drawings to which reference is made.

The electrical connector 100 is configured to be mounted to an underlying substrate, for instance a first printed circuit board (PCB) 109, at the mounting interface 108 such that the first electrical connector 100 is placed in electrical communication with the first printed circuit board 109. Similarly, the second electrical connector 200 can be configured to be mounted to an underlying substrate, for instance a second printed circuit board (PCB) 109, at its mounting interface such that the second electrical connector 200 is placed in electrical communication with the second printed circuit board 209. Thus, an electrical connector system can include the electrical connector assembly 10, including the first and second electrical connectors 100 and 200, mounted onto the respective printed circuit boards 109 and 209, respectively. Accordingly, when the first and second electrical connectors 100-200 are mated to each other, such that the mating interface 106 of the first electrical connector 100 engages with the mating interface 206 of the second electrical connector 200 to place the respective arrays of electrical contacts 104 and 204 in electrical communication with each other, the first and second electrical connectors 100-200 can operate to place the first printed circuit board in electrical communication with the second printed circuit board.

Similarly, the second electrical connector 200 can include a connector housing 212, which can be referred to as a second connector housing, that is configured to support the second array 202 of electrical contacts 204, which can be referred to as a second plurality of electrical contacts. The connector housing 212 can be made of any suitable dielectric material, such as plastic and the electrical contacts 204 can be made of any suitable electrically conductive material, such as metal. In accordance with the illustrated embodiment the connector housing 212 can be overmolded onto the electrical contacts 204. Alternatively, the electrical contacts 204 can be stitched into the connector housing 212 or otherwise supported by the connector housing 212 as desired. The connector housing 212 can include a housing body 214 that defines opposed first and second sides 214*a* and 214*b* that are spaced from each other along a first or longitudinal direction L, opposed third and fourth sides 214*c* and 214*d* that are spaced from each other along a second or lateral direction A that extends substantially perpendicular to the longitudinal direction L, an inner end 214*e*, and an outer end 214*f* that is spaced from the inner end 214*e* along a third or transverse direction T that extends substantially perpendicular to both the longitudinal direction L and the lateral direction A. The inner end 214*e* can define the mating interface 206, and the outer end 214*f* can define the mounting interface 208.

Figure 3A:
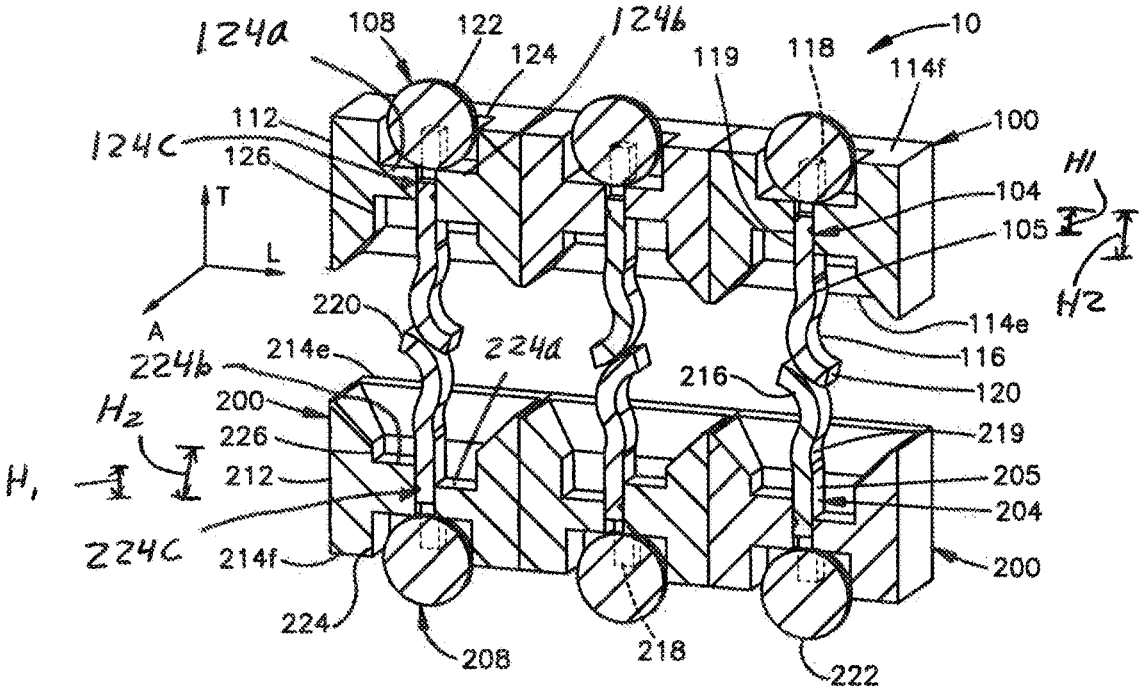
FIG. 3A is zoomed perspective section view of respective portions of the first and second electrical connectors illustrated in FIG. 1, with respective electrical contacts of the first and second electrical connectors aligned by engagement of complementary alignment members of the first and second electrical connectors.
Figure 3B:
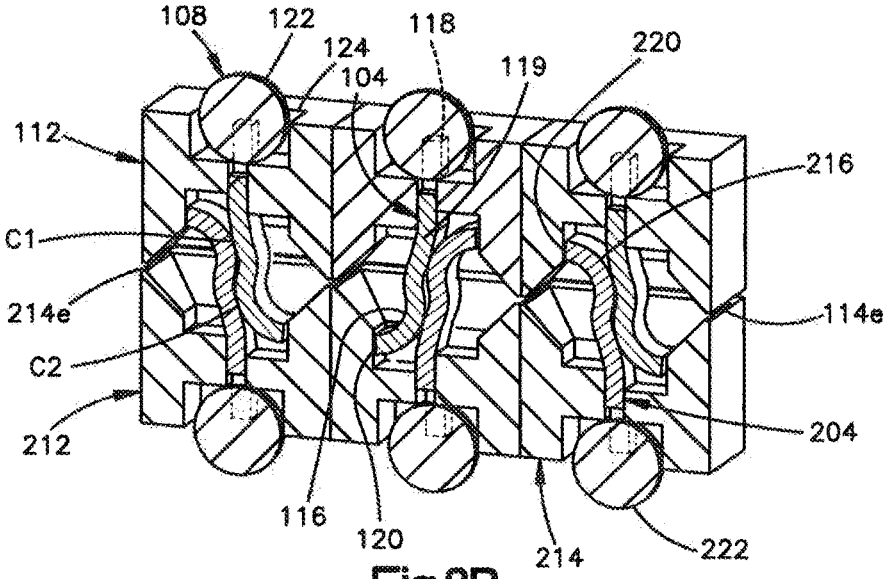
FIG. 3B is zoomed perspective section view of respective portions of the first and second electrical connectors after the first and second electrical connectors are mated to each other.

Referring now also to FIGS. 3A-3B, each electrical contact 104 can have a contact body 105 that defines a mating end 116 that extends out from that mating interface 106, an opposed mounting end 118 that extends out from the mounting interface 108, and a lead portion 119 that extends between the mating end 116 and the mounting end 118. At least a portion of the contact body 105 of each electrical contact 104 can be curved between the mating and mounting ends 116 and 118, respectively, as it extends between the mating end 116 and the mounting end 118 along the transverse direction T. For instance, in accordance with the illustrated embodiment, each contact body can define a region of generally "S" shaped curvature between the mating end 116 and the mounting end 118, such that the mating end 116 defines a tip 120 that is offset along the longitudinal direction L with respect to the mounting end 118. Each electrical contact 104 can be supported by the connector housing 112 such that the tip 120 faces toward one of the first side 114*a* or the second side 114*b* of the housing body 114 of the connector housing 112, as described in more detail below. For instance, one or more of the tips 120, and thus one or more of the mating ends 116, can be curved so as to define a curvature. At least a portion of each electrical contact 104, for instance the mating end 116, can define a pair of opposed edges and a pair of opposed broadsides that are longer than the opposed edges, such that the contact body defines a substantially rectangular cross section defined along the orthogonal directions that are perpendicular to the contact body 105 at the cross-section. The electrical contacts 104 of the first array 102 can be configured as broadside-coupled differential signal pairs, as edge-coupled differential signal pairs, as open contacts, or any combination thereof as desired.

The electrical contacts 204 of the second array 202 can be configured identically with respect to the electrical contacts 104 of the first array 102. Thus, all structure described and illustrated with respect to the electrical contacts 104 of the first array 102 are illustrated with respect to the electrical contacts 204 of the second array 202 by reference numerals incremented by 100. Thus, with continuing reference to FIGS. 3A-3B, each electrical contact 204 can have a contact body 205 that defines a mating end 216 that extends out from the mating interface 208, an opposed mounting end 218 that extends out from the mounting interface 206, and a lead portion 219 that extends between the mating end 216 and the mounting end 218. At least a portion of the contact body 205 of each electrical contact 204 can be curved between the mating and mounting ends 216 and 218, respectively, as it extends between the mating end 216 and the mounting end 218 along the transverse direction T. For instance, in accordance with the illustrated embodiment, each contact body can define a region of generally "S" shaped curvature between the mating end 216 and the mounting end 218, such that the mating end 216 defines a tip 220 that is offset along the longitudinal direction L with respect to the mounting end 218. Each electrical contact 204 can be supported by the connector housing 212 such that the tip 220 faces toward one of the first side 214*a* or the second side 214*b* of the housing body 214 of the connector housing 212, as described in more detail below. For instance, one or more of the tips 220, and thus one or more of the mating ends 216, can be curved so as to define a curvature. At least a portion of each electrical contact 204, for instance the mating end 216, can define a pair of opposed edges and a pair of opposed broadsides that are longer than the opposed edges, such that the contact body defines a substantially rectangular cross section defined along the orthogonal directions that are perpendicular to the contact body 205 at the cross-section. The electrical contacts 204 of the second array 202 can be configured as broadside-coupled differential signal pairs, as edge-coupled differential signal pairs, as open contacts, or any combination thereof as desired.

Because the mating interface 106 of the first electrical connector 100 and the mating interface 206 of the second electrical connector 200, respectively, are oriented substantially parallel to the respective mounting interfaces 108 and 208, the first and second electrical connectors 100 and 200 can be referred to as vertical or mezzanine electrical connectors. However it should be appreciated that one or both of the first and second electrical connectors 100-200 can be otherwise constructed as desired, for instance as right-angle electrical connectors such that the respective mating interfaces are oriented substantially perpendicular to the respective mounting interfaces.

The mating ends 116 of the electrical contacts 104 of the first electrical connector 100 can be configured as receptacle mating ends that are configured to mate with corresponding receptacle mating ends of the electrical contacts 204 of the second electrical connector, as described in more detail below. Similarly, the mating ends 216 of the electrical contacts 204 of the second electrical connector 200 can be configured as receptacle mating ends that are configured to mate with corresponding receptacle mating ends of the electrical contacts 104 of the first electrical connector 100, as described in more detail below. In this regard, the first and second electrical connectors 100 and 200 can be referred to as receptacle electrical connectors. However it should be appreciated that the first and second electrical connectors 100 and 200, respectively, are not limited to the illustrated mating ends, and that the electrical contacts of one or both of the first and second electrical connectors 100 and 200 can be alternatively be configured with any other suitable mating ends as desired. For instance, the electrical contacts of one of the first or second electrical connectors 100 or 200 can be alternatively configured with electrical contacts having plug mating ends, and thus can be referred to as a header electrical connector configured to mate with the receptacle electrical connector of the other of the first or second electrical connectors 100 or 200.

The mounting ends 118 of the electrical contacts can be configured such that the first electrical connector 100 can be mounted to a complementary electrical component, for instance the first printed circuit board 109 as described above. For example, in accordance with the illustrated embodiment, the mounting end of each electrical contact 104 can include a fusible element, such as a solder ball 122 that is disposed at the mounting end 118 of the contact body 105, for instance fused to the mounting end 118. The solder balls 122 can all be co-planar with each other along the mounting interface 108 both before and after the solder reflow process, described below, is completed. The solder ball 122 can be integral and monolithic with the contact body of the electrical contact 104 or can be separate and attached to the mounting end 118. It should be appreciated that the solder balls 122 of the electrical contacts 104 can be mounted to corresponding electrical contacts, for instance electrically conductive contact pads of the first printed circuit board, for instance by positioning the first electrical connector 100 on the first printed circuit board and subjecting the first electrical connector 100 and the first printed circuit board to a solder reflow process whereby the solder balls 122 fuse to the contact pads of the respective printed circuit board. It should further be appreciated that the electrical contacts 104 are not limited to the illustrated mounting ends 118, and that the mounting ends 118 can be alternatively configured with any other suitable fusible or non-fusible element as desired, such as press-fit mounting tails configured to be inserted into complementary vias of the first printed circuit board.

In accordance with the illustrated embodiment, the electrical contacts 204 of the second electrical connector 200 can be identically constructed with respect to the electrical contacts 104 of the first electrical connector 100, including identical mating ends 216, mounting ends 218, tips 220, and solder balls 222. Thus, the mounting ends 218 of the electrical contacts 204 can be configured such that the second electrical connector 200 can be mounted to a complementary electrical component, for instance the second printed circuit board 209 as described above. For example, in accordance with the illustrated embodiment, the mounting end of each electrical contact 204 can include a fusible element, such as a solder ball 222 that is disposed at the mounting end 218 of the contact body 205, for instance fused to the mounting end 218. The solder ball 222 can be integral and monolithic with the contact body of the electrical contact 204 or can be separate and attached to the mounting end 218. The solder balls 222 can all be co-planar with each other along the mounting interface 208 both before and after the solder reflow process is completed. It should be appreciated that the solder balls 222 of the electrical contacts 204 can be mounted to corresponding electrical contacts, for instance electrically conductive contact pads of the first printed circuit board, for instance by positioning the second electrical connector 200 on the second printed circuit board 209 and subjecting the second electrical connector 200 and the second printed circuit board 209 to a solder reflow process whereby the solder balls fuse to the contact pads of the respective printed circuit board. It should further be appreciated that the electrical contacts 204 are not limited to the illustrated mounting ends 218 and that the mounting ends 218 can be alternatively configured with any other suitable fusible or non-fusible element as desired, such as press-fit mounting tails configured to be inserted into complementary vias of the second printed circuit board. All of the solder balls 122 at the mounting ends of first electrical connector 100 are coplanar with each other in a first plane, both before and after the solder balls 122 are reflowed to the first printed circuit board so as to mount the first electrical connector 100 to the first printed circuit board. Similarly, all of the solder balls 222 at the mounting ends of the second electrical connector 200 are coplanar with each other in a second plane, both before and after the solder balls 222 are reflowed to the second printed circuit board so as to mount the second electrical connector 200 to the second printed circuit board.

In accordance with the illustrated embodiment, the electrical contacts 104 of the first array 102 of electrical contacts 104 of the first electrical connector 100 are supported by the connector housing 112 substantially along the transverse direction T, such that the mating ends 116 at least partially protrude from the inner end 114*e* of the housing body 114 and the mounting ends 118 at least partially protrude from the outer end 114*f* of the housing body 114. Similarly, the electrical contacts 204 of the second array 202 of electrical contacts 204 of the second electrical connector 200 are supported by the connector housing 212 substantially along the transverse direction T, such that the mating ends 216 at least partially protrude from the inner end 214*e* of the housing body 214 and the mounting ends 218, at least partially protrude from the outer end 214*f* of the housing body 214.

Further in accordance with the illustrated embodiment, the electrical contacts 104 of the first array 102 of electrical contacts 104 are arranged into at least two such as a plurality of rows that extend along a row direction R that can be defined by the longitudinal direction L and into at least two such as a plurality of columns that extend substantially perpendicular to the rows along a column direction C that can be defined by the lateral direction A. As illustrated, each row or electrical contacts 104 can intersect with every column of electrical contacts 104, and each column of electrical contacts can intersect with every row of electrical contacts 104. In this regard, it can be said that each of the at least two rows of electrical contacts 104 intersects each of the at least two columns of electrical contacts 104. Similarly the electrical contacts 204 of the second array 202 of electrical contacts 204 of the second electrical connector 200 can be arranged into rows and columns that identical to those of the first electrical connector 100.

Further in accordance with the illustrated embodiment, the electrical contacts 104 of the first array 102 of electrical contacts 104 are arranged into at least two such as a plurality of rows that extend along a row direction R that can be defined by the longitudinal direction L and into at least two such as a plurality of columns that extend substantially perpendicular to the rows along a column direction C that can be defined by the lateral direction A. As illustrated, each row or electrical contacts 104 can intersect with every column of electrical contacts 104, and each column of electrical contacts can intersect with every row of electrical contacts 104. In this regard, it can be said that each of the at least two rows of electrical contacts 104 intersects each of the at least two columns of electrical contacts 104. Similarly, in accordance with the illustrated embodiment, the electrical contacts 204 of the second array 202 of electrical contacts 204 are arranged into at least two such as a plurality of rows that extend along a row direction R that can be defined by the longitudinal direction L and into at least two such as a plurality of columns that extend substantially perpendicular to the rows along a column direction C that can be defined by the lateral direction A. As illustrated, each row or electrical contacts 204 can intersect with every column of electrical contacts 204, and each column of electrical contacts can intersect with every row of electrical contacts 204. In this regard, it can be said that each of the at least two rows of electrical contacts 204 intersects each of the at least two columns of electrical contacts 204.

In accordance with the illustrated embodiment, the first array 102 of electrical contacts 104 of the first electrical connector 100 includes ten rows of electrical contacts 104 spaced apart along the column direction C and ten columns of electrical contacts 104 spaced apart along the row direction R. Similarly, the second array 202 of electrical contacts 204 of the second electrical connector 200 includes ten rows of electrical contacts 204 spaced apart along the column direction C and ten columns of electrical contacts 204 spaced apart along the row direction R. In this regard, the first and second arrays 102 and 202 of electrical contacts of the first and second electrical connectors 100 and 200, respectively, can be referred to as ten by ten (10×10) arrays of electrical contacts, meaning each column and row of the arrays 102 and 202 include ten electrical contacts 104 and 204, respectively. However it should be appreciated that the first and second electrical connectors 100 and 200 are not limited to the illustrated arrays of electrical contacts and that first and second arrays 102 and 202 can be alternatively configured as desired. For instance, the first and second arrays 102 and 202 of the first and second electrical connectors 100 and 200, respectively, can be constructed with nine by nine (9×9) arrays of electrical contacts that include as nine rows of electrical contacts spaced apart along the column direction C and nine columns of electrical contacts spaced apart along the row direction R, as ten by eleven (11×10) arrays of electrical contacts that include eleven columns of electrical contacts spaced apart along the row direction R and ten rows of electrical contacts spaced apart along the column direction C (see FIGS. 4-5), or any other suitably sized array of electrical contacts as desired.

With continuing reference to FIGS. 1-2 and 3A-3B, the first electrical connector 100 can define a plurality of pockets 124 that extend into the housing body 114 along the transverse direction T. For instance, the pockets 124 can extend into the outer end 114*f* of the housing body 114 of the connector housing 112 along the transverse direction T toward the inner end 114*e*. The opposed mounting ends 118 of the contact body 105 can extend into the pockets 124. Each of the pockets 124 can be configured to at least partially receive a respective one of the solder balls 122 of the electrical contacts 104. Accordingly, the mounting ends of each of the electrical contacts 104, which can include the mounting ends 118 of the contact body 105 and the respective solder ball 122 can be at least partially disposed in the pockets 124. Thus, when the first array 102 of electrical contacts 104 is supported by the connector housing 112, each solder ball 122 is at least partially recessed with respect to the outer end 114*f* of the housing body 114, in a respective one of the plurality of pockets 124. In this regard, it can be said that the solder balls 122 of the first array 102 of electrical contacts 104 protrude out with respect to the outer end 114*f* of the housing body 114.

The connector housing 112 can further define a plurality of cavities 126 that extend into the inner end 114*e* of the housing body 114 of the connector housing 112 along the transverse direction T. Each cavity 126 can be substantially aligned with and spaced from a respective one of the plurality of pockets 124 along the transverse direction T, and can be configured to at least partially receive a respective one of the mating ends 116 of the electrical contacts 104, such that when the first array 102 of electrical contacts 104 is supported by the connector housing 112, the mating end 116 of each electrical contact 104 protrudes out with respect to the inner end 114*e* of the housing body 114. Each cavity 126 can be at least partially defined by a plurality of inner walls. A portion of at least one, such as each of the inner walls of each cavity 126 can be angularly offset with respect to the transverse direction T, such that a cross-sectional dimension, for instance an area of the cavity 126 measured in a plane defined by the longitudinal direction L and the lateral direction A, is largest at the inner end 114*e* of the housing body 114, and decreases with distance along the transverse direction T toward the outer end 114*f* of the housing body 114. In this regard, it can be said that each cavity 126 defines a tapered opening at the inner end 114*e* of the housing body 114. The inner walls of the cavity 126 can be tapered to allow for deflection of the receptacle mating ends 116 of the electrical contacts 104 within the cavities 126 when the first and second electrical connectors 100 and 200 are mated to each other, as described in more detail below. The connector housing 112 can further include a retention aperture 124*c* that extends through the housing body 114 along the transverse direction T so as to define first and second retention ribs 124*a* and 124*b* that are spaced from each other along a direction that is perpendicular to the transverse direction T. For instance, the perpendicular direction can be along the longitudinal direction L. In accordance with one embodiment, the retention aperture 124*c* can have a dimension substantially equal to or less than that of the lead portion 119. Accordingly, the mounting ends 118 can be inserted into the retention aperture 124*c* in an insertion direction along the transverse direction T so that the lead portion 119, for instance at the broadsides, is press-fit into the retention aperture 124*c* until mechanical interference between the contact body 105 and the housing body 114 prevents further insertion of the electrical contact 104 in the insertion direction. The solder balls 122, when attached to the respective mounting ends 118, can mechanically interfere with the contact body 105 to prevent removal of the contacts 104 from the connector housing 112 in a removal direction that is opposite the insertion direction along the transverse direction T. Each of the first and second retention ribs 124*a* and 124*c* can define a respective first height H1 and second height H2 in the transverse direction T that is from 0.02 mm and 0.15 mm. The first and second heights H1 and H2 can be equal to each other or different from each other. For instance, in accordance with one embodiment, the first height H1 can be 0.04 mm and the second height H2 can be 0.08 mm.

The housing body 214 of the connector housing 212 of the second electrical connector 200 can be constructed substantially identically to the housing body 114 of the connector housing 112 of the first electrical connector 100. Thus, the connector housing 212 can define a plurality of pockets 224 that extend into the housing body 214 along the transverse direction T. For instance, the pockets 224 can extend into the outer end 214*f* of the housing body 214 along the transverse direction T toward the inner end 214*e*. The opposed mounting ends 218 of the contact body 205 can extend into the pockets 224. Each of the pockets 224 can be configured to at least partially receive a respective one of the solder balls 222. Accordingly, the mounting ends of each of the electrical contacts 204, which can include the mounting ends 218 of the contact body 205 and the respective solder ball 222, can be at least partially disposed in the respective pockets 224. Thus, when the second array 202 of electrical contacts 104 is supported by the connector housing 212, each solder ball 222 is at least partially recessed with respect to the outer end 214*f* of the housing body 214, in a respective one of the plurality of pockets 224. In this regard, it can be said that the solder balls 222 of the second array 202 of electrical contacts 204 protrude out with respect to the outer end 214*f* of the housing body 214.

The connector housing 212 can further define a plurality of cavities 226 that extend into the inner end 214*e* of the housing body 214 along the transverse direction T. Each cavity 226 can be substantially aligned with and spaced from a respective one of the plurality of pockets 224 along the transverse direction T, and can be configured to at least partially receive a respective one of the mating ends 216 of the electrical contacts 204, such that when the second array 202 of electrical contacts 204 is supported by the connector housing 212, the mating end 216 of each electrical contact 204 protrudes out with respect to the inner end 214*e* of the housing body 214. Each cavity 226 can include a plurality of inner walls. A portion of at least one, such as each of the inner walls of each cavity 226 can be angularly offset with respect to the transverse direction T, such that a cross-sectional dimension, for instance an area of the cavity 226 measured in a plane defined by the longitudinal direction L and the lateral direction A, is largest at the inner end 214*e* of the housing body 214, and decreases with distance along the transverse direction T toward the outer end 214*f* of the housing body 214. In this regard, it can be said that each cavity 226 defines a tapered opening at the inner end 214*e* of the housing body 214. The inner walls of the cavity 226 can be tapered to allow for deflection of the receptacle mating ends 216 of the electrical contacts 204 within the cavities 226 when the first and second electrical connectors 100 and 200 are mated to each other, as described in more detail below. The connector housing 212 can further include a retention aperture 224*c* that extends through the housing body 214 along the transverse direction T so as to define first and second retention ribs 224*a* and 224*b* that are spaced from each other along a direction that is perpendicular to the transverse direction T. For instance, the perpendicular direction can be along the longitudinal direction L. In accordance with one embodiment, the retention aperture 224*c* can have a dimension substantially equal to or less than that of the lead portion 219. Accordingly, the mounting ends 218 can be inserted into the retention aperture 224*c* in an insertion direction along the transverse direction T so that the lead portion 219, for instance at the broadsides, is press-fit into the retention aperture 224*c* until mechanical interference between the contact body 205 and the housing body 214 prevents further insertion of the electrical contact 204 into the connector housing 212 along the insertion direction. The solder balls 222, when attached to the respective mounting ends 218, can mechanically interfere with the contact body 205 to prevent removal of the contacts 204 from the connector housing 212 in a removal direction that is opposite the insertion direction along the transverse direction T. Each of the first and second retention ribs 224*a* and 224*c* can define a respective first height H1 and second height H2 in the transverse direction T that is from 0.02 mm and 0.15 mm. The first and second heights H1 and H2 can be equal to each other or different from each other. For instance, in accordance with one embodiment, the first height H1 can be 0.04 mm and the second height H2 can be 0.08 mm.

The first electrical connector 100 can further include at least one alignment member configured to engage with a complementary alignment member of the second electrical connector 200. For example, the first electrical connector 100 can include at least one alignment member, such as an inner alignment member 110 that is supported by the connector housing 112 such that the inner alignment member 110 is disposed in the first array 102 of electrical contacts 104. The inner alignment member 110 can be disposed in the first array 102 of electrical contacts 104 such that the inner alignment member 110 is disposed between at least two rows of electrical contacts 104 of the first array 102 and further disposed between at least two columns of electrical contacts 104 of the first array 102. For instance, the inner alignment member 110 can be disposed in the first array 102 of electrical contacts 104 such that an outer perimeter of the inner alignment member 110 is substantially surrounded on all sides by respective ones of the electrical contacts 104 of the at least two rows of electrical contacts 104 and at least two columns of electrical contacts 104.

The inner alignment member 110 can be configured with any geometry as desired. For instance, the illustrated inner alignment member 110 includes a base 128 that defines opposed first and second sides 128*a* and 128*b* that are spaced apart along the longitudinal direction L and opposed third and fourth sides 128*c* and 128*d* that are spaced apart along the lateral direction A. The base 128 can define a height along the transverse direction that is substantially equal to that of the housing body, for instance as defined by the inner end 114*e* and the outer end 114*f*. In accordance with the illustrated embodiment, the base 128, and thus the inner alignment member 110, is integral and monolithic with the housing body 114 of the connector housing 112. Alternatively, the inner alignment member 110 can be separate and attachable to the housing body 114. The first through fourth sides 128*a*-128*d*, respectively, of the base 128 can collectively define an outer perimeter of the inner alignment member 110. In this regard, it can be said that the inner alignment member 110 is disposed in the first array 102 of electrical contacts 104 such that the outer perimeter of the inner alignment member 110, for instance the outer perimeter of the base 128, is substantially surrounded by respective electrical contacts 104 of the first array 102 of electrical contacts 104.

In accordance with the illustrated embodiment, the inner alignment member 110 is disposed in the first array 102 of electrical contacts 104 such that the inner alignment member 110 is disposed at substantially the geometric center of the first array 102, and moreover of the connector housing 112. For example, a first distance along the longitudinal direction L between the first side 128*a* of the base 128 and the first side 114*a* of the housing body 114 can be substantially equal to a second distance along the longitudinal direction L between the second side 128*b* of the base 128 and the second side 114*a* of the housing body 114 and a third distance along the lateral direction A between the third side 128*c* of the base 128 and the third side 114*c* of the housing body 114 can be substantially equal to a fourth distance along the lateral direction A between the fourth side 128*d* of the base 128 and the fourth side 114*d* of the housing body 114. It should be appreciated that the first electrical connector 100 is not limited to the illustrated location of the inner alignment member 110, and that the inner alignment member 110 can alternatively be disposed at any other location within the first array 102 of electrical contacts 104, for instance such that the outer perimeter of the base 128 of the inner alignment member 110 is flanked on all sides by respective electrical contacts 104 of the first array 102. Moreover, the first and second electrical connectors 100 and 200 can include more than one inner alignment member.

Further in accordance with the illustrated embodiment, the inner alignment member 110 can be a two part alignment member that includes a post 130 and a receptacle 132 that is disposed adjacent to and spaced from the post 130 along the longitudinal direction L. The post 130 projects out, along the transverse direction T, with respect to a first portion of the base 128 that supports the post 130. The receptacle 132 includes a block 134 that projects out, along the transverse direction T, with respect to a second portion of the base 128 that supports the receptacle 132. The post 130 and the block 134 can project out with respect to the base to respective distances from the inner end 114*e* of the housing body 114 that can be substantially equal. The first portion of the base 128 can be recessed with respect to the inner end 114*e* of the housing body 114, such that when the first and second electrical connectors 100 and 200 are mated, at least a portion of a complementary receptacle of the second electrical connector 200 will be received in the recessed portion of the base 128, as described in more detail below.

The block 134 can define a bore 136 that extends into the block along the transverse direction T. The illustrated post 130 and bore 136 can be equally spaced from respective sides of the housing body 114. For instance, in accordance with the illustrated embodiment, a first central axis of the post 130 that extends substantially parallel to the transverse direction T is spaced from the first side 114*a* of the housing body 114 a first distance and a second central axis of the bore 136 that extends substantially parallel to the transverse direction T is spaced from the second side 114*b* of the housing body 114 a second distance that is substantially equal to the first distance between the post 130 and the first side 114*a* of the housing body 114. Furthermore, but the first and second central axes are spaced substantially equidistantly between the third and fourth sides 114*c* and 114*d*, respectively, of the housing body 114, such that the post 130 and the bore 136 are substantially aligned with each other along the longitudinal direction L.

Similarly, the second electrical connector 200 can further include at least one alignment member, such as an inner alignment member 210 that is configured to engage the inner alignment member 110 of the first electrical connector 100. The inner alignment member 210 is supported by the connector housing 212 such that the inner alignment member 210 is disposed in the second array 202 of electrical contacts 204. The inner alignment member 210 can be disposed in the second array 202 of electrical contacts 204 such that the inner alignment member 210 is disposed between at least two rows of electrical contacts 204 of the second array 202 and further disposed between at least two columns of electrical contacts 204 of the second array 202. For instance, the inner alignment member 210 can be disposed in the second array 202 of electrical contacts 204 such that an outer perimeter of the inner alignment member 210 is substantially surrounded on all sides by respective ones of the electrical contacts 204 of the at least two rows of electrical contacts 204 and at least two columns of electrical contacts 204.

The inner alignment member 210 can be configured with any geometry as desired. For instance, the illustrated inner alignment member 210 includes a base 228 that defines opposed first and second sides 228*a* and 228*b* that are spaced apart along the longitudinal direction L and opposed third and fourth sides 228*c* and 228*d* that are spaced apart along the lateral direction A. The base 228 can define a height along the transverse direction that is substantially equal to that of the housing body, for instance as defined by the inner end 214*e* and the outer end 214*f*. In accordance with the illustrated embodiment, the base 228, and thus the inner alignment member 210, is integral and monolithic with the housing body 214 of the connector housing 212. Alternatively, the inner alignment member 210 can be separate and attachable to the housing body 214. The first through fourth sides 228*a*-128*d*, respectively, of the base 228 can collectively define an outer perimeter of the inner alignment member 210. In this regard, it can be said that the inner alignment member 210 is disposed in the second array 202 of electrical contacts 104 such that the outer perimeter of the inner alignment member 210, for instance the outer perimeter of the base 228, is substantially surrounded by respective electrical contacts 204 of the second array 202 of electrical contacts 204.

In accordance with the illustrated embodiment, the inner alignment member 210 is disposed in the second array 202 of electrical contacts 204 such that the inner alignment member 210 is disposed at substantially the geometric center of the second array 202, and moreover of the connector housing 212. For example, a first distance along the longitudinal direction L between the first side 228*a* of the base 228 and the first side 214*a* of the housing body 214 can be substantially equal to a second distance along the longitudinal direction L between the second side 228*b* of the base 228 and the second side 214*a* of the housing body 214 and a third distance along the lateral direction A between the third side 228*c* of the base 228 and the third side 214*c* of the housing body 214 can be substantially equal to a fourth distance along the lateral direction A between the fourth side 228*d* of the base 228 and the fourth side 214*d* of the housing body 214. It should be appreciated that the second electrical connector 200 is not limited to the illustrated location of the inner alignment member 210, and that the inner alignment member 210 can alternatively be disposed at any other location within the second array 202 of electrical contacts 204, for instance such that the outer perimeter of the base 228 of the inner alignment member 210 is flanked on all sides by respective electrical contacts 204 of the second array 202. Moreover, the first and second electrical connectors 100 and 200 can include more than one inner alignment member.

Further in accordance with the illustrated embodiment, the inner alignment member 210 can be a two part alignment member that includes a post 230 and a receptacle 232 that is disposed adjacent to and spaced from the post 230 along the longitudinal direction L. The post 230 projects out, along the transverse direction T, with respect to a first portion of the base 228 that supports the post 230. The receptacle 232 includes a block 234 that projects out, along the transverse direction T, with respect to a second portion of the base 228 that supports the receptacle 232. The post 230 and the block 234 can project out with respect to the base to respective distances from the inner end 214*e* of the housing body 214 that can be substantially equal. The first portion of the base 228 can be recessed with respect to the inner end 214*e* of the housing body 214, such that when the first and second electrical connectors 100 and 200 are mated, at least a portion of a complementary receptacle of the first electrical connector 100 will be received in the recessed portion of the base 228, as described in more detail below.

The block 234 can define a bore 236 that extends into the block along the transverse direction T. The illustrated post 230 and bore 236 can be equally spaced from respective sides of the housing body 214. For instance, in accordance with the illustrated embodiment, a first central axis of the post 230 that extends substantially parallel to the transverse direction T is spaced from the first side 214*a* of the housing body 214 a first distance and a second central axis of the bore 236 that extends substantially parallel to the transverse direction T is spaced from the second side 214*b* of the housing body 214 a second distance that is substantially equal to the first distance between the post 230 and the first side 214*a* of the housing body 214. Furthermore, but the first and second central axes are spaced substantially equidistantly between the third and fourth sides 214*c* and 214*d*, respectively, of the housing body 214, such that the post 230 and the bore 236 are substantially aligned with each other along the longitudinal direction L.

The block 134 can further define a first beveled surface 138 configured to guide the post of the inner alignment member 210 into the bore 136, and can still further define a second beveled surface 140 configured to guide the receptacle 232 such that the receptacle 232 of slides past the receptacle 132, as described in more detail below. The bore 136 is sized to receive the post 230 in slidable engagement within the bore 136. Similarly, the block 234 can further define a first beveled surface 238 configured to guide the post of the inner alignment member 110 into the bore 236, and can still further define a second beveled surface 240 configured to guide the receptacle 132 such that the receptacle 132 slides past the receptacle 232, as described in more detail below. The bore 236 is sized to receive the post 130 in slidable engagement within the bore 236. It should be appreciated that the first and second electrical connectors 100 and 200 are not limited to the illustrated inner alignment members, and that the first and second electrical connectors 100 and 200 can alternatively be constructed with any other suitable complementary alignment members as desired.

The first electrical connector 100 can further include at least one alignment member, which can define outer alignment member, that is configured to engage with a complementary outer alignment member of the second electrical connector 200. For example, the first electrical connector 100 can include at least one outer alignment member, such as a plurality of side walls 142 that are disposed outboard of the housing body 114 along one or both of the lateral direction A and the longitudinal direction L along respective portions of the first through fourth sides 114*a*-114*d*, respectively, and extend out with respect to the inner end 114*e* of the housing body 114 and away from the outer end 114*f* along the transverse direction T. Accordingly, the side walls 142 are supported by the housing body 114 and are not disposed in the first array 102 of electrical contacts 104. The side walls 142 can be monolithic with the housing body 114, or otherwise attached to the housing body 114. In accordance with the illustrated embodiment, the first electrical connector 100 includes two pairs of side walls 142, including a first pair 142*a* and an opposed second pair 142*b*. In this regard, it can be said that the first through fourth sides 114*a*-114*d* of the housing body 114 define an outer perimeter of the housing body 114, and the connector housing 112 further includes at least one second, or outer alignment member that protrudes from the housing body 114 along a portion of the perimeter of the housing body 114.

The first pair 142*a* of side walls 142 includes a first side wall 142 that extends from a corner of the housing body 114 defined by the intersection of the first side 114*a* and the fourth side 114*d* to a location along the first side 114*a* that is between, for instance substantially equidistantly between, the third side 114*c* and the fourth side 114*d* of the housing body 114 and a second side wall 142 that extends from the corner of the housing body 114 defined by the intersection of the first side 114*a* and the fourth side 114*d* to a location along the fourth side 114*d* that is between, for instance substantially equidistantly between, the first side 114*a* and the second side 114*b* of the housing body 114.

Similarly, the second pair 142*b* of side walls 142 includes a third side wall 142 that extends from a corner of the housing body 114 defined by the intersection of the second side 114*b* and the third side 114*c* to a location along the third side 114*c* that is between, for instance substantially equidistantly between, the first side 114*a* and the second side 114*b* of the housing body 114 and a fourth side wall 142 that extends from the corner of the housing body 114 defined by the intersection of the second side 114*b* and the third side 114*c* to a location along the second side 114*b* that is between, for instance substantially equidistantly between, the third side 114*c* and the fourth side 114*d* of the housing body 114. The first through fourth side walls 142 of the first and second pairs 142*a* and 142*b* can define beveled inner edges 144 along portions of, such as the entireties of their respective lengths along the longitudinal direction L or the lateral direction A.

Similarly, the second electrical connector 200 can further include at least one alignment member, which can define an outer alignment member, that is configured to engage with the outer alignment member of the first electrical connector 100. For example, the second electrical connector 200 can include at least one outer alignment member, such as a plurality of side walls 242 that are disposed outboard of the housing body 214 along one or both of the lateral direction A and the longitudinal direction L along respective portions of the first through fourth sides 214*a*-214*d*, respectively, and extend out with respect to the inner end 214*e* of the housing body 214 and away from the outer end 214*f* along the transverse direction T. Accordingly, the side walls 242 are supported by the housing body 214 and are not disposed in the second array 202 of electrical contacts 204. The side walls 242 can be monolithic with the housing body 214, or otherwise attached to the housing body 214. In accordance with the illustrated embodiment, the second electrical connector 200 includes two pairs of side walls 242, including a first pair 242*a* and an opposed second pair 242*b*. In this regard, it can be said that the first through fourth sides 214*a*-214*d* of the housing body 214 define an outer perimeter of the housing body 214, and the connector housing 212 further includes at least one second, or outer alignment member that protrudes from the housing body 214 along a portion of the perimeter of the housing body 214.

The first pair 242*a* of side walls 242 includes a first side wall 242 that extends from a corner of the housing body 214 defined by the intersection of the first side 214*a* and the fourth side 214*d* to a location along the first side 214*a* that is between, for instance substantially equidistantly between, the third side 214*c* and the fourth side 214*d* of the housing body 214 and a second side wall 242 that extends from the corner of the housing body 214 defined by the intersection of the first side 214*a* and the fourth side 214*d* to a location along the fourth side 214*d* that is between, for instance substantially equidistantly between, the first side 214*a* and the second side 214*b* of the housing body 214.

Similarly, the second pair 242*b* of side walls 242 includes a third side wall 242 that extends from a corner of the housing body 214 defined by the intersection of the second side 214*b* and the third side 214*c* to a location along the third side 214*c* that is between, for instance substantially equidistantly between, the first side 214*a* and the second side 214*b* of the housing body 214 and a fourth side wall 242 that extends from the corner of the housing body 214 defined by the intersection of the second side 214*b* and the third side 214*c* to a location along the second side 214*b* that is between, for instance substantially equidistantly between, the third side 214*c* and the fourth side 214*d* of the housing body 214. The first through fourth side walls 242 of the first and second pairs 242*a* and 242*b* can define beveled inner edges 244 along portions of, such as the entireties of, their respective lengths along the longitudinal direction L or the lateral direction A.

When the first and second electrical connectors 100 and 200 are mated with each other, respective ones of the side walls of the second electrical connector 200 will be disposed adjacent to corresponding ones of the side walls 142 of the first electrical connector 100. The side walls 142 and the complementary side walls 242 of the second electrical connector 200 can operate to align the respective connector housings 112 and 212, and thus the respective electrical contacts 104 and 204, relative to each other. It should further be appreciated that the respective outer alignment members of the first and second electrical connectors 100 and 200 can operate cooperatively with or separate from the inner alignment members 110 and 210 of the first and second electrical connectors 100 and 200 during mating of the first and second electrical connectors 100 and 200. For instance, the respective outer alignment members of the first and second electrical connectors 100 and 200 can operate before, after, or at the substantially the same time as that of the inner alignment members 110 and 210.

With continuing reference to FIGS. 1-2 and 3A-3B, the electrical contacts 104 of the first array 102 of electrical contacts 104 can be supported by the connector housing 112 such that respective ones of the electrical contacts 104 are oriented toward either the first side 114*a* of the housing body 114 or the second side 114*b* of the housing body 114. For instance, the tips 120 of select electrical contacts 104 of the second array 102 of electrical contacts 104 face the first side 114*a* of the housing body 114 and the tips 120 of other select electrical contacts 104 of the first array 102 of electrical contacts 104 face the second side 114*b* of the housing body 114. In accordance with the illustrated embodiment, the tips 120 of the electrical contacts 104 within each column are oriented in an alternating pattern along the column. Accordingly, the curvature of the tips 120, and thus of the mating ends 116, of a first pair of electrical contacts 104 that are adjacent each other along the column direction (so that no additional electrical contacts are disposed between the adjacent electrical contacts along the column direction) can face away from each other. Furthermore, the curvature of the tips 120, and thus of the mating ends 116, of a second pair of electrical contacts 104 that are adjacent each other along the column direction (so that no additional electrical contacts are disposed between the adjacent electrical contacts along the column direction) can face toward each other. The first pair and the second pair can share a common electrical contact. The curvature of the tips 120 can be oriented along the same direction across each row.

The orientation of the first array 102 of electrical contacts 104 such that select electrical contacts 104 face the first side 114*a* of the housing body 114 while other select electrical contacts 104 face the second side 114*b* allows for normal forces generated by the mating ends 116 and 216, respectively, of the electrical contacts 104 and 204 to substantially cancel each other out, thereby mitigating forces that might bias the respective electrical contacts 104 and 204 of the first and second electrical connectors 100 and 200 out of alignment relative to each other as the first and second electrical connectors 100 and 200 are mated.

Similarly, with continuing reference to FIGS. 1-2 and 3A-3B, the electrical contacts 204 of the second array 202 of electrical contacts 204 can be supported by the connector housing 212 such that respective ones of the electrical contacts 204 are oriented toward either the first side 214*a* of the housing body 214 or the second side 214*b* of the housing body 214. For instance, the tips 220 of select electrical contacts 204 of the second array 202 of electrical contacts 204 face the first side 214*a* of the housing body 214 and the tips 220 of other select electrical contacts 204 of the second array 202 of electrical contacts 204 face the second side 214*b* of the housing body 214. In accordance with the illustrated embodiment, the tips 220 of the electrical contacts 204 within each column are oriented in an alternating pattern along the column. Accordingly, the curvature of the tips 220, and thus of the mating ends 216, of a first pair of electrical contacts 204 that are adjacent each other along the column direction (so that no additional electrical contacts are disposed between the adjacent electrical contacts along the column direction) can face away from each other. Furthermore, the curvature of the tips 220, and thus of the mating ends 216, of a second pair of electrical contacts 204 that are adjacent each other along the column direction (so that no additional electrical contacts are disposed between the adjacent electrical contacts along the column direction) can face toward each other. The first pair and the second pair can share a common electrical contact. The curvature of the tips 220 can be oriented along the same direction across each row.

The orientation of the second array 202 of electrical contacts 204 such that select electrical contacts 204 face the first side 214*a* of the housing body 214 while other select electrical contacts 204 face the second side 214*b* allows for normal forces generated by the mating ends 116 and 216, respectively, of the electrical contacts 104 and 204 to substantially cancel each other out, thereby mitigating forces that might bias the respective electrical contacts 104 and 204 of the first and second electrical connectors 100 and 200 out of alignment relative to each other as the first and second electrical connectors 100 and 200 are mated.

In accordance with the illustrated embodiment, the rows of electrical contacts 104 of the first array 102 are spaced substantially equally from each other along the column direction C. Similarly, the rows of electrical contacts 204 of the second array 202 are spaced substantially equally from each other along the column direction C. The spacing between the rows of electrical contacts 104 of the first array 102 can be substantially equal to that of the second array 202. Further in accordance with the illustrated embodiment, the columns of electrical contacts 104 of the first array 102 are spaced substantially equally from each other along the row direction R. Similarly, the columns of electrical contacts 204 of the second array 202 can be spaced substantially equally from each other along the row direction R. The columns of electrical contacts 104 of the first array 102 can be spaced slightly differently than those of the second array 202, so as to at least partially mitigate the forces the respective mating ends of the electrical contacts of the first and second arrays 102-202 exert against each other as the first and second electrical connectors 100-200 are mated. For instance, in accordance with an embodiment the rows of electrical contacts 104 of the first array 102 can be spaced apart from each other 1 mm along the column direction C, while the rows of electrical contacts 204 of the second array 202 can be spaced apart from each other in alternating distances of 0.95 mm, 1.05 mm, 0.95 mm, 1.05 mm, and so on, along the column direction C.

The first and second electrical connectors 100 and 200 can be mated to each other in a mating direction M that can be defined by the transverse direction T, and unmated from each other in a direction opposite the mating direction. As the first and second electrical connectors 100 and 200 are mated, the respective alignment members of the electrical connectors can operate to align the first and second electrical connectors 100 and 200 relative to each other, thereby aligning the first array 102 of electrical contacts 104 of the first electrical connector 100 with the second array 202 of electrical contacts 204 of the second electrical connector 200. For instance, the side walls 142 of the first electrical connector 100 can engage with corresponding sides of the housing body 214 of the connector housing 212 of the second electrical connector 200, and the walls 242 of the second electrical connector 200 can engage with corresponding sides of the housing body 114 of the connector housing 112 of the first electrical connector 100, so as to at align the respective connector housings 112 and 212 of the first and second electrical connectors 100 and 200 relative to each other along one or both of the longitudinal direction L and the lateral direction A.

Additionally, the inner alignment member 110 of the first electrical connector 100, which can be referred to as a first alignment member, can mate with the inner alignment member 210 of the second electrical connector 200, which can be referred to as a second alignment member, so as to substantially align the first and second arrays 102 and 202 of electrical contacts 104 and 204, respectively, relative to each other, for instance to precisely align the mating ends 116 of the electrical contacts 104 of the first array 102 with corresponding mating ends 216 of the electrical contacts 204 of the second array 202. For example, as the first and second electrical connectors 100 and 200 are mated, the post 130 of the inner alignment member 110 of the first electrical connector 100 can be received in the receptacle 232 of the second electrical connector 200, and the post 230 of the second electrical connector 200 can be received in the receptacle 132 of the first electrical connector 100.

As the first and second electrical connectors 100 and 200 are further mated along the mating direction M, the block 134 of the inner alignment member 110 can slide past the block 234 of the inner alignment member 210, such that at least a portion of the block 234 of the inner alignment member 210 is received in the recessed first portion of the base 128 of the inner alignment member 110 and the block 134 of the inner alignment member 110 is received in the recessed first portion of the base 228 of the inner alignment member 210. It should be appreciated that the first and second electrical connectors 100-200 cannot be mated to each other if the electrical connectors are not oriented properly with respect to one another. For instance, the side walls 142 of the first electrical connector 100 would interfere with respective side walls 242 of the second electrical connector 200 and the post 130 of the first electrical connector 100 would interfere with the complementary post 230 of the second electrical connector 200, and thus the electrical contacts 104 cannot mate with the electrical contacts 204 of the second array 202 unless the first and second electrical connectors 100-200 are properly oriented relative to each other. In this regard, the respective alignment members of the first and second electrical connectors 100-200 can additionally operate as orientation that establish a predetermined orientation between the first and second electrical connectors 100 and 200 to be mated. It should be appreciated that the second electrical connector 200 can be a mirror image of the first electrical connector 100 that is rotated about both a first axis in the transverse direction T and a second axis in the longitudinal direction L when the first and second electrical connectors 100 and 200 are aligned to be mated with each other.

When the first and second electrical connectors 100 and 200 are fully mated to each other, the mating end 116 of each electrical contact 104 of the first array 102 makes at least two points of contact, such as C1 and C2, with the mating end 216 of a corresponding electrical contact 204 of the second array 202, such that the electrical contacts 104 and 204 of the first and second arrays 102 and 202, respectively, define stub lengths and between the respective contact location of the curved tip 120 or 220 to the distal free end of the respective tip 120 or 220. The two points of contact C1 and C2 can also provide passive retention of the first and second electrical connectors 100 and 200 with respect to each other. Moreover, the electrical connector assembly 10, for instance the first and second electrical connectors 100 and 200, when fully mated, exhibit a stack height, for instance as defined by a distance along the transverse direction T between respective locations on the solder balls 122 of the electrical contacts 104 of the first array 102 that are spaced furthest from the inner end 114*e* of the housing body 114 of the connector housing 112 of the first electrical connector 100 and respective locations on the solder balls 222 of the electrical contacts 204 of the second array 202 that are spaced furthest from the inner end 214*e* of the housing body 214 of the connector housing 212 of the second electrical connector 200. Otherwise stated, the stack height can be defined by opposed outermost ends, along the transverse direction T, of the solder balls of the first electrical connector 100 and solder balls 222 of the second electrical connector 200. In accordance with the illustrated embodiment, the stack height of the electrical connector assembly 10, that is the cumulative height of the first and second electrical connectors 102 and 202 along the transverse direction T when mated, can be in a range having a lower end between and including approximately 1 mm and approximately 2 mm, and increments of 0.1 mm therebetween. The range can have an upper end between and including approximately 2 mm and approximately 4 mm, and increments of 0.1 mm therebetween. For instance, the stack height can be approximately 2 mm. The stack height can further be approximately 3 mm. In this regard, it can be said that when the first and second electrical connectors 100 and 200 are mated to each other, each fusible element of the first array 102 of electrical contacts 104 is spaced from a corresponding fusible element of the second array 202 of electrical contacts 204 a distance equal to the stack height along the transverse direction T.

It should be appreciated that the first and second electrical connectors 100 and 200, respectively, can be constructed in accordance with any suitable alternative embodiment as desired. For instance, referring now to FIGS. 4 and 5, the electrical contacts 104 can be oriented differently than the embodiment illustrated in FIGS. 1-2. For instance, the tips 120 of select ones of the electrical contacts 104 face the first side 114*a* of the housing body 114 and the tips of other ones of the electrical contacts 104 face the second side 114*b*. In accordance with the illustrated embodiment, the tips 120 of the electrical contacts 104 within each row are oriented in the same direction, that is toward a common one of the first and second side walls 114*a* and 114*b*, across the respective row. For instance, all tips 120 of each row can face one of the first and second sides 114*a* and 114*b*, and all tips 120 of an immediately adjacent row can face the other of the first and second sides 114*a* and 114*b*. Thus, the tips 120 of at least one of the electrical contacts 104 within each column can be oriented opposite to others of the electrical contacts 104 of the respective column. For instance, the orientation of immediately adjacent tips 120 along the column can alternate between facing the first side 114*a* and facing the second side 114*b*. As will be appreciated, the broadsides of the electrical contacts 104 face the first and second sides 114*a* and 114*b*, and the edges of the electrical contacts 104 face the third and fourth sides 114*c* and 114*d*. Thus, the electrical contacts 104 can be oriented such that their broadsides face each other along the column direction C, and their edges face each other along the row direction R.

The mating ends 116 of each electrical contact 104 are offset with respect to the respective mounting end 118, such that the mating end 116 and mounting end 118 are not aligned with each other along the transverse direction T. For instance, the mating ends 116 can be offset from the mounting ends along the longitudinal direction L. Accordingly, the mounting ends 118 of the electrical contacts 304 of the first array 302 can be spaced equidistantly with respect to each other along both the row direction R and the column direction C, while immediately adjacent mating ends 116 can be spaced substantially equally from each other at varying distances at least along the column direction C, and can further be spaced at varying distances along the row direction R. Thus, the array 102 of electrical contacts 104 can define a row pitch (i.e., distance between adjacent rows along the column direction) at the distal ends of the tips 120 that varies along the array 102. For instance, the array 102 can define two different row pitches that alternate between immediately adjacent rows. For instance, the mating ends 116 of a select row of electrical contacts 104 are spaced closer to the respective mating ends 116 of a first immediately adjacent row of electrical contacts 104 whose tips that face toward the tips of the select row of electrical contacts 104 than to the respective mating ends 116 of a second immediately adjacent row of electrical contacts 104 whose tips 120 that face away from the tips 120 of the select row of electrical contacts 304.

The side walls 142 can extend along an outer perimeter of the housing body 114 and extends out with respect to the inner end 114*e* of the housing body 114 along substantially the transverse direction T, such that the side wall 142 substantially surrounds the first array 102 of electrical contacts 104. It should be appreciated that while the illustrated side wall 142 is substantially continuous about the outer perimeter of the housing body 314, that the wall 142 can be alternatively constructed as desired, for example as a wall comprising a plurality of wall segments that extend along respective portions of at least one, such as each of the sides 314*a*-314*d*, for instance as illustrated in FIGS. 1-2.

The first electrical connector 100 can further include at least one alignment member as described above. In accordance with the embodiment illustrated in FIGS. 4-5, the at least one alignment member can include a plurality of alignment members, such as slots 152 that extend into at least a portion of the housing body 114 along the transverse direction, for instance into the inner end 114*e* and toward or out the outer end 114*f*, that is through the housing body 114. In accordance with the illustrated embodiment, the housing body 114 can define four slots 152, each slot 152 configured to receive a respective one of alignment members, such as ridges 252, of the second electrical connector 200, as described in more detail below. The illustrated slots 152 are located proximate to respective corners of an outer perimeter of the first array 102 of electrical contacts 104, such that the slots 152 are disposed between the first array 102 of electrical contacts 104 and the side wall 142. In this regard, it can be said that the first electrical connector 100 includes a first alignment member that is disposed between the first array 102 of electrical contacts 104 and at least a portion of the side wall 142. The illustrated slots 152 are substantially "L" shaped, but the slots 152 can have any other suitable geometry as desired. Moreover, it should be appreciated that the first electrical connector 100 is not limited to the illustrated slot locations, and that more or fewer slots can be defined as desired, for instance at any other suitable locations along the outer perimeter of the first array 102 of electrical contacts 104.

The first electrical connector 100 can further include at least one orientation member configured to engage with a complementary orientation member of the second electrical connector 200 only when the first and second electrical connectors 100 and 200 are in a predetermined orientation with relative to each other, thereby ensuring the relative orientation when the first and second electrical connectors 100 and 200 are mated to each other. In accordance with the illustrated embodiment, the orientation member of the first electrical connector 100 can be configured as a recess 154 that extends into the side wall 142, for instance at the first side 114*a*, toward the array 102 of electrical contacts 104, and that further extends along the transverse direction T from the inner end 114*e* toward the outer end 114*f*, for instance through the outer end 114*f*, and thus through the connector housing 112. The recess 154 is configured to receive a complementary orientation member, such as a tab 254, of the second electrical connector 400 as described in more detail below. It should be appreciated that the connector housing 112 is not limited to the illustrated recess 154, and that the connector housing 112 can alternatively be constructed with any other suitable orientation member, or members, as desired.

Figure 4:
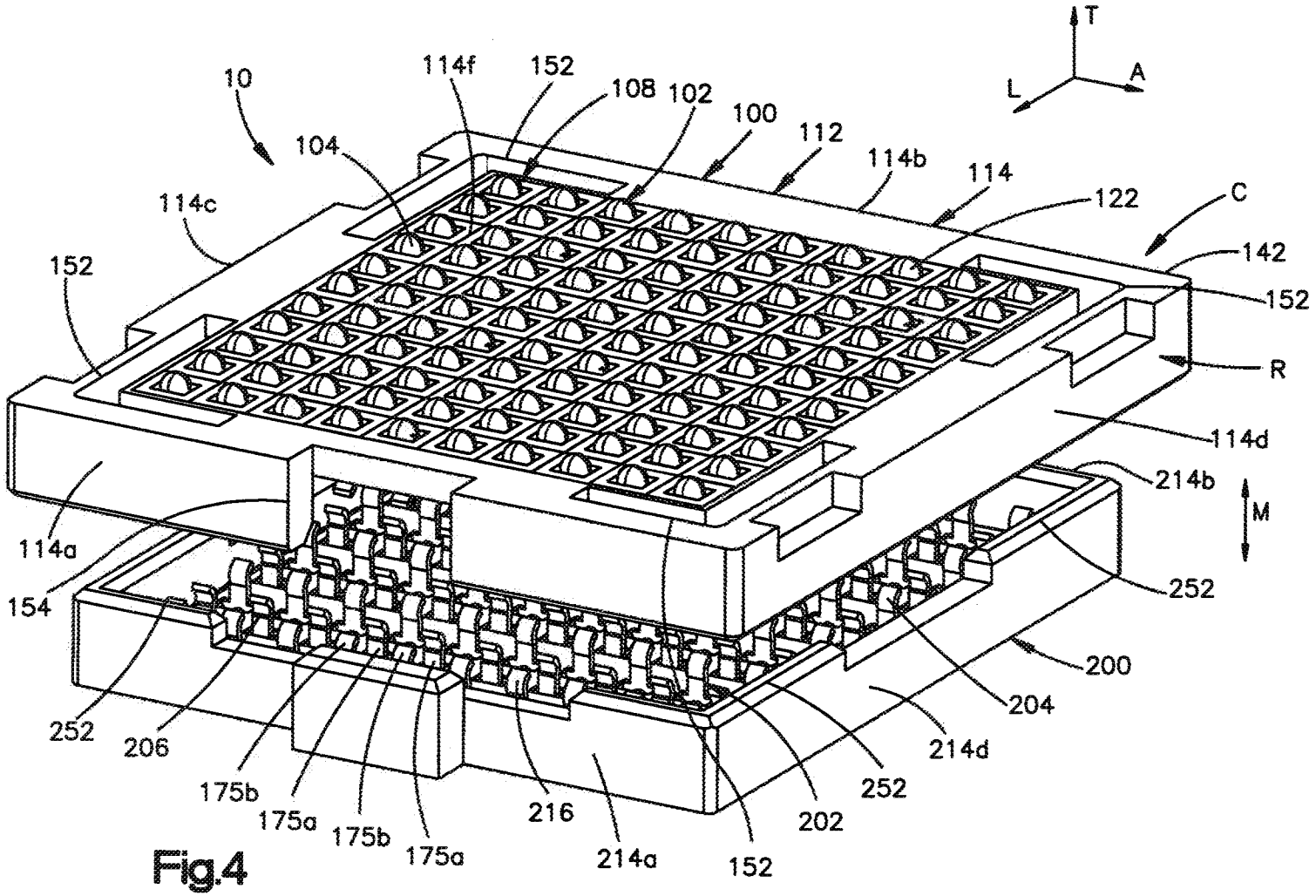
FIG. 4 is a perspective view of an electrical assembly constructed in accordance with an alternative embodiment, including first and second electrical connectors.
Figure 5:
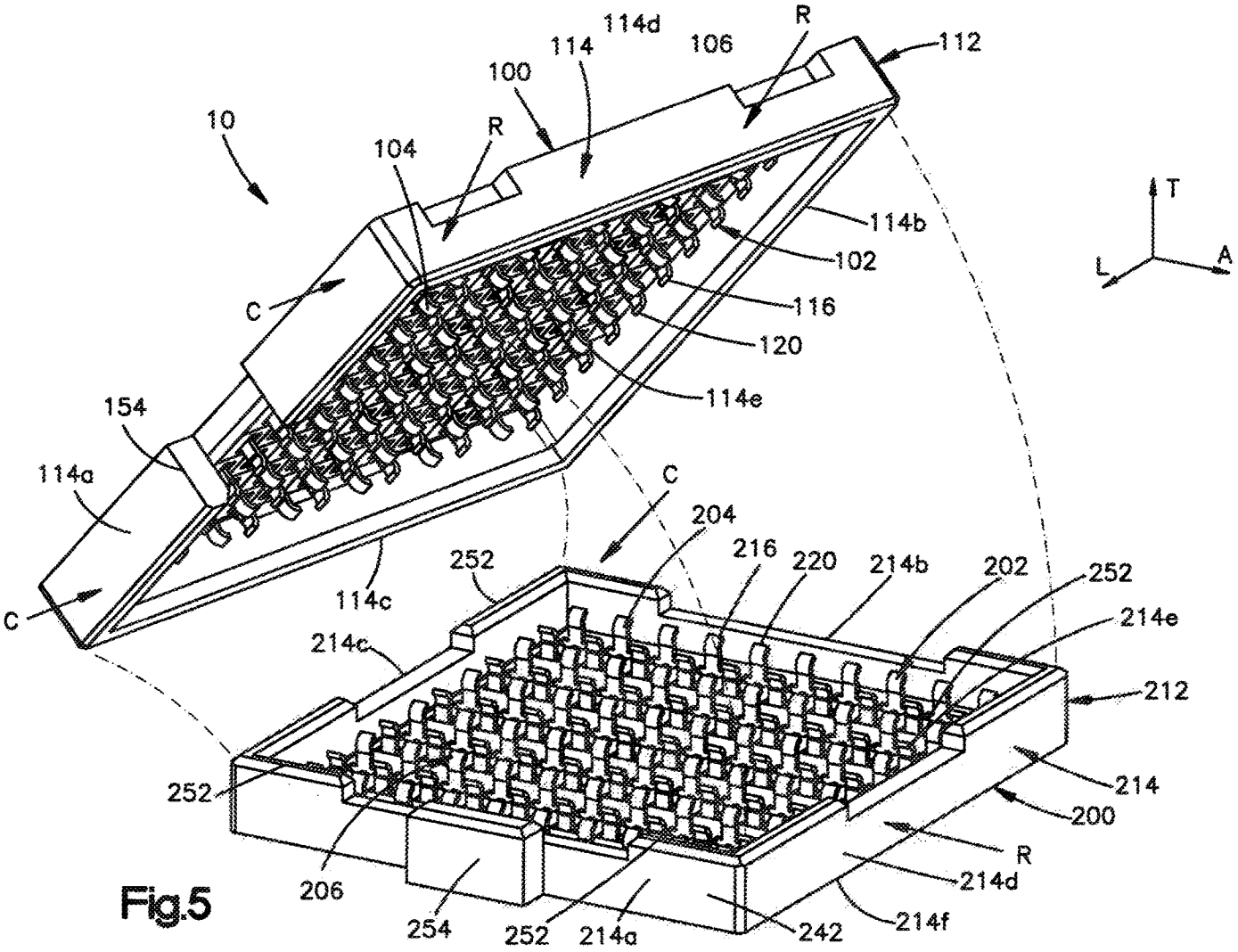
FIG. 5 is a perspective view of the first and second electrical connectors illustrated in FIG. 4.
Figure 6A:
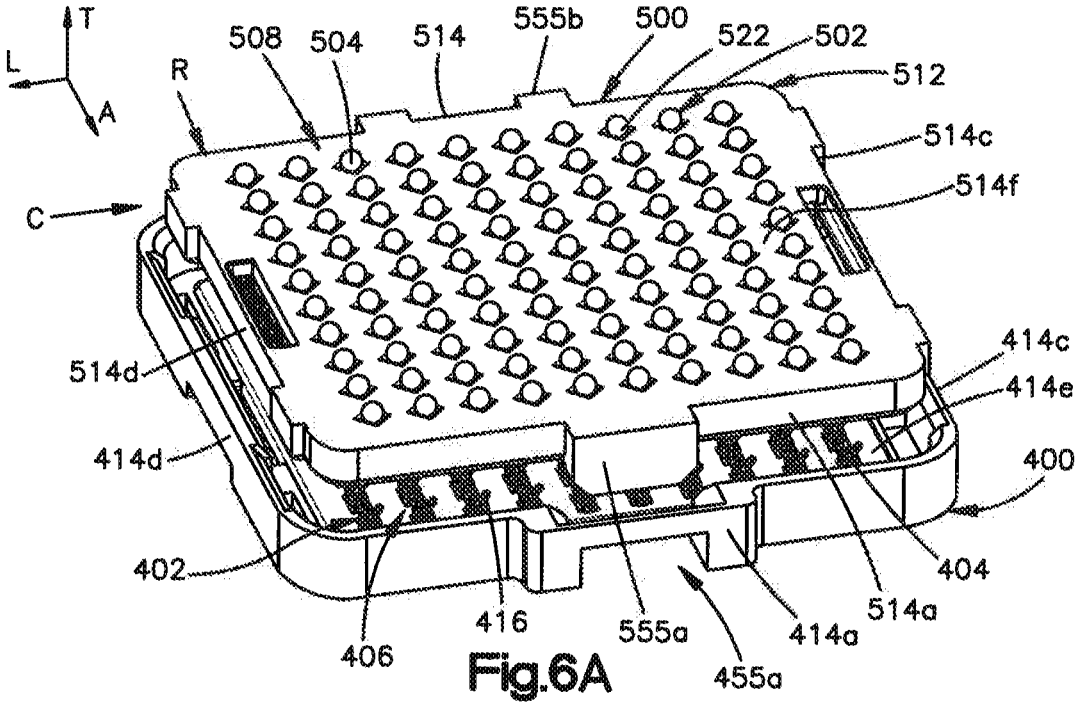
FIG. 6A is a perspective view of an electrical connector assembly constructed in accordance with an alternative embodiment, including a receptacle connector and a header connector configured to be mated with each other.
Figure 6B:
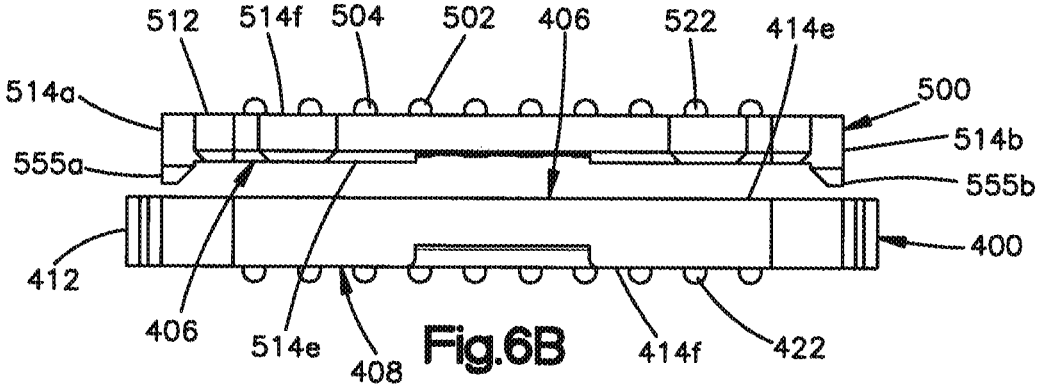
FIG. 6B is a side elevation view of the electrical connector assembly illustrated in FIG. 6A.
Figure 6C:
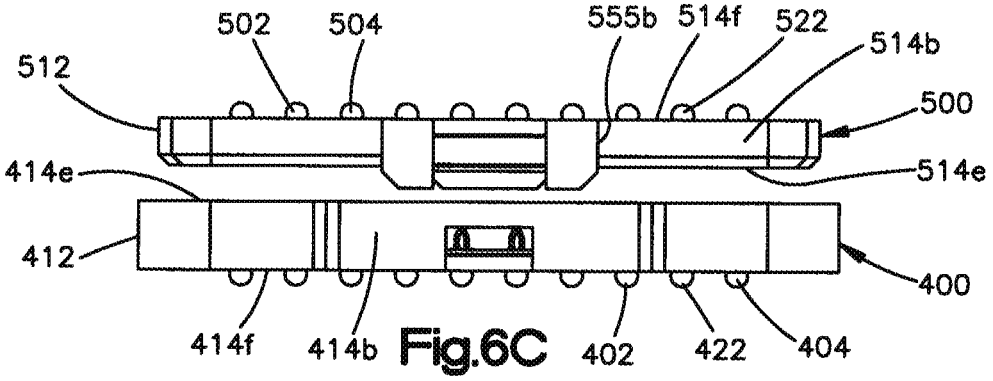
FIG. 6C is another side elevation view of the electrical connector assembly illustrated in FIG. 6A.
Figure 7A:
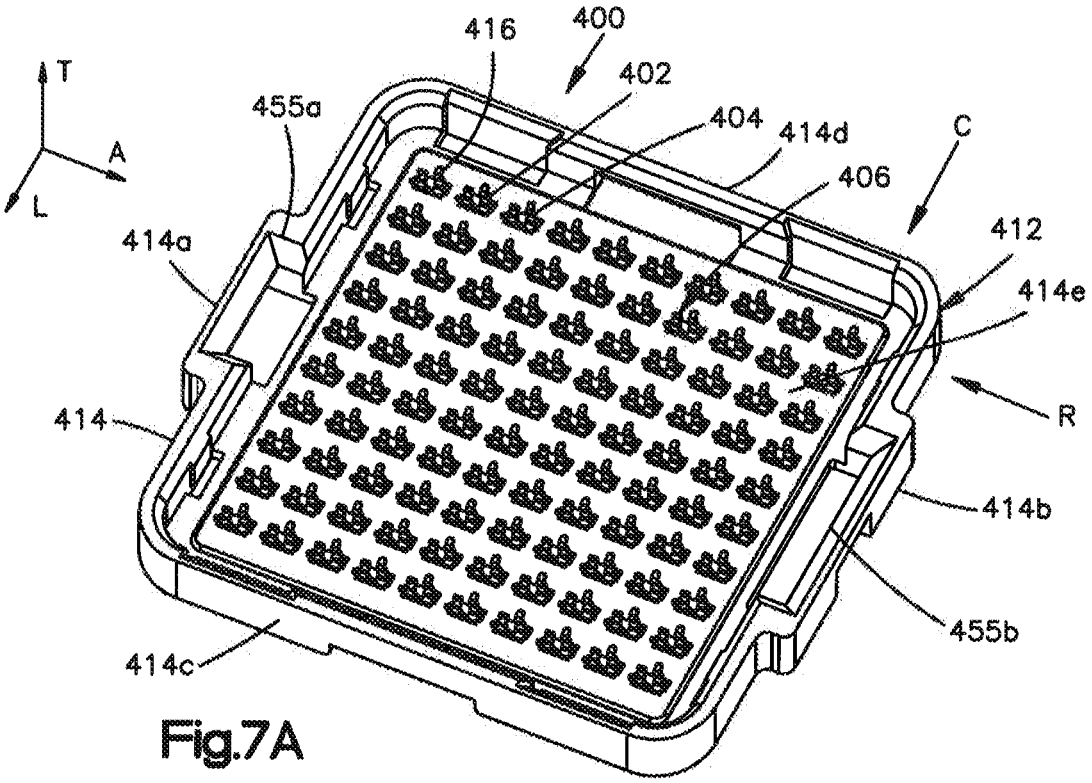
FIG. 7A is a perspective view of the receptacle connector illustrated in FIG. 6A, showing the mating interface.
Figure 7B:
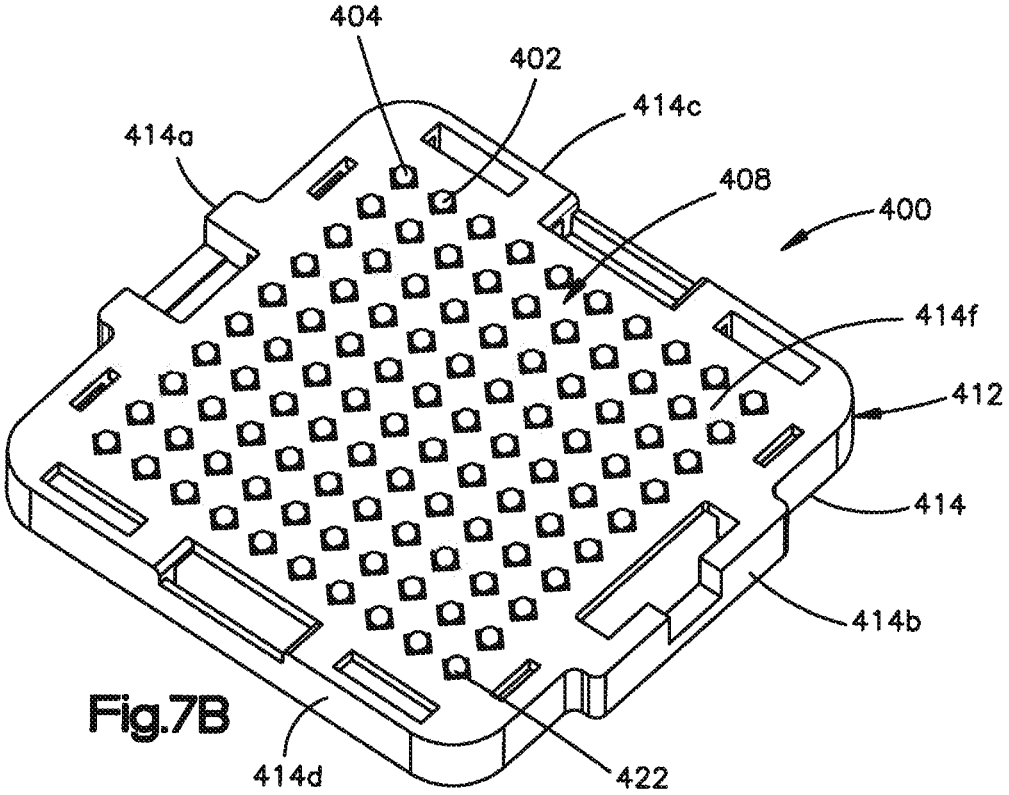
FIG. 7B is a perspective view of the receptacle connector illustrated in FIG. 6A, showing the mounting interface.
Figure 7C:
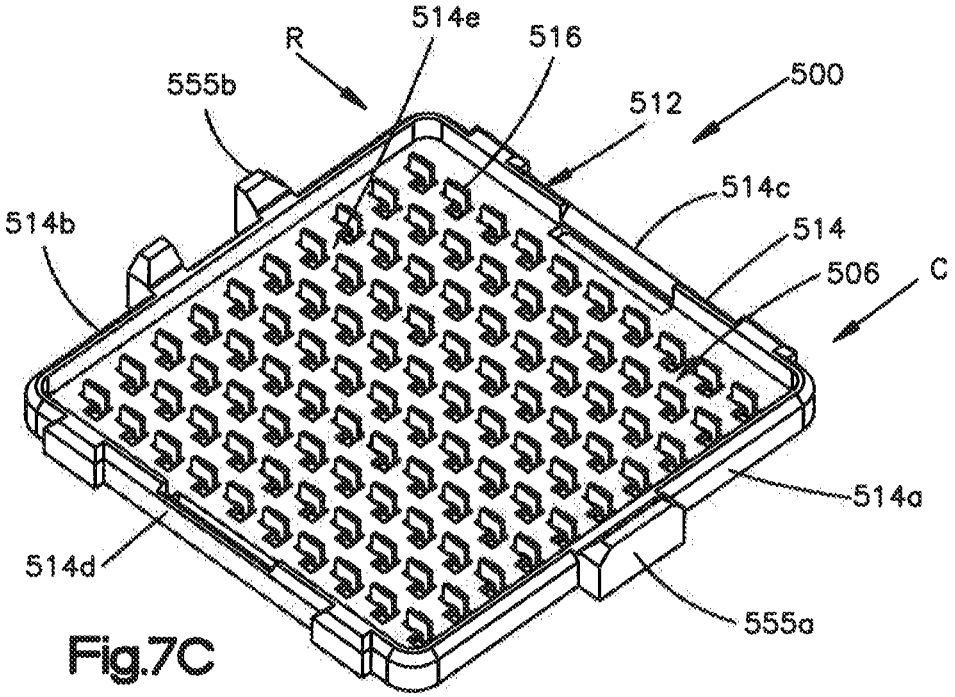
FIG. 7C is a perspective view of the header connector illustrated in FIG. 6A, showing the mating interface.
Figure 7D:
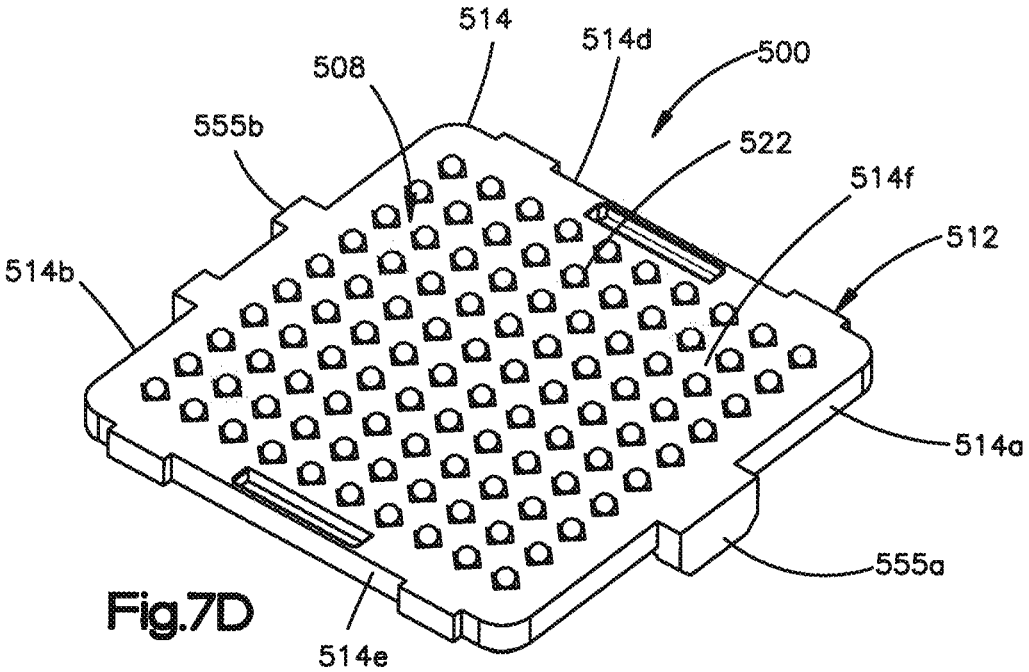
FIG. 7D is a perspective view of the header connector illustrated in FIG. 6A, showing the mounting interface.
Figure 8A:
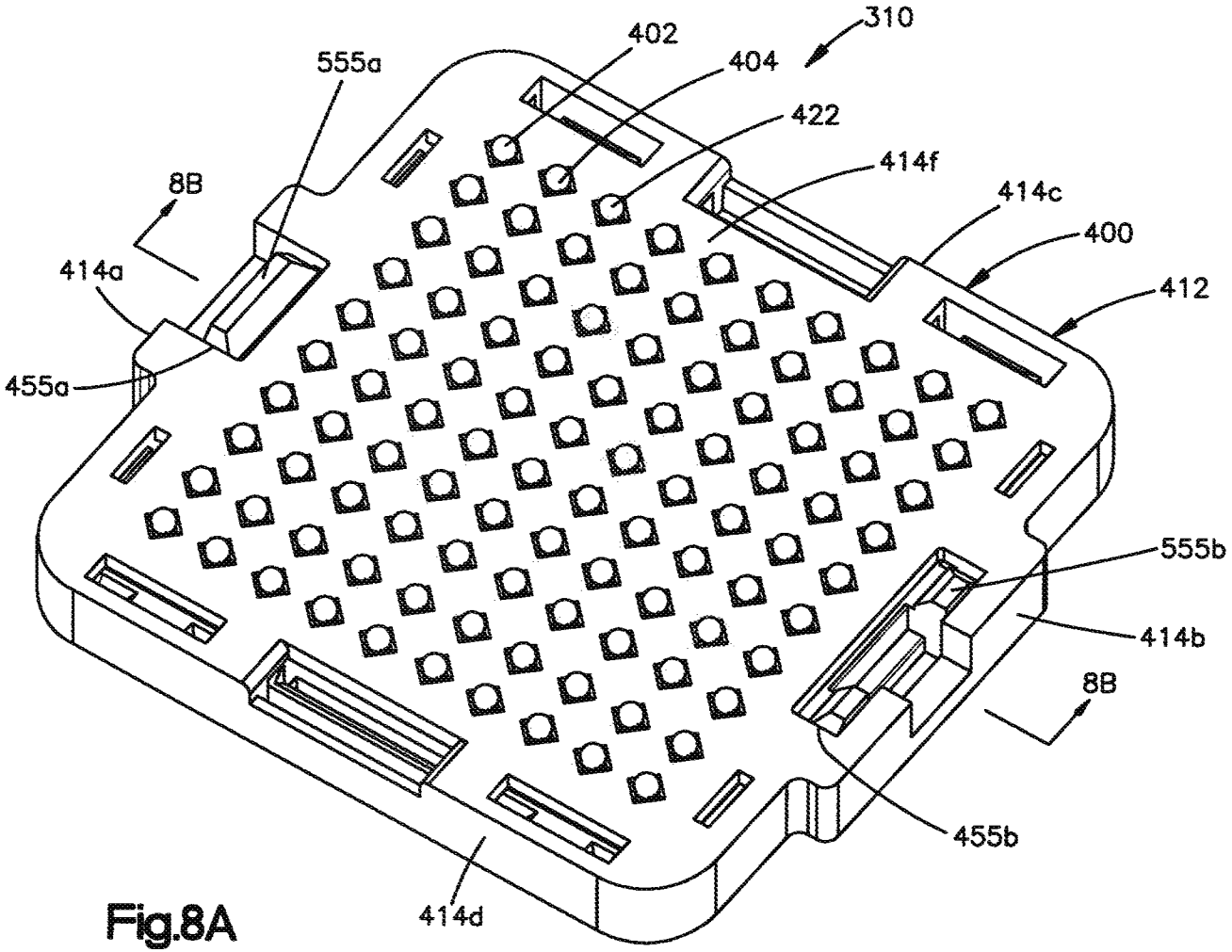
FIG. 8A is a top plan view of the electrical connector assembly illustrated in FIG. 6A, shown with the receptacle and header connectors mated with each other.
Figure 8B:
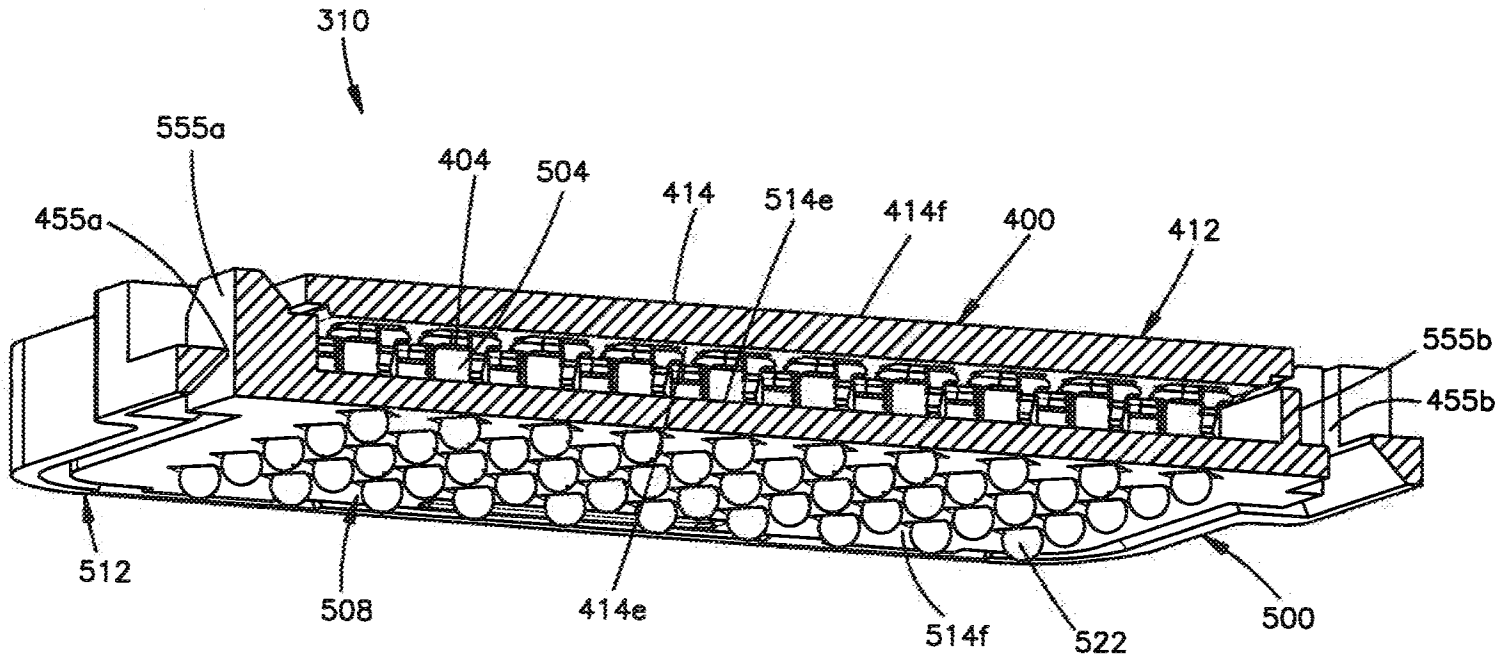
FIG. 8B is a sectional side elevation view of the electrical connector assembly illustrated in FIG. 8A, taken along line 8B-8B.

With continuing reference to FIGS. 4-5, the electrical contacts 204 of the second electrical connector 200 can be oriented differently than the embodiment illustrated in FIGS. 1-2. For instance, the tips 220 of select ones of the electrical contacts 204 face the first side 214*a* of the housing body 214 and the tips of other ones of the electrical contacts 204 face the second side 214*b*. In accordance with the illustrated embodiment, the tips 220 of the electrical contacts 204 within each row are oriented in the same direction, that is toward a common one of the first and second side walls 214*a* and 214*b*, across the respective row. For instance, all tips 220 of each row can face one of the first and second sides 214*a* and 214*b*, and all tips 220 of an immediately adjacent row can face the other of the first and second sides 214*a* and 214*b*. Thus, the tips 220 of at least one of the electrical contacts 204 within each column can be oriented opposite to others of the electrical contacts 204 of the respective column. For instance, the orientation of immediately adjacent tips 220 along the column can alternate between facing the first side 214*a* and facing the second side 214*b*. As will be appreciated, the broadsides of the electrical contacts 204 face the first and second sides 214*a* and 214*b*, and the edges of the electrical contacts 204 face the third and fourth sides 214*c* and 214*d*. Thus, the electrical contacts 204 can be oriented such that their broadsides face each other along the column direction C, and their edges face each other along the row direction R.

The mating ends 216 of each electrical contact 204 are offset with respect to the respective mounting end 218, such that the mating end 216 and mounting end 218 are not aligned with each other along the transverse direction T. For instance, the mating ends 216 can be offset from the mounting ends along the longitudinal direction L. Accordingly, the mounting ends 218 of the electrical contacts 204 of the second array 202 can be spaced equidistantly with respect to each other along both the row direction R and the column direction C, while immediately adjacent mating ends 216 can be spaced substantially equally from each other at varying distances at least along the column direction C, and can further be spaced at varying distances along the row direction R. Thus, the second array 202 of electrical contacts 204 can define a row pitch (i.e., distance between adjacent rows along the column direction) at the distal ends of the tips 220 that varies along the array 202. For instance, the array 202 can define two different row pitches that alternate between immediately adjacent rows. For instance, the mating ends 216 of a select row of electrical contacts 204 are spaced closer to the respective mating ends 216 of a first immediately adjacent row of electrical contacts 204 whose tips that face toward the tips of the select row of electrical contacts 204 than to the respective mating ends 216 of a second immediately adjacent row of electrical contacts 204 whose tips 220 that face away from the tips 220 of the select row of electrical contacts 204.

The side walls 242 of the second electrical connector 200 can extend along an outer perimeter of the housing body 214 and extends out with respect to the inner end 214*e* of the housing body 214 along substantially the transverse direction T, such that the side walls 242 substantially surround the second array 202 of electrical contacts 204. It should be appreciated that while the illustrated side walls 242 are substantially continuous about the outer perimeter of the housing body 214, that the walls 242 can be alternatively constructed as desired, for example as a wall comprising a plurality of wall segments that extend along respective portions of at least one, such as each of the sides 214*a*-214*c* (see FIGS. 1-2). In accordance with the illustrated embodiment, the side walls 242 of the second electrical connector 200 illustrated in FIGS. 4-5 can be configured to be inserted in the side walls 142 of the first electrical connector 100, such that the side walls 242 nest within the side walls 142 when the first and second electrical connectors 100 and 200 are mated with each other.

The second electrical connector 200 can further include at least one alignment member, such as a plurality of alignment members configured to engage with respective complementary alignment member of the first electrical connector 100. For example, the second electrical connector 200 can include a plurality of alignment members, such as ridges 252 that extend out from respective portions of outer edges of at least one or more up to all of the side walls 242, substantially along the transverse direction T, and are configured to be received in corresponding ones of the slots 152 of the connector housing 112. In accordance with the illustrated embodiment, the side walls 242 can define four respective ridges 252, each ridge 252 configured to be at least partially received in a respective one of the slots 152. The illustrated ridges 252 are located proximate to respective corners of the side walls 242. The illustrated ridges 252 can be substantially "L" shaped so as to fit in respective ones of the slots 152, but the ridges 252 can have any other suitable geometry as desired. Moreover, it should be appreciated that the second electrical connector 200 is not limited to the illustrated ridge locations, and that more or fewer ridges can be defined as desired, for instance at any other suitable locations along the wall 250. It should further be appreciated that the first and second electrical connectors 100-200 are not limited to the illustrated slots 152 and ridges 252, and that the first and second electrical connectors 100-200 can be alternatively constructed with any other suitable alignment members as desired, for instance as illustrated in FIGS. 1-2.

The second electrical connector 200 can further include at least one orientation member configured to engage with a complementary orientation member of the first electrical connector 100 to ensure proper orientation of the first and second electrical connectors 100-200 relative to each other during mating of the first and second electrical connectors 100-200. In accordance with the illustrated embodiment, the connector housing 212 of the second electrical connector 200 can include at least one alignment member, such as the tab 254 that extends out from the wall 250 at the front end 214*a* of the housing body 214, the tab 254 configured to be received in the recess 154 of the connector housing 112. It should be appreciated that the connector housing 212 is not limited to the illustrated tab 254, and that the connector housing 212 can alternatively be constructed with any other suitable orientation member, or members, as desired, for instance as illustrated in FIGS. 1-2.

The first and second electrical connectors 100-200 can be mated and unmated to each other along the mating direction M. For instance, the first and second electrical connectors 100-200 are oriented such that the tab 254 is aligned to be received in the recess 154. Once the first and second electrical connectors 100-200 are properly oriented relative to one another, the first and second electrical connectors 100-200 can be mated. As the first and second electrical connectors 100-200 are mated, the respective alignment members of the electrical connectors can operate to align the first and second electrical connectors 300-400 relative to each other, thereby aligning the first array 102 of electrical contacts 104 with the second array 202 of electrical contacts 204. For instance, the side wall 242 can be received in nesting engagement by the side wall 142. The walls 142 and 242 can abut each other and slide along each other as the first and second electrical connectors 100 and 200 are mated. As the first and second electrical connectors 300-400 are further mated, the ridges 252 can be received in the slots 152 so as to substantially align the first and second arrays 102 and 202 of electrical contacts 104 and 204.

When the first and second electrical connectors 100 and 200 are aligned to be mated with each other, and mated with each other, select ones of the electrical contacts 104 and 204 mate with each other so as to define first and second mated contacts, respectively. The tip 120 of the first mated contact of the electrical contacts 104 faces one of the first and second sides 104*a* and 104*b*, and the tip 220 of the second mated contact of the electrical contacts 204 faces the other of the first and second sides 204*a* and 204*b*.

It should be appreciated that each of the electrical connectors 100 and 200 can include an electrically insulative connector housing and an array of gender-neutral electrical contacts (104 and 204, respectively) supported by the connector housing. The array of electrical contacts can define an open pinfield, such that each electrical contact 104 and 204 can be assigned as a signal contact or a ground contact as desired, and is not a dedicated signal contact or ground contact. Each of the electrical contacts 104 and 204 illustrated in FIGS. 1-5 can define a broadside 175*a*, such as a pair of broadsides that are spaced from each other along a first direction which can be defined by the column direction C, and an edge 175*b*, such as a pair of edges that are spaced from each other along a second direction that can be defined by the row direction R. Thus, the first and second directions can be perpendicular with respect to each other. An intersection between the lead portion 119 or 219 and a plane that extends substantially perpendicular to the lead portion defines a first dimension that extends along an entirety of each of the edges 175*b* and a second dimension that extends along an entirety of each of the broadsides 175*a*, such that the second dimension is greater than the first dimension. For instance, the first dimension of the edges 175*b* can be equal to the material thickness of the electrical contact, while the second dimension of the broadsides 175*a* can be defined by a stamping operation when stamping the electrical contacts from the material. Thus, it can be said that the broadsides 175*a* are longer than the edges 175*b* along the intersection of the lead portion the plane that is oriented substantially orthogonal to the electrical contact, for instance at the lead portion. The plane can be oriented in the lateral and longitudinal directions. The array of electrical contacts can define a plurality of rows that are spaced along a column direction and a plurality of columns that are spaced along a row direction. The edges of adjacent ones of the electrical contacts of each row face each other along the row direction, and the broadsides of adjacent ones of the electrical contacts of each column face each other along the column direction.

The mating ends can be curved so as to define a curvature. The electrical contacts define first, second, and third electrical contacts that are aligned along the column direction (for instance along one of the columns). The second electrical contact can be disposed adjacent and disposed between the first and third electrical contacts (such that no additional electrical contacts are disposed between the first electrical contact and the second electrical contact in the column along the column direction, and no additional electrical contacts are dispose between the second electrical contact and the third electrical contact in the column along the column direction). The curvature of the mating ends of the first and second electrical contacts face each other, and the curvature of the mating ends of the second and third electrical contacts face away from each other. For instance, the mating end of the first electrical contact can be concave with respect to the mating end of the second electrical contact. Similarly, the mating end of the second electrical contact is concave with respect to the mating end of the first electrical contact. Furthermore, the mating end of the third electrical contact can be convex with respect to the mating end of the second electrical contact, and the mating end of the second electrical contact can be convex with respect to the mating end of the third electrical contact.

Accordingly, a first distance can be defined along the column direction from the mating end of the first electrical contact to the mating end of the second electrical contact, and a second distance is defined along the column direction from the mating end of the second electrical contact to the mating end of the third electrical contact, and the first distance is less than the second distance. For instance, the lead portion of at least one, up to all, of the electrical contacts, including each of the first, second, and third electrical contacts can define a thickness along the column direction, and the second distance is greater than the thickness. For instance, the second distance can be greater than twice the thickness and less than any distance as desired, such as one-hundred times the thickness, including less than fifty times the thickness. The electrical contacts can be evenly spaced along the row direction.

In accordance with the illustrated embodiment, the curvature of the electrical contacts alternates in direction from contact to adjacent contact of each column. Furthermore, at least one of the columns up to all of the columns defines first and second outermost electrical contacts that define opposed ends of the column along the column direction, and the direction of curvature of the mating ends of the first and second outermost electrical contacts are the same. Thus, it should be appreciated that each column can define an odd number of electrical contacts. Alternatively, each column can define an even number of electrical contacts, whereby the direction of curvature of the mating ends of the first and second outermost electrical contacts are the opposite each other.

Furthermore, the mating ends of the electrical contacts can extend out from the connector housing such that a straight line extending through the curvature, and thus the mating end, of the electrical contacts of each column along the column direction does not pass through the connector housing. For instance, the line passes only through air between the curvatures of the electrical contacts that are adjacent each other along the column direction.

In accordance with the illustrated embodiment, at least one, up to all of, the electrical contacts including each of the first, second, and third electrical contacts can be gender neutral, and thus configured to mate with a respective one electrical contact that is shaped substantially identical to the respective electrical contacts, such as the respective first, second, and third electrical contacts. Accordingly, each of the electrical contacts is configured to mate with a respective different electrical contact of another electrical connector.

Referring now to FIGS. 6A-7D, an electrical connector assembly 310 includes a first electrical connector 400 and a second electrical connector 500 that is configured to be mated to the first electrical connector 400 so as to place the first and second electrical connectors in electrical communication with each other. The first electrical connector 400 can include at least one alignment member that is configured to engage with a complementary at least one alignment member of the second electrical connector, as described in more detail below. The respective at least one alignment members of the first and second electrical connectors 400 and 500, respectively, can engage each other when the first and second electrical connectors 400 and 500 are mated, so as to at least partially align respective electrical contacts of the first and second electrical connectors 400 and 500, with respect to each other and to ensure proper orientation of the first and second electrical connectors 400 and 500 with respect to each other during mating of the electrical connectors. The first electrical connector 400 can be configured as a receptacle electrical connector, and the second electrical connector 500 can be configured as a header connector whose electrical contacts are configured to be received by the electrical contacts of the first electrical connector 400.

The first electrical connector 400 can include a connector housing 412, which can be referred to as a first connector housing, and an array 402 of electrical contacts 404, which can be referred to as a first array of electrical contacts, that are supported by the connector housing 412. The connector housing 412 can be made of any suitable dielectric material, such as plastic and the electrical contacts 404 can be made of any suitable electrically conductive material, such as metal. In accordance with the illustrated embodiment, the connector housing 412 can be overmolded onto the electrical contacts 404. Alternatively, the electrical contacts 404 can be stitched into the connector housing 412 or otherwise supported by the connector housing 412 as desired. The connector housing 412 can include a housing body 414 that defines opposed first and second sides 414*a* and 414*b* that are spaced from each other along a first or longitudinal direction L, opposed third and fourth sides 414*c* and 414*d* that are spaced from each other along a second or lateral direction A that extends substantially perpendicular to the longitudinal direction L, an inner end 414*e* that defines a mating interface 106, and an outer end 414*f* that is spaced from the inner end 414*e* along a third or transverse direction T and defines an opposed mounting interface 108. The transverse direction T extends substantially perpendicular to both the longitudinal direction L and the lateral direction A. It should be appreciated that in accordance with the illustrated embodiment, the longitudinal direction L and the lateral direction A are oriented horizontally, and the transverse direction T is oriented vertically, though it should be appreciated that the orientation of the first electrical connector 400, and thus the electrical connector assembly 10, can vary during use. Unless otherwise specified herein, the terms "lateral," "laterally," "longitudinal," "longitudinally," "transverse," and "transversely" are used to designate perpendicular directional components in the drawings to which reference is made.

The first electrical connector 400 is configured to be mounted to an underlying substrate, for instance a first printed circuit board (PCB), at the mounting interface 408 such that the first electrical connector 400 is placed in electrical communication with the first printed circuit board. Similarly, the second electrical connector 500 can be configured to be mounted to an underlying substrate, for instance a second printed circuit board (PCB) 509, at its mounting interface such that the second electrical connector 500 is placed in electrical communication with the second printed circuit board 509. Thus, an electrical connector system can include the electrical connector assembly 310, including the first and second electrical connectors 400 and 500, mounted onto the respective printed circuit boards 409 and 509, respectively. Accordingly, when the first and second electrical connectors 400 and 500 are mated to each other, such that the mating interface 406 of the first electrical connector 400 engages with the mating interface 506 of the second electrical connector 500 to place the respective arrays of electrical contacts 404 and 504 in electrical communication with each other, the first and second electrical connectors 400 and 500 can operate to place the first printed circuit board in electrical communication with the second printed circuit board.

Similarly, the second electrical connector 500 can include a connector housing 512, which can be referred to as a second connector housing, that is configured to support the second array 502 of electrical contacts 504, which can be referred to as a second plurality of electrical contacts. The connector housing 512 can be made of any suitable dielectric material, such as plastic and the electrical contacts 504 can be made of any suitable electrically conductive material, such as metal. In accordance with the illustrated embodiment the connector housing 512 can be overmolded onto the electrical contacts 504. Alternatively, the electrical contacts 504 can be stitched into the connector housing 512 or otherwise supported by the connector housing 512 as desired. The connector housing 512 can include a housing body 514 that defines opposed first and second sides 514*a* and 514*b* that are spaced from each other along a first or longitudinal direction L, opposed third and fourth sides 514*c* and 514*d* that are spaced from each other along a second or lateral direction A that extends substantially perpendicular to the longitudinal direction L, an inner end 514*e*, and an outer end 514*f* that is spaced from the inner end 514*e* along a third or transverse direction T that extends substantially perpendicular to both the longitudinal direction L and the lateral direction A. The inner end 514*e* can define the mating interface 506, and the outer end 514*f* can define the mounting interface 508.

Because the mating interface 406 of the first electrical connector 400 and the mating interface 506 of the second electrical connector 500, respectively, are oriented substantially parallel to the respective mounting interfaces 408 and 508, the first and second electrical connectors 400 and 500 can be referred to as vertical or mezzanine electrical connectors. However it should be appreciated that one or both of the first and second electrical connectors 400 and 500 can be otherwise constructed as desired, for instance as right-angle electrical connectors such that the respective mating interfaces are oriented substantially perpendicular to the respective mounting interfaces.

Further in accordance with the illustrated embodiment, the electrical contacts 404 of the first array 402 of electrical contacts 404 are arranged into at least two such as a plurality of rows that extend along a row direction R that can be defined by the longitudinal direction L and into at least two such as a plurality of columns that extend substantially perpendicular to the rows along a column direction C that can be defined by the lateral direction A. As illustrated, each row or electrical contacts 404 can intersect with every column of electrical contacts 404, and each column of electrical contacts can intersect with every row of electrical contacts 404. In this regard, it can be said that each of the at least two rows of electrical contacts 404 intersects each of the at least two columns of electrical contacts 404. Similarly, in accordance with the illustrated embodiment, the electrical contacts 504 of the second array 502 of electrical contacts 504 are arranged into at least two such as a plurality of rows that extend along a row direction R that can be defined by the longitudinal direction L and into at least two such as a plurality of columns that extend substantially perpendicular to the rows along a column direction C that can be defined by the lateral direction A. As illustrated, each row or electrical contacts 504 can intersect with every column of electrical contacts 504, and each column of electrical contacts can intersect with every row of electrical contacts 504. In this regard, it can be said that each of the at least two rows of electrical contacts 504 intersects each of the at least two columns of electrical contacts 504. The arrays 402 and 502, respectively, can define any number of columns and rows of electrical contacts 404 and 504, respectively, as desired as described herein. The rows and columns of the first and second electrical connectors 400 and 500 can be numerically and spatially identical to each other.

Figure 9A:
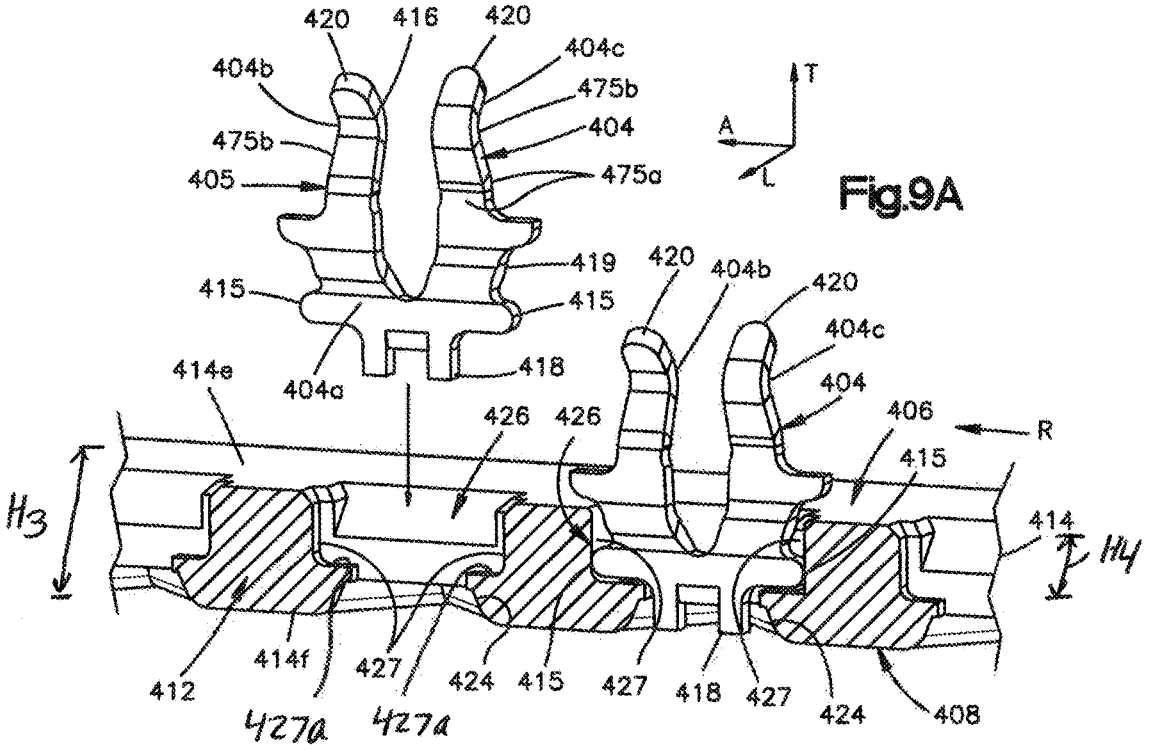
FIG. 9A is a partial exploded perspective view of one of the electrical contacts of the receptacle connector shown being inserted into the connector housing, and shown inserted in the connector housing.
Figure 9B:
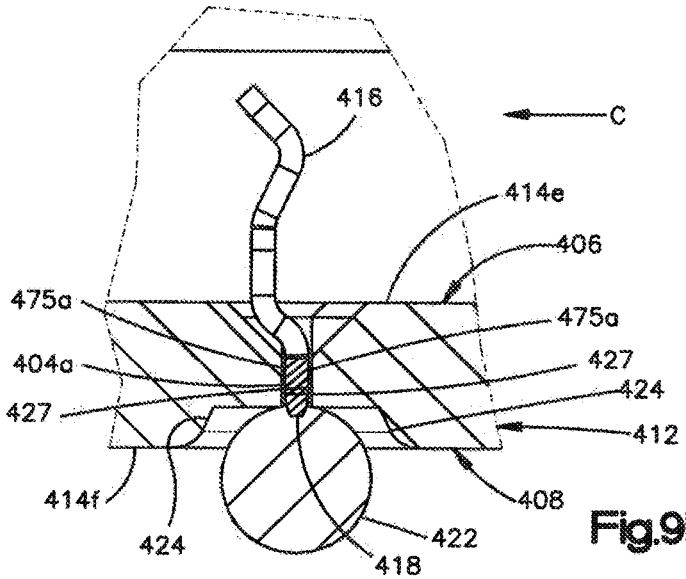
FIG. 9B is a sectional side elevation view of the electrical contact illustrated in FIG. 9A, shown inserted in the connector housing.

Referring also to FIGS. 9A-9B, each electrical contact 404 can have a contact body 405 that defines a mating end 416 that extends out from that mating interface 406, an opposed mounting end 418 that extends out from the mounting interface 408, and a lead portion 419 that extends between the mating end 416 and the mounting end 418. At least a portion of the contact body 405 of each electrical contact 404 can be curved between the mating and mounting ends 416 and 418, respectively, as it extends between the mating end 416 and the mounting end 418 along the transverse direction T. As described in U.S. Pat. No. 6,042,389, which is incorporated by reference as if set forth in its entirety herein, each of the electrical contacts 404 can be a receptacle contact that include a base 404*a*, and a pair of cantilevered spring arms, including a first spring arm 404*b* and a second spring arm 404*c* that each extends from the base 404*a* along the transverse direction T toward the inner end 414*e*, such that the mounting end 418 extend from the base 404*a* toward the outer end 414*f*. Each spring arm 404*b* and 404*c* can be resiliently supported by the base 404*a*, and can extend from the base 404*a* to a respective free distal tip 420. The base 404*a* can be defined by the lead portion 419.

Each of the first cantilevered spring arm 404*b* and the second cantilevered spring arm 404*c* of each electrical contact 404 can be offset from each other both along the row direction R such that each electrical contact defines a gap between the spring arms 404*b* and 404*c* along the row direction R. The spring arms 404*b* and 404*c* can further be spaced from each other along the column direction C. For instance, each spring arm 404*b* and 404*c* can further define a curved region between the base 404*a* and the respective distal tip 420, for instance a region of generally "S" shaped curvature. Thus, the tip 420 of each spring arm 404*b* and 404*c* is offset along the longitudinal direction L with respect to the mounting end 418. One of the spring arms 404*b* and 404*c* can be curved such that the distal tip 420 is offset toward one of the first side 414*a* or the second side 414*b* with respect to the mounting end 418, and the other of the spring arms 404*b* and 404*c* can be curved such that the distal tip 420 is offset toward the other of the first side 414*a* or the second side 414*b* with respect to the mounting end 418. The first and second spring arms 404*b* and 404*c* are configured to flex with respect to the base 404*a* away from each other when a plug mating end, for instance of the second electrical connector 500 is inserted between the spring arms 404*b* and 404*c* along the column direction C.

The electrical contacts 404 can further include respective solder balls 422 that project out from the mounting end 418 proximate to the mounting interface 408. The solder balls 422 can be attached or otherwise supported by the mounting ends 418, for instance fused to the mounting end 418, and are configured to be mounted to corresponding electrical contacts, for instance electrically conductive contact pads of the printed circuit board, for instance by positioning the first electrical connector 400 on the first printed circuit board and subjecting the first electrical connector 400 and the first printed circuit board to a solder reflow process whereby the solder balls 422 fuse to the respective contact pads of the first printed circuit board. The solder balls 422 can all be co-planar with each other along the mounting interface 408, both before and after the solder reflow process is completed. It should further be appreciated that the electrical contacts 404 are not limited to the illustrated mounting ends 418, and that the mounting ends 418 can be alternatively configured with any other suitable fusible or non-fusible element as desired, such as press-fit mounting tails configured to be inserted into complementary vias of the first printed circuit board.

The first electrical connector 400 can define a plurality of pockets 424 that extend into the housing body 414 along the transverse direction T. For instance, the pockets 424 can extend into the outer end 414*f* of the housing body 414 of the connector housing 412 along the transverse direction T toward the inner end 414*e*. The mounting ends 418 of the contact body 405 can extend into the pockets 424, such that the solder balls 422 are disposed in respective ones of the pockets 424. Accordingly, the mounting ends of each of the electrical contacts 404, which can include the mounting ends 418 of the contact body 405 and the respective solder ball 422 can be at least partially disposed in the pockets 424. Thus, when the first array 402 of electrical contacts 404 is supported by the connector housing 412, each solder ball 422 is at least partially recessed with respect to the outer end 414*f* of the housing body 414, in a respective one of the plurality of pockets 424. In this regard, it can be said that the solder balls 422 of the first array 402 of electrical contacts 404 protrude out with respect to the outer end 414*f* of the housing body 414.

With continuing reference to FIGS. 9A-B, the connector housing 412 can further define a plurality of retention apertures that extend through the housing body 414 along the transverse direction T from the inner end 414*e* of the housing body 414 of the connector housing 412 to the outer end 414*f* of the housing body 414. The retention apertures can include retention cavities 426 that extend into the inner end 414*e* of the housing body 414 of the connector housing 412 along the transverse direction T, and the plurality of pockets 424 that are substantially aligned with the retention cavities 426 along the transverse direction T. The retention cavities 426 can be configured to at least partially receive a respective retention portion of the electrical contacts 404, such that when the first array 402 of electrical contacts 404 is supported by the connector housing 412, the mating end 416 of each electrical contact 404 protrudes out with respect to the inner end 414*e* of the housing body 414. Each retention cavity 426 can be at least partially defined by at least one inner wall 427. Further, each retention cavity 426 can be at least partially defined by a shelf 427*a* that extends in from the inner walls 427 at a location between the inner end 414*e* and the outer end 414*f*. Each shelf 427*a* can be substantially parallel to the inner end 414*e* and the outer end 414*f*. The pockets 424 can be disposed between the shelf 427*a* and the outer end 414*f*. The connector housing 412 can define a height H3 along the transverse direction T from the inner end 414*e* to the outer end 414*f* from 0.3 mm to 0.7 mm, for instance 0.5 mm. The connector housing 412 can define a height H4 along the transverse direction T from the inner end 414*e* to the shelf 427*a* from 0.2 mm to 0.4 mm, for instance 0.3 mm.

The electrical contacts 404 can include broadsides 475*a* and edges 475*b* as defined above with respect to the electrical contacts 104. The electrical contacts 404 can further include a retention portion that includes at least one retention wing 415, for instance first and second opposed retention wings 415 that project out from opposed sides of the base 404*a*, for instance along the row direction R. Thus, the retention wings 415 that project out from opposed sides of the base 404*a* in opposite directions along a first direction that separates opposed edges of the electrical contacts 404. The retention wings 415 can extend to a location outboard of both the base 404*a* portion and the respective ones of the first and second spring arms 404*b* and 404*c*. The retention wings 415 can project out to respective free distal tips 415*a* that are spaced from each other connector a distance along a select direction that is slightly greater than the cross-sectional dimension of the retention cavity 426 along the select direction. Accordingly, the retention wings 415 can be press-fit against the at least one inner wall 427 so as to retain the electrical contact 402 in the connector housing 412. Thus, in accordance with one embodiment, the electrical contacts 404 touch the connector housing 412 at only two locations, defined by respective abutments between the retention wings 415 and the at least one inner wall 427. Further, as illustrated in FIG. 9B, the broadsides of the electrical contacts 404 are spaced from the at least one inner wall 427, along a second direction that separates the opposed broadsides, along an entirety of a length between the opposed retention wings 415 along the first direction that separates the opposed edges. Further, the broadsides 420 can be continuous from one of the retention wings 415 to the other of the retention wings, and from each of the spring arms 404*b* and 404*c* to the mounting end 418. Moreover, the electrical contacts 404 can be devoid of enclosed apertures that extend through the contact body 405 from one broadside to the other broadside. Because wicking of solder flux during the solder reflow operation is directed toward contact locations between the contact body 405 and the connector housing 412, the electrical contacts are configured such that any wicking will occur between the retention wings 415 and the connector housing 412, which is offset from a data flow path between the mounting end 418 and each of the spring arms 404*b* and 404*c*. Thus, the data flow path is substantially devoid of wicked solder flux. Furthermore, because the contact body is substantially planar in the cavity 424, the solder is able to substantially fill the cavity 424 during the solder reflow operation. Each electrical contact 404 can define a thickness in the longitudinal direction L of approximately 0.1 mm. Thus, the opposed broadsides of each electrical contact 404 can be spaced from each other a distance of approximately 0.1 mm. The thickness can be defined by the sheet of material that forms the electrical contacts 404 before the electrical contacts are stamped or otherwise cut from the sheet of material. Each of the retention wings 415 can be curved. For instance, each of the retention wings 415 can be defined by a radius. For instance, each of the retention wings 415 can be defined by a radius of approximately 0.6 mm. Each of the retention wings 415 can define a contact area defined at a location where the retention wing 415 abuts the connector housing 412. The contact area can thus be defined by the thickness of the electrical contact 404 in the longitudinal direction L and a contact height dimension along the transverse direction T, from 0.01 mm to 0.15 mm, of the electrical contact at the retention wings 415 that are in physical contact with the connector housing. For instance, the contact height dimension of each wing 415 can be 0.06 mm. Thus, the contact area can be between 0.001 mm squared and 0.015 mm squared, such as 0.012 mm squared. One or both of the connector housing 412 and the electrical contact, at the wings 415, can deform when the electrical contacts 404 are mounted in the connector housing 412 to define the contact height dimension. Without being bound by theory, it is believed that the reduction of a cumulative contact area defined by all of the electrical contacts 404 and the connector housing 412 is reduced with respect to conventional electrical connectors, which correspondingly reduces internal forces applied by the electrical contacts 404 to the connector housing 412 that might otherwise cause the connector housing 412 to deform, particularly the inner and outer ends 414*e* and 414*f*, during the solder reflow operation. The reduction of internal forces thus allows the connector housing 414 to have a reduced height along the transverse direction T with respect to conventional connector housings 414 while maintaining the planarity of the inner and outer ends 414*e* and 414*f*, and further maintaining the co-planarity of the solder balls 422.

Figure 10A:
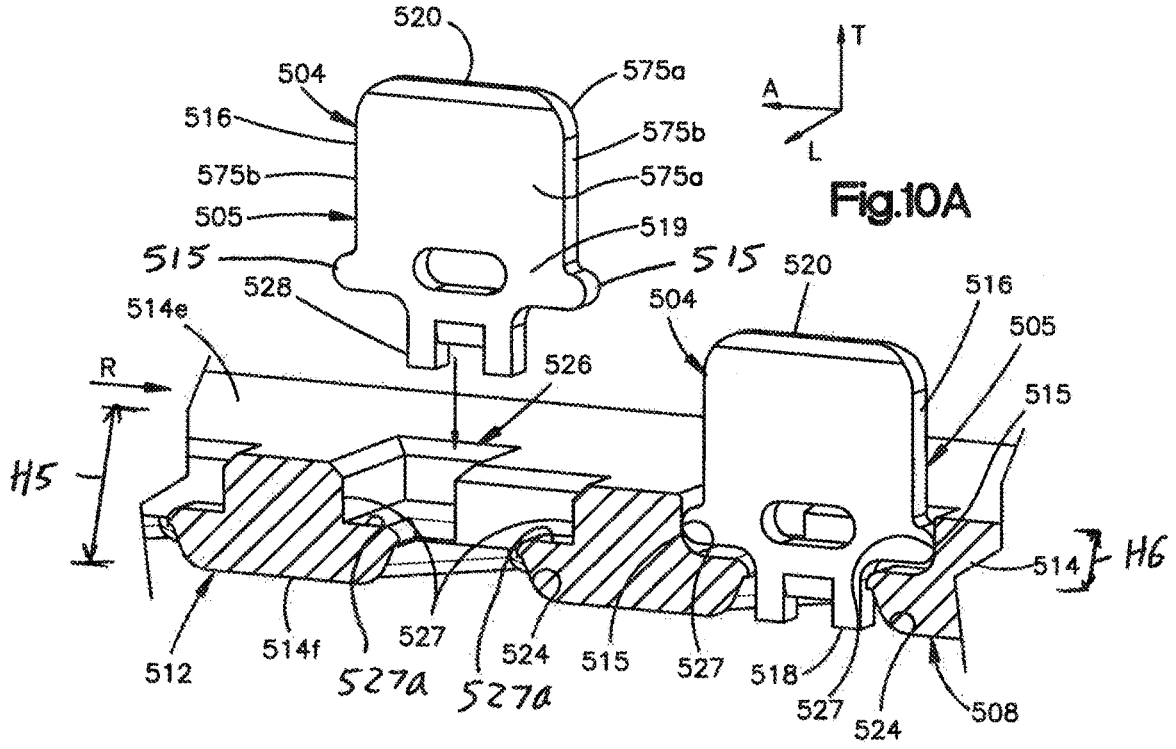
FIG. 10A is a partial exploded perspective view of one of the electrical contacts of the header connector shown being inserted into the connector housing, and shown inserted in the connector housing.
Figure 10B:
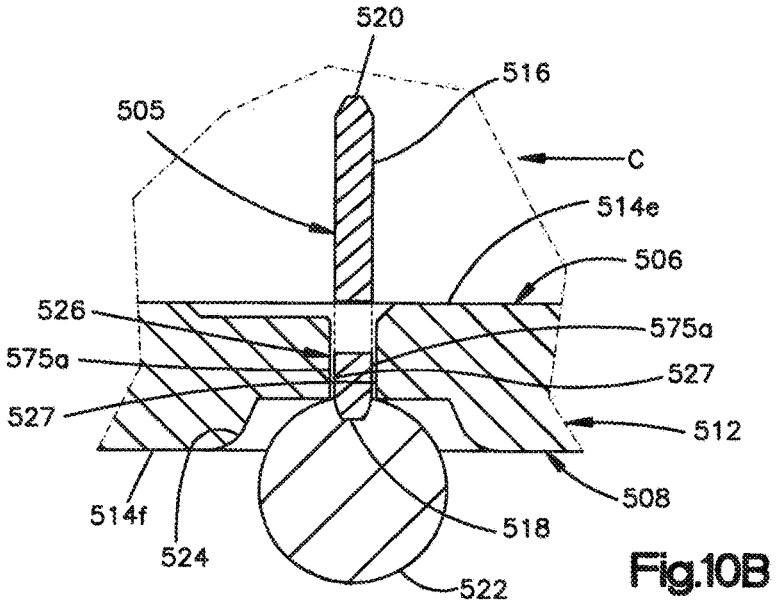
FIG. 10B is a sectional side elevation view of the electrical contact illustrated in FIG. 10A, shown inserted in the connector housing.
Figure 11B:
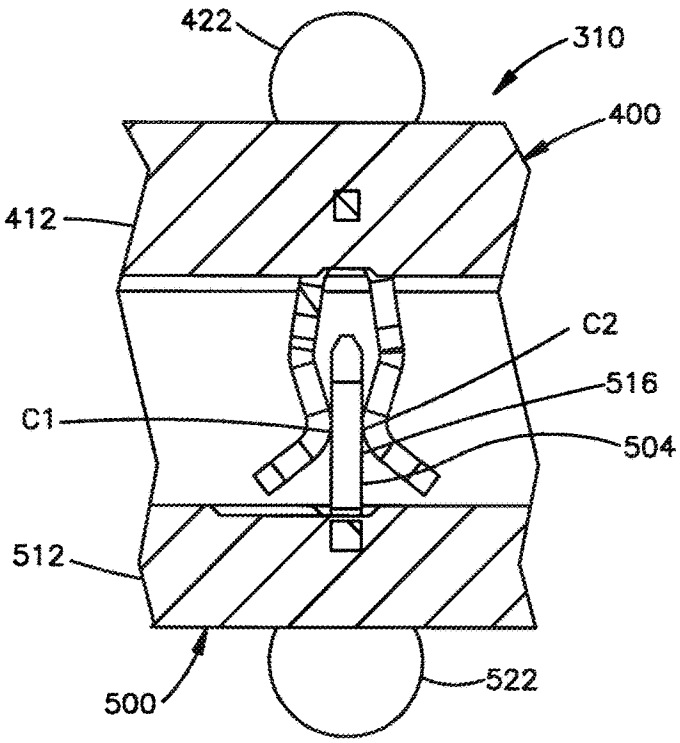
FIG. 11B is a side elevation view of the electrical contacts illustrated in FIG. 11A shown mated.
Figure 11A:
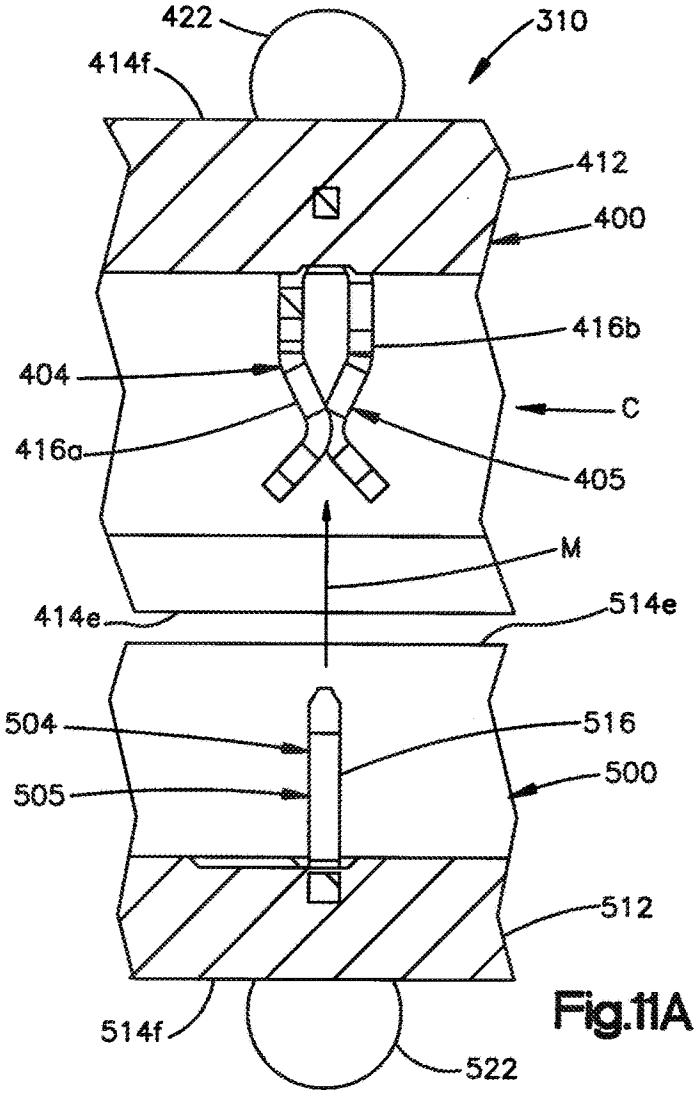
FIG. 11A is a side elevation view of the electrical contacts of the header connector aligned to be mated with the electrical contacts of the receptacle connector.

Referring now also to FIGS. 10A-10B, each of the electrical contacts 504 can have a contact body 505 that defines a mating end 516 that extends out from that mating interface 506, an opposed mounting end 518 that extends out from the mounting interface 508, and a lead portion 519 that extends between the mating end 516 and the mounting end 518. As described in U.S. Pat. No. 6,042,389, which is incorporated by reference as if set forth in its entirety herein, each of the electrical contacts 504 can be configured as a plug contact. Thus, the mating end 516 can define a blade that is planar and is oriented to lies within a plane defined by the lateral direction A and the transverse direction T. The mating end 516 can define a distal tip 520 that is inline with the mounting end 518 along the transverse direction T. The mating end 516 can have a dimension in the lateral direction A that is greater than the gap that separates the first and second spring arms 404*b* and 404*c*.

The electrical contacts 504 can further include respective solder balls 522 that project out from the mounting end 518 proximate to the mounting interface 508. The solder balls 522 can be attached or otherwise supported by the mounting ends 518, for instance fused to the mounting end 518, and are configured to be mounted to corresponding electrical contacts, for instance electrically conductive contact pads of a second printed circuit board, for instance by positioning the first electrical connector 500 on the second printed circuit board and subjecting the second electrical connector 500 and the second printed circuit board to a solder reflow process whereby the solder balls 522 fuse to the respective contact pads of the second printed circuit board. The solder balls 522 can all be co-planar with each other along the mounting interface 508, both before and after the solder reflow process is completed. Thus, all of the solder balls 422 at the mounting ends of first electrical connector 400 are coplanar with each other in a first plane, both before and after the solder balls 422 are reflowed to the first printed circuit board so as to mount the first electrical connector 400 to the first printed circuit board. Similarly, all of the solder balls 522 at the mounting ends of the second electrical connector 500 are coplanar with each other in a second plane, both before and after the solder balls 522 are reflowed to the second printed circuit board so as to mount the second electrical connector 500 to the second printed circuit board. The first plane can be parallel with the second plane. It should further be appreciated that the electrical contacts 504 are not limited to the illustrated mounting ends 518, and that the mounting ends 518 can be alternatively configured with any other suitable fusible or non-fusible element as desired, such as press-fit mounting tails configured to be inserted into complementary vias of the second printed circuit board.

The second electrical connector 500 can define a plurality of pockets 524 that extend into the housing body 514 along the transverse direction T. For instance, the pockets 524 can extend into the outer end 514*f* of the housing body 514 of the connector housing 512 along the transverse direction T toward the inner end 514*e*. The mounting ends 518 of the contact body 505 can extend into the pockets 524, such that the solder balls 522 are disposed in respective ones of the pockets 524. Accordingly, the mounting ends of each of the electrical contacts 504, which can include the mounting ends 518 of the contact body 505 and the respective solder ball 522 can be at least partially disposed in the pockets 524. Thus, when the first array 502 of electrical contacts 504 is supported by the connector housing 512, each solder ball 522 is at least partially recessed with respect to the outer end 514*f* of the housing body 514, in a respective one of the plurality of pockets 524. In this regard, it can be said that the solder balls 522 of the first array 502 of electrical contacts 504 protrude out with respect to the outer end 514*f* of the housing body 514.

With continuing reference to FIGS. 10A-B, the connector housing 512 can further define a plurality of retention apertures that extend through the housing body 514 along the transverse direction T from the inner end 514*e* of the housing body 514 of the connector housing 512 to the outer end 514*f* of the housing body 514. The retention apertures can include retention cavities 526 that extend into the inner end 514*e* of the housing body 514 of the connector housing 512 along the transverse direction T, and the plurality of pockets 524 that are substantially aligned with the retention cavities along the transverse direction T. Each of the retention cavities 526 and can be configured to at least partially receive a respective retention portion of the electrical contacts 504, such that when the first array 502 of electrical contacts 504 is supported by the connector housing 512, the mating end 516 of each electrical contact 504 protrudes out with respect to the inner end 514*e* of the housing body 514. Each retention cavity 526 can be at least partially defined by at least one inner wall 527. Further, each retention cavity 526 can be at least partially defined by a shelf 527*a* that extends in from the inner walls 527 at a location between the inner end 514*e* and the outer end 514*f*. Each shelf 527*a* can be substantially parallel to the inner end 514*e* and the outer end 514*f*. The pockets 524 can be disposed between the shelf 527*a* and the outer end 514*f*. The connector housing 512 can define a height H5 along the transverse direction T from the inner end 514*e* to the outer end 514*f* from 0.2 mm to 0.6 mm, for instance 0.4 mm. The connector housing 512 can define a height H6 along the transverse direction T from the inner end 514*e* to the shelf 527*a* from 0.2 mm to 0.4 mm, for instance instance 0.3 mm.

The electrical contacts 504 can include broadsides 575*a* and edges 575*b* as defined above with respect to the electrical contacts 204. The electrical contacts 504 can further include a retention portion that includes at least one retention wing 515, for instance first and second opposed retention wings 515 that project out from opposed sides of the lead portion 519, for instance along the row direction R. Thus, the retention wings 515 that project out from opposed sides of the base 504*a* in opposite directions along a first direction that separates opposed edges of the electrical contacts 504. The retention wings 515 can extend to a location outboard of one or both of the mating end 516 and the mounting end 518. The retention wings 515 can project out to respective free distal tips 515*a* that are spaced from each other connector a distance along a select direction that is slightly greater than the cross-sectional dimension of the retention cavity 526 along the select direction. Accordingly, the retention wings 515 can be press-fit against the at least one inner wall 527 so as to retain the electrical contact 502 in the connector housing 512. Accordingly, the retention wings 515 can be press-fit against the at least one inner wall 527 so as to retain the electrical contact 502 in the connector housing 512. Thus, in accordance with one embodiment, the electrical contacts 504 touch the connector housing 512 at only two locations, defined by respective abutments between the retention wings 515 and the at least one inner wall 527. Further, as illustrated in FIG. 10B, the broadsides of the electrical contacts 504 are spaced from the at least one inner wall 527, along a second direction that separates the opposed broadsides, along an entirety of a length between the opposed retention wings 515 along the first direction that separates the opposed edges. Because wicking of solder flux during the solder reflow operation is directed toward contact locations between the contact body 505 and the connector housing 512, the electrical contacts are configured such that any wicking will occur between the retention wings 515 and the connector housing 512, which is offset from a data flow path between the mating end 516 and the mounting end 518. Thus, the data flow path is substantially devoid of wicked solder flux. Furthermore, because the contact body is substantially planar in the cavity 524, the solder is able to substantially fill the cavity 524 during the solder reflow operation. Each electrical contact 504 can define a thickness in the longitudinal direction L of approximately 0.1 mm. Thus, the opposed broadsides of each electrical contact 504 can be spaced from each other a distance of approximately 0.1 mm. The thickness can be defined by the sheet of material that forms the electrical contacts 504 before the electrical contacts are stamped or otherwise cut from the sheet of material. Each of the retention wings 515 can be curved. For instance, each of the retention wings 515 can be defined by a radius. For instance, each of the retention wings 515 can be defined by a radius of approximately 0.6 mm. Each of the retention wings 515 can define a contact area defined at a location where the retention wing 515 abuts the connector housing 512. The contact area can thus be defined by the thickness of the electrical contact 504 in the longitudinal direction L and a contact height dimension along the transverse direction T, from 0.01 mm to 0.15 mm, of the electrical contact at the retention wing 515 that is in physical contact with the connector housing. For instance, the contact height dimension of each wing 415 can be 0.06 mm. Thus, the contact area can be between 0.001 mm squared and 0.015 mm squared, such as 0.012 mm squared. One or both of the connector housing 512 and the electrical contact, at the retention wings 515, can deform when the electrical contacts 504 are mounted in the connector housing 512 to define the contact height dimension. Without being bound by theory, it is believed that the reduction of a cumulative contact area defined by all of the electrical contacts 504 and the connector housing 512 is reduced with respect to conventional electrical connectors, which correspondingly reduces internal forces applied by the electrical contacts 504 to the connector housing 512 that might otherwise cause the connector housing 512 to deform, particularly the inner and outer ends 514*e* and 514*f*, during the solder reflow operation. The reduction of internal forces thus allows the connector housing 514 to have a reduced height along the transverse direction T with respect to conventional connector housings 514 while maintaining the planarity of the inner and outer ends 514*e* and 514*f*, and further maintaining the co-planarity of the solder balls 522.

Each of the first and second electrical connectors 400 and 500 can include at least one alignment member configured to engage each other so as to ensure that the respective electrical contacts 404 and 504 are aligned to be mated when the first and second electrical connectors 400 and 500 are mated with each other along the mating direction M. Each of the first and second electrical connectors 400 and 500 can further include at least one orientation member orientation member configured to engage each other only when the first and second electrical connectors 400 and 500 are in a predetermined orientation with relative to each other, thereby ensuring the relative orientation when the first and second electrical connectors 100 and 200 are mated to each other. For instance, accordance with one embodiment, the first electrical connector 400 can include at least one recess, such as a first recess 455*a* and a second recess 455*b* that extend at least into the connector housing 412, from the inner end 414*e* toward the outer end 414*f*, for instance from the inner end 414*e* to the outer end 414*f*. The first recess 455*a* can be disposed at the first side 414*a* of the connector housing 412, and the second recess 455*b* can be disposed at the second side 414*b* of the connector housing 412. The recesses 455*a* and 455*b* can define different lengths along the longitudinal direction L.

The second electrical connector 500 can include at least one protrusion such as a first protrusion 555*a* and a second protrusion 555*b* that extend out from the inner end 514*e* along the transverse direction T. The first protrusion 555*a* can be disposed at the first side 514*a* and the second protrusion 555*b* can be disposed at the second side 514*b*. The first protrusion 555*a* can defined a length along the longitudinal direction sized to be received in the first recess 455*a*. The second protrusion 555*b* can be split so as to defined two second protrusion portions, or can be a single continuous structure, and can define a length along the longitudinal direction L sized to be received in the second recess 455*b*, and sized greater than that of the first recess 455*a*. Thus, the first and second electrical connectors 400 and 500 are only able to mate with each other when the first protrusion 555*a* is aligned with the first recess 455*a*, and the second protrusion 555*b* is aligned with the second recess 455*b*. It should be appreciated that the first and second electrical connectors 400 and 500 can include any suitable alternative alignment member as desired. For instance, the first electrical connector 400 can include one or more projections and the second electrical connector 500 can include one or more recesses.

Referring now also to FIGS. 8A-8B and 11A-11B, the mating ends 516 of the electrical contacts 504 are aligned with the mating ends 416 of the respective electrical contacts 404 so as to be inserted between the respective spring arms 404*b* and 404*c* along the column direction C when the first and second electrical connectors 400 and 500 are mated with each other. The spring arms 404*b* and 404*c* are elastically flexible and resilient so as to deflect away from each other about the base 404*a* along the column direction C as the mating ends 416 are inserted therebetween. The resiliency of the spring arms 404*b* and 404*c* defines a normal spring force against the mating end 516 that is inserted between the spring arms 404*b* and 404*c*. Because the mating ends 516 define a length along the row direction greater than that gap between the adjacent spring arms 404*b* and 404*c*, the mating ends 516 define first and second contact locations C1 and C2 with the first and second spring arms 404*b* and 404*c*, respectively. The first and second contact locations C1 and C2 can be disposed on opposed sides of the mating ends 516. For instance, the first and second contact locations C1 and C2 can be disposed on opposed broadsides of the electrical contacts 504. Thus, each of the electrical contacts 404 are placed in physical and electrical contact with a respective one of the electrical contacts 504, and each of the electrical contacts 504 are placed in physical and electrical contact with a respective one of the electrical contacts 404. The mating ends 416 of the electrical contacts 404 of the first electrical connector 400 can be configured as receptacle mating ends that are configured to receive complementary mating ends of the electrical contacts 504 of the second electrical connector 500 as described above, so as to mate with the electrical contacts 504. In this regard, the first electrical connector 400 can be referred to as a receptacle electrical connector, and the second electrical connector 500 can be referred to as a header electrical connector. However it should be appreciated that the first and second electrical connectors 400 and 500, respectively, are not limited to the illustrated mating ends, and that the electrical contacts of one or both of the first and second electrical connectors 400 and 500 can be alternatively be configured with any other suitable mating ends as desired. For instance, the electrical contacts of the first and second electrical connectors 400 or 500 can be alternatively configured with electrical receptacle contacts in the manner des When the first and second electrical connectors 400 and 500 are fully mated to each other, the electrical connector assembly 310 can define a stack height within a range having a lower end between and including approximately 1 mm and approximately 2 mm, and increments of 0.1 mm therebetween. The range can have an upper end between and including approximately 2 mm and approximately 4 mm, and increments of 0.1 mm therebetween. For instance, the stack height can be approximately 2 mm. The stack height can further be approximately 3 mm. The stack height can be defined by a distance along the transverse direction T between respective locations on the solder balls 422 of the electrical contacts 404 that are spaced furthest from the inner end 414*e* of the housing body 414 of the connector housing 412 and respective locations on the solder balls 522 of the electrical contacts 504 that are spaced furthest from the inner end 514*e* of the housing body 514. Otherwise stated, the stack height can be defined by opposed outermost ends, along the transverse direction T, of the solder balls 422 of the first electrical connector 400 and solder balls 522 of the second electrical connector 500.

It should be noted that the illustrations and discussions of the embodiments shown in the figures are for exemplary purposes only, and should not be construed limiting the disclosure. One skilled in the art will appreciate that the present disclosure contemplates various embodiments. Additionally, it should be understood that the concepts described above with the above-described embodiments may be employed alone or in combination with any of the other embodiments described above. For example, it should be appreciated that the alignment members of the first and second electrical connectors 100-200 can be combined with or otherwise integrated with the alignment members of the first and second electrical connectors 300-400, and so on, unless otherwise indicated. It should further be appreciated that the various alternative embodiments described above with respect to one illustrated embodiment can apply to all embodiments as described herein, unless otherwise indicated.

What is claimed:

1. An electrical connector comprising:

a connector housing;

an array of electrical contacts supported by the connector housing, the array of electrical contacts including at least two rows of electrical contacts that are spaced from each other and extend along a first direction, and at least two columns of electrical contacts that are spaced from each other and extend along a second direction that is substantially perpendicular to the first direction, each of the at least two rows of electrical contacts intersecting each of the at least two columns of electrical contacts, and wherein mating ends of the electrical contacts in the array have curved shapes and are configured to mate with a mating end of another electrical contact having a like curved shape; and an alignment member that is disposed at substantially a geometric center of the array of electrical contacts such that the alignment member is disposed between the least two rows of electrical contacts and further disposed between the at least two columns of electrical contacts, wherein the alignment member is configured to mate with another alignment member having a like alignment member.

2. The electrical connector as recited in claim 1, wherein the alignment member comprises a post that extends outward with respect to the connector housing along a third direction that is substantially perpendicular to both the first direction and the second direction.

3. The electrical connector as recited in claim 2, wherein the alignment member further comprises a receptacle that is disposed adjacent to the post.

4. The electrical connector as recited in claim 3, wherein the receptacle is spaced from, and aligned with, the post along the second direction.

5. The electrical connector as recited in claim 4, wherein each electrical contact of the array of electrical contacts includes the mating end and an opposed mounting end, and a fusible element disposed at the mounting end.

6. The electrical connector as recited in claim 1, wherein the connector housing includes a housing body that defines an outer perimeter and the connector housing further includes a second alignment member that protrudes from the housing body along a portion of the perimeter.

7. The electrical connector as recited in claim 6, wherein the second alignment member comprises one or more sidewalls disposed on the outer perimeter.

8. The electrical connector as recited in claim 1, wherein 1) the connector housing includes a housing body and a plurality of retention apertures that extend through the housing body in a transverse direction so as to define respective pluralities of first and second retention ribs spaced from each other along a dimension along a direction perpendicular to the transverse direction, 2) the electrical contacts are press-fit into respective ones of the retention apertures, and 3) each of the first and second retention ribs has a height along the transverse direction between 0.02 mm and 0.15 mm.

9. The electrical connector as recited in claim 8, wherein the height of one of the first and second retention ribs is 0.04 mm and the height of the other of the first and second retention ribs is 0.08 mm.

10. An electrical connector assembly comprising:

a first electrical connector having a first connector housing including a first monolithic housing body, a first array of electrical contacts supported by the first monolithic housing body, and a first alignment member that defines an outer perimeter, the first alignment member supported by the first monolithic housing body and disposed at substantially a geometric center of the first array of electrical contacts such that the outer perimeter of the first alignment member is substantially surrounded by respective electrical contacts of the first array of electrical contacts; and a second electrical connector configured to be mated to the first electrical connector, the second electrical connector having a second connector housing including a second monolithic housing body, a second array of electrical contacts supported by the second monolithic housing body, and a second alignment member that defines an outer perimeter, the second alignment member supported by the second monolithic housing body and disposed at substantially a geometric center of the second array of electrical contacts such that the outer perimeter of the second alignment member is substantially surrounded by respective electrical contacts of the second array of electrical contacts, the second alignment member configured to mate with the first alignment member of the first electrical connector so as to substantially align the first and second arrays of electrical contacts relative to each other as the first and second electrical connectors are mated to each other.

11. The electrical connector assembly as recited in claim 10, wherein the electrical contacts of the first array do not mate with the electrical contacts of the second array unless the first and second alignment members are aligned with each other.

12. The electrical connector assembly as recited in claim 10, wherein the first alignment member comprises a first post and a first receptacle disposed adjacent the first post and the second alignment member comprises a second post and a second receptacle disposed adjacent the second post, the first post received in the second receptacle and the second post received in the first receptacle when the first electrical connector is mated to the second electrical connector.

13. The electrical connector assembly as recited in claim 10, each electrical contact of the first array of electrical contacts includes a mating end and an opposed mounting end supporting a fusible element and each electrical contact of the second array of electrical contacts includes a mating end and an opposed mounting end supporting a fusible element.

14. The electrical connector assembly as recited in claim 13, wherein when the first and second electrical connectors are mated to each other each fusible element of the first array of electrical contacts is spaced from a corresponding fusible element of the second array of electrical contacts a distance of between 1 mm and 4 mm.

15. The electrical connector assembly as recited in claim 14, wherein the distance is approximately 2 mm.

16. The electrical connector assembly as recited in claim 10, wherein the first and second electrical connectors are substantially identical with respect to each other.

17. The electrical connector as recited in claim 10, wherein 1) each of the connector housings includes a plurality of retention apertures that extend through the respective housing body in a transverse direction so as to define respective pluralities of first and second retention ribs spaced from each other along a dimension along a direction perpendicular to the transverse direction, 2) the electrical contacts are press-fit into respective ones of the retention apertures, and 3) each of the first and second retention ribs has a height along the transverse direction between 0.02 mm and 0.15 mm.

18. The electrical connector as recited in claim 17, wherein the height of one of the first and second retention ribs is 0.04 mm and the height of the other of the first and second retention ribs is 0.08 mm.

* * * * *